US005382488A

United States Patent [19]

Kato et al.

[11] Patent Number: 5,382,488

[45] Date of Patent: Jan. 17, 1995

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 64,056

[22] PCT Filed: Sep. 18, 1992

[86] PCT No.: PCT/JP92/01194

§ 371 Date: May 18, 1993

§ 102(e) Date: May 18, 1993

[30] Foreign Application Priority Data

| | | | |
|---|---|---|---|
| Sep. 19, 1991 | [JP] | Japan | 3-266903 |
| Oct. 23, 1991 | [JP] | Japan | 3-302659 |
| May 6, 1992 | [JP] | Japan | 4-139630 |
| May 6, 1992 | [JP] | Japan | 4-139631 |

[51] Int. Cl.[6] ..... G03G 5/087; G03G 5/09

[52] U.S. Cl. ..... 430/95; 430/91; 430/92; 430/93; 430/96

[58] Field of Search ..... 430/84, 87, 88, 90, 430/91, 92, 93, 96, 95

[56] References Cited

FOREIGN PATENT DOCUMENTS

| | | |
|---|---|---|
| 125266 | 5/1990 | Japan . |
| 127651 | 5/1990 | Japan . |
| 135457 | 5/1990 | Japan . |
| 167551 | 6/1990 | Japan . |
| 2870 | 1/1991 | Japan . |
| 13951 | 1/1991 | Japan . |
| 17664 | 1/1991 | Japan . |
| 29954 | 2/1991 | Japan . |
| 39967 | 2/1991 | Japan . |
| 42665 | 2/1991 | Japan . |
| 42666 | 2/1991 | Japan . |
| 46665 | 2/1991 | Japan . |

*Primary Examiner*—Roland Martin

*Attorney, Agent, or Firm*—Sughrue, Mion, Zinn, Macpeak & Seas

[57] ABSTRACT

An electrophotographic light-sensitive material which has improved electrostatic characteristics and image forming performance and is excellent particularly in reproducibility of highly accurate image using a liquid developer and image forming performance upon a scanning exposure system using a laser beam of a low power.

The electrophotographic light-sensitive material contains, as a binder resin, a low molecular weight resin (A) comprising an organic molecule having bonded thereto at least three polymer chains each containing a polymer component of formula (I) and a polymer component having a specified polar group, and a resin (B) which is a medium to high molecular weight AB block copolymer comprising an A block containing a specified polar group and a B block containing a polymer component of formula (I).

Formula (I)

wherein $a^1$ and a2: hydrogen, halogen, a cyano group, a hydrocarbon group, —$COOR^4$ or —$COOR^4$ bonded via a hydrocarbon group ($R^4$: hydrocarbon group); and $R^3$: a hydrocarbon group.

9 Claims, No Drawings

ELECTROPHOTOGRAPHIC LIGHT-SENSITIVE MATERIAL

TECHNICAL FIELD

The present invention relates to an electrophotographic light-sensitive material, and more particularly to an electrophotographic light-sensitive material which is excellent in electrostatic characteristics and moisture resistance.

TECHNICAL BACKGROUND

An electrophotographic light-sensitive material may have various structures depending upon the characteristics required or an electrophotographic process to be employed.

Typical electrophotographic light-sensitive materials widely employed comprise a support having provided thereon at least one photoconductive layer and, if necessary, an insulating layer on the surface thereof. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing .On the order of from several hundreds to several thousands prints having a high image quality.

Under these circumstances, binder resins which are used for forming the photoconductive layer of an electrophotographic light-sensitive material are required to be excellent in the film-forming properties by themselves and the capability of dispersing photoconductive powder therein. Also, the photoconductive layer formed using the binder resin is required to have satisfactory adhesion to a base material or support. Further, the photoconductive layer formed by using the binder resin is required to have various excellent electrostatic characteristics such as high charging capacity, small dark decay, large light decay, and less fatigue due to prior light-exposure and also have excellent image forming properties, and the photoconductive layer stably maintains these electrostatic properties in spite of the fluctuation in humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

It has been found that the chemical structure of binder resin used in a photoconductive layer which contains at least an inorganic photoconductive substance, a spectral sensitizing dye and a binder resin has a great influence upon the. electrostatic characteristics as well as smoothness of the photoconductive layer. Among the electrostatic characteristics, dark charge retention rate (D.R.R.) and photosensitivity are particularly affected.

Techniques for improvements in smoothness and electrostatic characteristics of a photoconductive layer by using various types of low molecular weight resins having a component containing an acidic group are described, for example, in JP-A-63-217354 (the term "JP-A" as used herein means an "unexamined published Japanese Patent Application"), U.S. Pat. Nos. 4,968,572, 5,021,311, 5,134,051, 4,495,407, 5,063,130 and 5,089,368, EP-A-0389928 and EP-A-0432727.

Also, it is presumed that, even when the stoichiometeric defect of the inorganic photoconductive substance varies to some extents, a relatively stable interaction between the inorganic photoconductive substance, spectral sensitizing dye and resin may be maintained since the resin has a sufficient adsorptive domain by the function and mechanism of these various low molecular weight resins. In particular, when a graft type copolymer or an AB block copolymer is used, it is known that relatively stable performances can be obtained even when ambient conditions are varied.

Further, techniques for improving a mechanical strength of a photoconductive layer by using the above described low molecular weight resins containing an acidic group together with medium to high molecular weight resins are described, for example, in U.S. Pat. Nos. 4,871,638, 4,968,572, 4,952,475, 5,030,534, 5,009,975, 5,073,467, 5,077,166, 5,104,760 and 5,104,759, EP-A-0410324 and EP-A-0440226.

PROBLEMS TO BE SOLVED BY THE INVENTION

However, it has been found that, even in a case of using these various low molecular weight resins having an acidic group or in a case of using these low molecular weight resins together with medium to high molecular weight resins, it is yet insufficient to keep the stable performance in the case of greatly fluctuating the ambient conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, .when the scanning exposure system using a semiconductor laser beam is applied to hitherto known light-sensitive materials for electrophotographic lithographic printing plate precursors, various problems may occur in that the difference between $E_{1/2}$ and $E_{1/10}$ is particularly large and the contrast of the duplicated image is decreased. Moreover, it is difficult to reduce the remaining potential after exposure, which results in severe fog formation in duplicated image, and when employed as lithographic printing plate precursors, edge marks of originals pasted up appear on the prints, in addition to the insufficient electrostatic characteristics described above.

Moreover, it has been desired to develop a technique which can faithfully reproduce highly accurate images of continuous gradation as well as images composed of lines and dots using a liquid developer. However, the above-described known techniques are still insufficient to fulfill such a requirement. Specifically, in the known technique, the improved electrostatic characteristics which are achieved by means of the low molecular weight resins may be sometimes deteriorated by using them together with the medium to high molecular weight resins. In fact, it has been found that an electrophotographic light-sensitive material having a photoconductive layer wherein the above described known resins are used in combination may cause a problem on reproducibility of the above described highly accurate image (particularly, an image of continuous gradation) or on image forming performance in case of using a scanning exposure system with a laser beam of low power.

The present invention has been made for solving the problems of conventional electrophotographic light-sensitive materials as described above.

An object of the present invention is to provide an electrophotographic light-sensitive material having stable and excellent electrostatic characteristics and giving clear good images even when the ambient conditions during the formation of duplicated images are fluctuated to low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing plate precursor having excellent electrostatic characteristics (in particular, dark charge retention characteristics and photosensitivity), capable of reproducing a faithfully duplicated image to the original (in particular, a highly accurate image of continuous gradation), forming neither overall background stains nor dotted background stains of prints, and showing excellent printing durability.

Other objects of the present invention will become apparent from the following description.

DISCLOSURE OF THE INVENTION

It has been found that the above described objects of the present invention are accomplished by an electrophotographic light-sensitive material having a photoconductive layer containing at least an inorganic photoconductive substance, a spectral sensitizing dye and a binder resin, wherein the binder resin comprises at least one resin (A) shown below and at least one resin (B) shown below.

Resin (A):

A starlike polymer having a weight average molecular weight of from $1\times10^3$ to $2\times10^4$ and comprising an organic molecule having bonded thereto at least three polymer chains each containing a polymer component containing at least one polar group selected from $-PO_3H_2$,

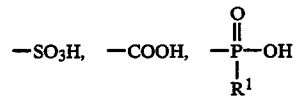

(wherein $R^1$ represents a hydrocarbon group or $-OR^2$ (wherein $R^2$ represents a hydrocarbon group)) and a cyclic acid anhydride group and a polymer component corresponding to a repeating unit represented by the general formula (I) described below, wherein the starlike polymer contains the polymer component containing a polar group in an amount of from 1 to 20% by weight and the polymer component represented by the general formula (I) in an amount not less than 30% by weight.

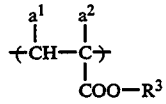

Formula (I)

(wherein $a^1$ and $a^2$ each represents a hydrogen atom, a halogen atom, a cyano group, a hydrocarbon group, $-COOR^4$ or $-COOR^4$ bonded via a hydrocarbon group (wherein $R^4$ represents a hydrocarbon group); and $R^3$ represents a hydrocarbon group).

Resin (B):

An AB block copolymer having a weight average molecular weight of from $3\times10^4$ to $1\times10^6$ and comprising an A block containing a polymer component containing at least one polar group selected from the specified polar groups as described in the resin (A) above and a B block containing a polymer component corresponding to a repeating unit represented by the general formula (I) as described in the resin (A) above, wherein the A block contains the polymer component containing a polar group in an amount of from 0.05 to 10% by weight based on the AB block copolymer and the B block contains the polymer component represented by the general formula (I) in an amount not less than 30% by weight based on the AB block copolymer.

In short, the binder resin which can be used in the present invention comprises at least the resin (A) which is a starlike polymer comprising an organic molecule having bonded thereto at least three polymer chains each containing the polymer component represented by the general formula (I) described above and the specified polar group-containing polymer component described above and the resin (B) which is an AB block copolymer comprising an A block containing the specified polar group-containing component described above and a B block containing a polymer component represented by the general formula (I) described above.

As described above, a resin having an acidic group-containing polymer component at random in the polymer main chain, a resin having an acidic group bonded at only one terminal of the polymer main chain, a graft type copolymer having an acidic group in the graft portion or at the terminal of the polymer main chain and an AB block copolymer containing an acidic group as a block are illustrated as low molecular weight binder resins containing an acidic group known for improving the smoothness and electrostatic characteristics of the photoconductive layer. On the contrary, the low molecular weight resin (A) according to the present invention is a starlike copolymer having the specified chemical structure of polymer and is clearly different from the known resins in its bonding pattern of polymer chains.

It is presumed that, in the resin (A) used in the present invention, the polar group-containing components present in the polymer chains are sufficiently adsorbed on the stoichiometric defect of the inorganic photoconductive substance and other components (e.g., those represented by the general formula (I)) constituting the polymer main chain mildly but sufficiently cover the surface of the inorganic photoconductive substance. Also, it is presumed that, even when the stoichiometric defect portion of the inorganic photoconductive substance varies to some extents, the stable interaction of the inorganic photoconductive substance with the resin (A) used in the present invention is always maintained since the resin (A) has the sufficient adsorptive domain and effectively provides the sufficient adsorption on the surface of inorganic photoconductive substance. Thus, it has been found that, according to the present invention, the traps of the inorganic photoconductive substance are more effectively and sufficiently compensated and the humidity characteristics of the photoconductive substance are improved as well as sufficient dispersion of the inorganic photoconductive substance and restrain of the occurrence of aggregation are achieved as compared with conventionally known polar group-containing low molecular weight resins.

As a result of various investigations, it has been found that in the known technique wherein the low molecular weight resin containing a polar group is used together with the medium to high molecular weight resin, the improved electrostatic characteristics achieved by the low molecular weight resin are sometimes deteriorated by the medium to high molecular weight resin used together as described above. Further, it has become apparent that an appropriate action of medium to high molecular weight resin on the interaction between the photoconductive substance, spectral sensitizing dye and low molecular weight resin in the photoconductive layer is an unexpectedly important factor.

It has been found that the above described objects can be effectively achieved by using the AB block copolymer comprising an A block containing the polar group and a B block containing no polar group according to the present invention as a medium to high molecular weight resin to be used together with the low molecular weight resin (A) containing the above described specified polar group in a polymer chain of a starlike polymer.

It is presumed that the electrostatic characteristics are stably maintained at a high level as a result of synergistic effect of the resin (A) and resin (B) according to the present invention wherein particles of photoconductive substance are sufficiently dispersed without the occurrence of aggregation, a spectral sensitizing dye and a chemical sensitizer are sufficiently adsorbed on the surface of particles of photoconductive substance, and the binder resin is sufficiently adsorbed to excessive active sites on the surface of the photoconductive substance to compensate the traps.

More specifically, the low molecular weight starlike polymer resin (A) containing the specified polar group has the important function in that the resin is sufficiently adsorbed on the surface of particles of the photoconductive substance to disperse uniformly and to restrain the occurrence of aggregation due to its short polymer chain and in that adsorption of the spectral sensitizing dye on the photoconductive substance is not disturbed.

Further, by using the medium to high molecular weight AB block copolymer comprising an A block containing the specified polar group and a B block which does not contain the specified polar group, mechanical strength of the photoconductive layer is remarkably increased. This is believed to be based on that the A block portion of the resin has a weak interaction with the particles of photoconductive substance compared with the resin (A) and that the polymer chains of the B block portions of the resins intertwine each other.

Moreover, according to the present invention the electrostatic characteristics are more improved in comparison with a case wherein a known medium to high molecular weight resin is employed. This is believed to be-based on that the resin (B) acts to control the disturbance of adsorption of spectral sensitizing dye on the surface of particles of photoconductive substance due to the polar group present in the A block portion which interacts with the particles of photoconductive substance.

As a result, it is presumed that the resin (B) appropriately effects on controlling the disturbance of adsorption of spectral sensitizing dye on the surface of particles of photoconductive substance and the electrophotographic interactions and increasing the strength of the photoconductive layer in a system wherein the particles of photoconductive substance, spectral sensitizing dye and resin (A) are coexistent with the resin (B), while details thereof are not clear.

This effect is especially remarkable in a case wherein polymethine dyes or phthalocyanine series pigments are employed which are particularly effective as spectral sensitizing dyes for the region of near infrared to infrared light.

When the electrophotographic light-sensitive material according to the present invention containing photoconductive zinc oxide as the photoconductive substance is applied to a conventional direct printing plate precursor, extremely good water retentivity as well as the excellent image forming performance can be obtained. More specifically, when the light-sensitive material according to the present invention is subjected to an electrophotographic process to form an duplicated image, oil-desensitization of non-image portions by chemical treatment with a conventional oil-desensitizing solution to prepare a printing plate, and printing by an offset printing system, it exhibits excellent characteristics as a printing plate.

When the electrophotographic light-sensitive material according to the present invention is subjected to the oil-desensitizing treatment, the non-image portions are rendered sufficiently hydrophilic to increase water retentivity which results in remarkable increase in the number of prints obtained. It is believed that these results are obtained by the fact that the condition is formed under which a chemical reaction for rendering the surface of zinc oxide hydrophilic upon the oil-desensitizing treatment is able to proceed easily and effectively. Specifically, zinc oxide particles are uniformly and sufficiently dispersed in the resin (A) and resin (B) used as a binder resin and the state of binder resin present on or adjacent to the surface of zinc oxide particles is proper to conduct an oil-desensitizing reaction with the oil-desensitizing solution rapidly and effectively.

Now, the resin (A) which can be used as the binder resin for the photoconductive layer of the electrophotographic light-sensitive material according to the present invention will be described in more detail below.

The resin (A) is a starlike polymer comprising an organic molecule having bonded thereto at least three polymer chains each containing a polymer component containing the specified polar group and a polymer component corresponding to a repeating unit represented by the general formula (I). For instance, the starlike polymer according to the present invention can be schematically illustrated below.

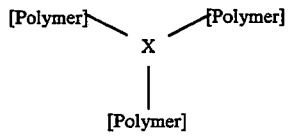

(A-1)

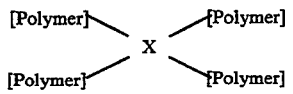

(A-2)

wherein X represents an organic molecule, and [Polymer] represents a polymer chain.

In the starlike polymer, three or more polymer chains which are bonded to the organic molecule may be the same as or different from each other in their structures, and the length of each polymer chain may be the same or different.

As described above, the polymer chain comprises at least one polymer component containing the specified polar group and at least one polymer component represented by the general formula (I), and the composition of the polymer chain may include various embodiments. Specifically, the specified polar group-containing components and the components represented by the general formula (I) each constituting the polymer chain may be present at random or as a block.

In the latter case, the resin (A) is a starlike polymer comprising an organic molecule having bonded thereto at least three AB block polymer chains each containing an A block comprising a polymer component containing the specified polar group and a B block comprising a polymer component represented by the general formula (I). The B block does not contain any specified polar group included in the A block. The A block and the B block in the polymer chain can be arranged in any order. Such a type of the resin (B) can, for example, be schematically illustrated below.

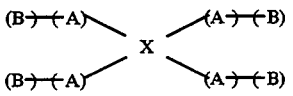

(A-3)

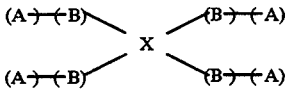

(A-4)

wherein X represents an organic molecule, (A) represents an A block, (B) represents a B block, and (A)-(B) represents a polymer chain.

In the starlike polymer of the resin (A), a number of the polymer chains bonded to an organic molecule is at most 15, and usually about 10 or less.

The weight average molecular weight of the resin (A) is from $1\times10^3$ to $2\times10^4$, and preferably from $3\times10^3$ to $1\times10^4$. The glass transition point of the resin (A) is preferably from −40° C. to 110° C., and more preferably from −20° C. to 90° C.

If the weight average molecular weight of the resin (A) is less than $1\times10^3$, the film-forming property of the resin is lowered, thereby a sufficient film strength cannot be maintained, and on the other hand, if the weight average molecular weight of the resin (A) is higher than $2\times10^4$, the effect of the present invention for obtaining stable duplicated images is reduced since fluctuations of electrophotographic characteristics (particularly, initial potential, dark charge retention rate and photosensitivity) of the photoconductive layer, in particular, that containing a spectral sensitizing dye for sensitization in the range of from near-infrared to infrared become somewhat large under severe conditions of high temperature and high humidity or low temperature and low humidity.

The content of the polymer component corresponding to the repeating unit represented by the general formula (I) present in the resin (A) is not less than 30% by weight, preferably from 30 to 99% by weight, and more preferably from 50 to 99% by weight, and the content of the polymer component containing the specified polar group present in the resin (A) is from 1 to 20% by weight, and preferably from 3 to 15% by weight.

If the content of the polar group-containing component in the resin (A) is less than 1% by weight, the initial potential is low and thus satisfactory image density is hardly obtained. On the other hand, if the content of the polar group-containing component is larger than 20% by weight, various undesirable problems may occur, for example, the dispersibility of photoconductive substance is reduced, and further when the light-sensitive material is used as an offset master plate, the occurrence of background stains may increase even a low molecular weight resin.

The repeating unit represented by the general formula (I) above which is contained in the polymer main chain of the resin (A) will be described in greater detail below.

In the general formula (I), $a^1$ and $a^2$ each preferably represents a hydrogen atom, a halogen atom (e.g., chlorine and bromine), a cyano group, an alkyl group having from 1 to 4 carbon atoms (e.g., methyl, ethyl, propyl and butyl), —$COOR^4$ or —$COOR^4$ bonded via a hydrocarbon group (wherein $R^4$ represents a hydrogen atom or an alkyl, alkenyl, aralkyl, alicyclic or aryl group which may be substituted, and specifically includes those as described for $R^3$ hereinafter). Particularly preferably $a^1$ represents a hydrogen atom and $a^2$ represents a methyl group.

The hydrocarbon group in the above described —$COOR^4$ group bonded via a hydrocarbon group includes, for example, a methylene group, an ethylene group and a propylene group.

$R^3$ preferably represents a hydrocarbon group having not more than 18 carbon atoms, which may be substituted. The substituent for the hydrocarbon group may be any substituent other than the polar groups contained in the polar group-containing polymer component described above present in the resin (A). Suitable examples of the substituent include a halogen atom (e.g., fluorine, chlorine and bromine), —$OR^6$ —$COOR^6$, and —$OCOR^6$ (wherein $R^6$ represents an alkyl group having from 1 to 22 carbon atoms, e.g., methyl, ethyl, propyl, butyl, hexyl, octyl, decyl, dodecyl, hexadecyl and octadecyl). Preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-hydroxyethyl, 2-methoxycarbonylethyl, 2-methoxyethyl, 2-ethoxyethyl, 3-hydroxypropyl and 3-bromopropyl), an alkenyl group having from 2 to 18 carbon atoms which may be substituted (e.g., vinyl, allyl, 2-methyl-1-propenyl, 2-butenyl, 2-pentenyl, 3-methyl-2-pentenyl, 1-pentenyl, 1-hexenyl, 2-hexenyl and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclopentyl, cyclohexyl, 2-cyclohexylethyl and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl and dodecyloylamidophenyl).

More preferably, the polymer component corresponding to the repeating unit represented by the general formula (I) is a methacrylate component having the specific aryl group represented by the general formula (Ia) and/or (Ib) described below. The low molecular weight resin containing the specific aryl group-containing methacrylate polymer component described above is sometimes referred to as a resin (A') hereinafter.

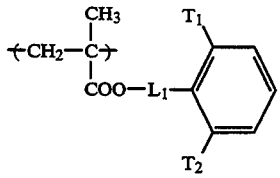

Formula (Ia)

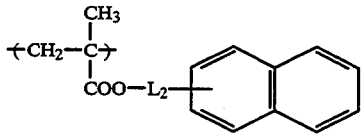

Formula (Ib)

wherein $T_1$ and $T_2$ each represents a hydrogen atom, a halogen atom, a hydrocarbon group having from 1 to 10 carbon atoms, —$COR_a$ or —$COOR_a$, wherein $R_a$ represents a hydrocarbon group having from 1 to 10 carbon atoms; and $L_1$ and $L_2$ each represents a mere bond or a linking group containing from 1 to 4 linking atoms, which connects —COO— and the benzene ring.

In the resin (A'), the content of the methacrylate polymer component corresponding to the repeating unit represented by the general formula (Ia) and/or (Ib) is suitably not less than 30% by weight, preferably from 50 to 97% by weight, and the content of polymer component containing the specified polar group is from 1 to 20% by weight, preferably from 3 to 15% by weight.

In case of using the resin (A'), the electrophotographic characteristics (particularly, $V_{10}$, D.R.R. and $E_{1/10}$) of the electrophotographic material can be furthermore improved.

In the general formula (Ia), $T_1$ and $T_2$ each preferably represents a hydrogen atom, a chlorine atom, a bromine atom, an alkyl group having from 1 to 4 carbon atoms (e.g., methyl, ethyl, propyl and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl and chloromethylbenzyl), an aryl group (e.g., phenyl, tolyl, xylyl, bromophenyl, methoxyphenyl, chlorophenyl and dichlorophenyl), —$COR_a$ or —$COOR_a$ (wherein $R_a$ preferably represents any of the above-recited hydrocarbon groups for $T_1$ or $T_2$).

In the general formulae (Ia) and (Ib), $L_1$ and $L_2$ each represents a mere bond or a linking group containing from 1 to 4 linking atoms which connects between —COO— and the benzene ring, e.g., $-(CH_2)_{n_1}-$ (wherein $n_1$ represents an integer of from 1 to 3), —$CH_2OCO$—, —$CH_2CH_2OCO$—, $-(CH_2O)_{m_1}-$ (wherein $m_1$ represents an integer of 1 or 2) and —$CH_2CH_2O$—, and preferably represents a mere bond or a linking group containing from 1 to 2 linking atoms.

Specific examples of the polymer component corresponding to the repeating unit represented by the general formula (Ia) or (Ib) which can be used in the resin (A) according to the present invention are set forth below, but the present invention should not be construed as being limited thereto. In the following formulae (a-1) to (a-17), n represents an integer of from 1 to 4; m represents an integer of from 0 to 3; p represents an integer of from 1 to 3; $R^{10}$ to $R^{13}$ each represents —$C_nH_{2n+1}$ or —$(CH_2)_mC_6H_5$ (wherein n and m each has the same meaning as defined above); and $X_1$ and $X_2$, which may be the same or different, each represents a hydrogen atom, -Cl, -Br or -I.

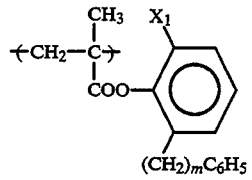

(a-1)

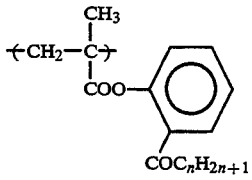

(a-2)

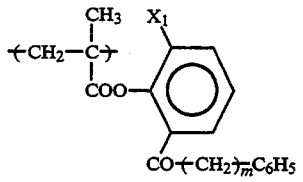

(a-3)

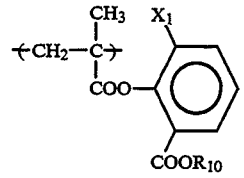

(a-4)

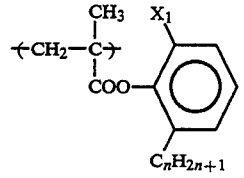

(a-5)

-continued (a-6)

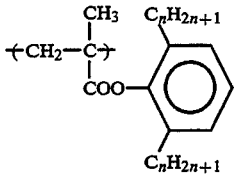

(a-7)

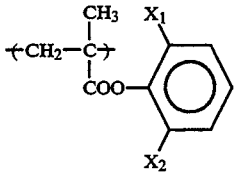

(a-8)

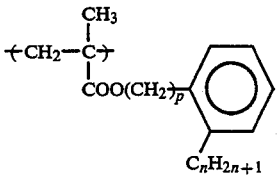

(a-9)

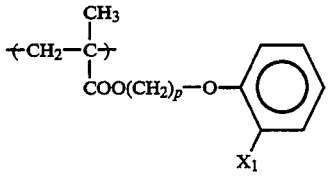

(a-10)

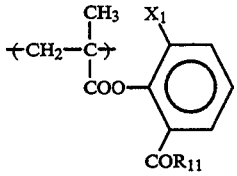

(a-11)

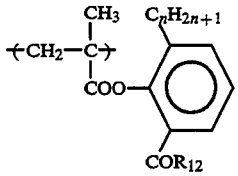

(a-12)

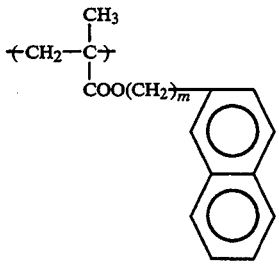

(a-13)

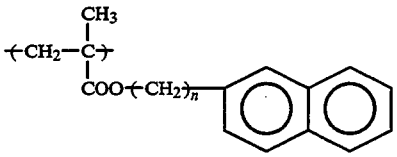

(a-14)

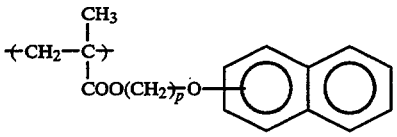

-continued (a-15)

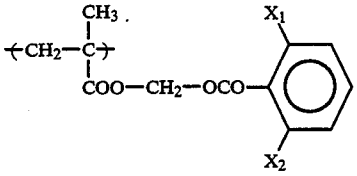

(a-16)

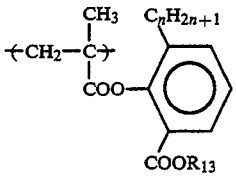

(a-17)

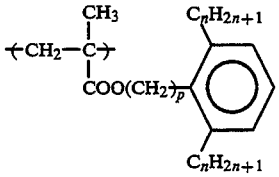

Now, the polymer component having the specified polar group present in the resin (A) will be described in detail below.

The polar group included in the polar group-containing polymer component is selected from $-PO_3H_2$,

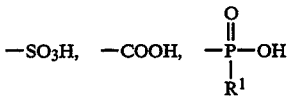

and a cyclic acid anhydride group, as described above.

In the group

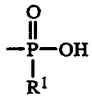

above, $R^1$ represents a hydrocarbon group or $-OR^2$ (wherein $R^2$ represents a hydrocarbon group). The hydrocarbon group represented by $R^1$ or $R^2$ preferably includes an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl and butoxyphenyl).

The cyclic acid anhydride group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom such as a chlorine atom and a bromine atom and an alkyl group such as a methyl group, an ethyl group, a butyl group and a hexyl group.

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl and butyl), a hydroxyl group, a cyano group, a nitro group and an alkoxycarbonyl group (e.g., methoxy and ethoxy as an alkoxy group).

The polar group in the resin (A) may be bonded to the polymer chain either directly or via an appropriate linking group.

The linking group can be any group for connecting the polar group to the polymer chain. Specific examples of suitable linking group include

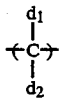

(wherein $d_1$ and $d_2$, which may be the same or different, each represents a hydrogen atom, a halogen atom (e.g., chlorine and bromine), a hydroxyl group, a cyano group, an alkyl group (e.g., methyl, ethyl, 2-chloroethyl, 2-hydroxyethyl, propyl, butyl and hexyl), an aralkyl group (e.g., benzyl and phenethyl) or a phenyl group),

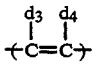

(wherein $d_3$ and $d_4$ each has the same meaning as defined for $d_1$ or $d_2$ above), $—C_6H_{10}$, $—C_6H_4—$, —O—, —S—,

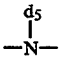

(wherein $d_5$ represents a hydrogen atom or a hydrocarbon group (preferably having from 1 to 12 carbon atoms (e.g., methyl, ethyl, propyl, butyl hexyl, octyl, decyl, dodecyl, 2-methoxyethyl, 2-chloroethyl, 2-cyanoethyl, benzyl, methylbenzyl, phenethyl, phenyl, tolyl, chlorophenyl, methoxyphenyl and butylphenyl)), —CO—, —COO—, —OCO—, $—CON(d_5)—$, $—SO_2N(d_5)—$, $—SO_2—$, —NHCONH—, —NHCOO—, $—NHSO_2—$, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine and morpholine)),

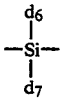

(wherein $d_6$ and $d_7$, which may be the same or different, each represents a hydrocarbon group or $—Od_8$ (wherein $d_8$ represents a hydrocarbon group)), and a combination thereof. Suitable examples of the hydrocarbon group represented by $d_6$, $d_7$ or $d_8$ include those described for $d_5$.

The polymer component containing the polar group according to the present invention may be any of specified polar group-containing vinyl compounds copolymerizable with, for example, a monomer corresponding to the repeating unit represented by the general formula (I) (including that represented by the general formula (Ia) or (Ib)). Examples of such vinyl compounds are described, e.g., in Kobunshi Gakkai (ed.), *Kobunshi Data Handbook Kisohen* (*Polymer Date Handbook Basis*), Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy and α,β-dichloro compounds), methacrylic acid, itaconic acid, itaconic half esters, iraconic half amides, crotonic acid, 2-alkenylcarboxylic acids (e.g., 2-pentenoic acid, 2-methyl-2-hexenoic acid, 2-octenoic acid, 4-methyl-2hexenoic acid and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the specified polar group in the substituent thereof.

Specific examples of the polar group-containing polymer components are set forth below. In the following formulae, $e_1$ represents —H or $—CH_3$; $e_2$ represents —H, $—CH_3$ or $—CH_2COOCH_3$; $R^{14}$ represents an alkyl group having from 1 to 4 carbon atoms; $R^{15}$ represents an alkyl group having from 1 to 6 carbon atoms, a benzyl group or a phenyl group; c represents an integer of from 1 to 3; d represents an integer of from 2 to 11; e represents an integer of from 1 to 11; f represents an integer of from 2 to 4; and g represents an integer of from 2 to 10.

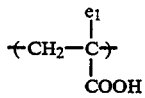

(b-1)

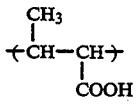

(b-2)

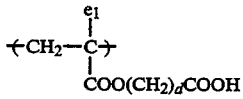

(b-3)

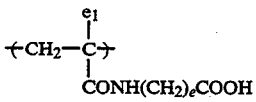

(b-4)

-continued
(b-5)
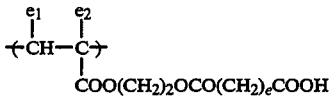
(b-6)
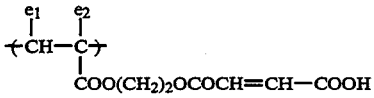
(b-7)
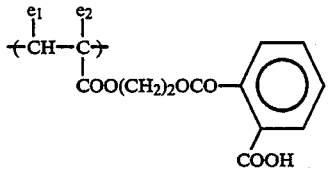
(b-8)
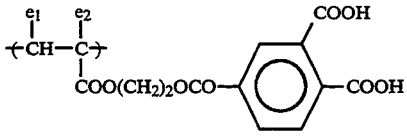
(b-9)
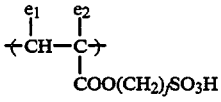
(b-10)
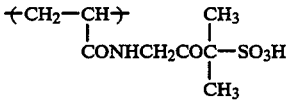
(b-11)
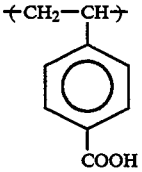
(b-12)
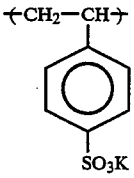
(b-13)
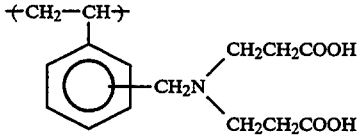
(b-14)
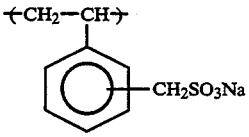
(b-15)
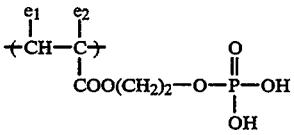
-continued
(b-16)
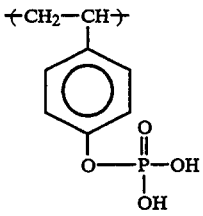
(b-17)
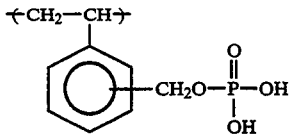
(b-18)
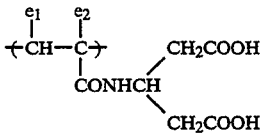
(b-19)
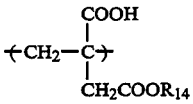
(b-20)
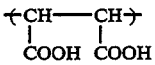
(b-21)
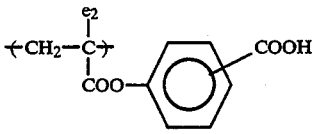
(b-22)
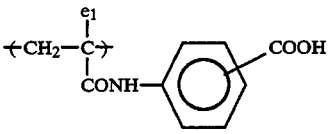
(b-23)
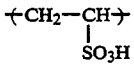
(b-24)
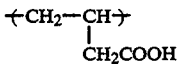
(b-25)
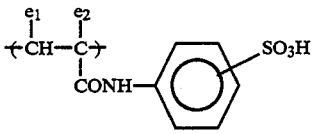
(b-26)
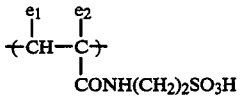
(b-27)
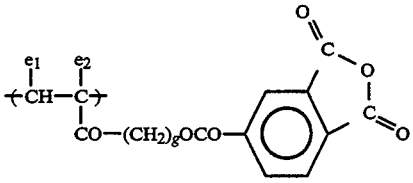

-continued
(b-28)
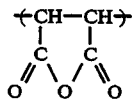
(b-29)
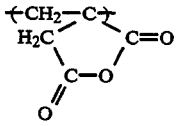
(b-30)
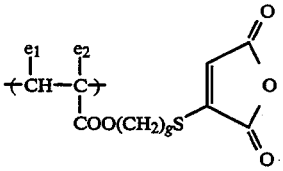
(b-31)
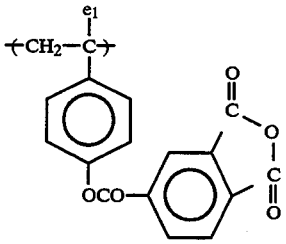
(b-32)
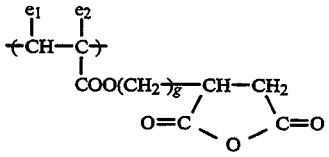
(b-33)
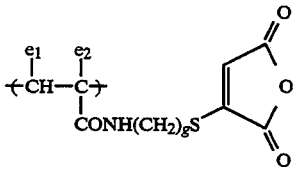
(b-34)
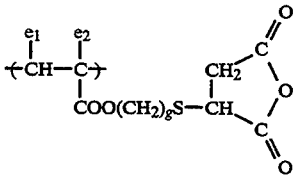
(b-35)
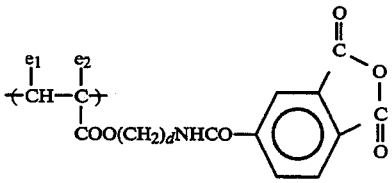
(b-36)
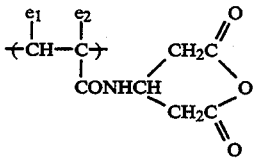
-continued
(b-37)
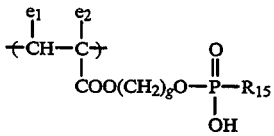
(b-38)
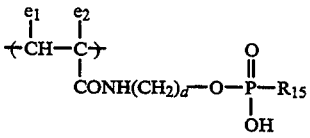
(b-39)
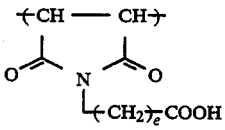
(b-40)
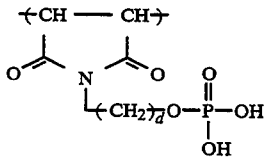
(b-41)
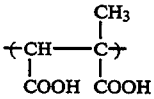
(b-42)
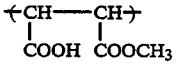
(b-43)
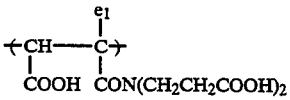
(b-44)
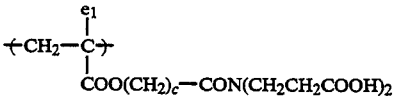
(b-45)
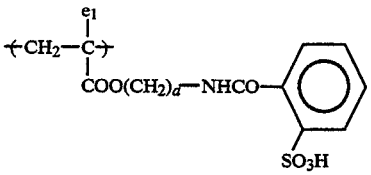
(b-46)
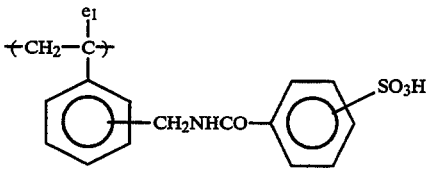
(b-47)
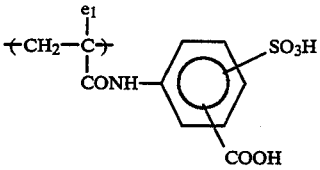

-continued (b-48)

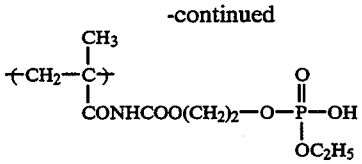

(b-49)

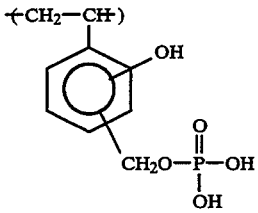

(b-50)

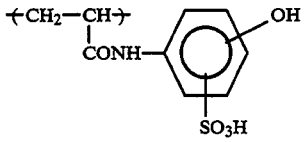

(b-51)

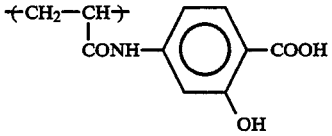

(b-52)

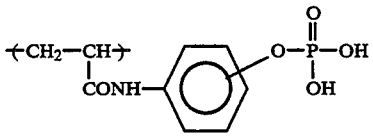

In the resin (A) containing an AB block copolymer in the polymer chain, the polar group-containing component described above is present in the A block. Two or more kinds of the polar group-containing components may be present in the A block, and in such a case, two or more kinds of these polar group-containing components may be contained in the form of a random copolymer or a block copolymer in the block A.

The resin (A) may contain polymer components other than the polymer components described above. Examples of such other polymer components preferably include those corresponding to the repeating unit represented by the following general formula (II):

Formula (II)

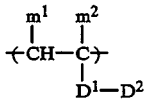

wherein $D^1$ represents —COO—, —OCO—, —$CH_2$-)$_k$OCO—, —$CH_2$)$_k$COO—, —O—, —$SO_2$—, —CO—,

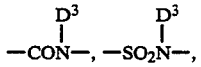

—CONHCOO—,

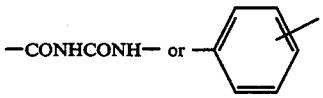

(wherein k represents an integer of from 1 to 3; and $D^3$ represents a hydrogen atom or a hydrocarbon group); $D^2$ represents a hydrocarbon group; and $m^1$ and $m^2$ which may be the same or different, each has the same meaning as $a^1$ or $a^2$ in the general formula (I) described above.

Preferred examples of the ,hydrocarbon group represented by $D^3$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $D^1$ represents

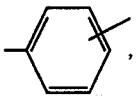

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

Preferred examples of the hydrocarbon group represented by $D^2$ include an alkyl group having from 1 to 22 carbon atoms which may be substituted (e.g., methyl, ethyl, propyl, butyl, pentyl, hexyl, heptyl octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

More preferably, in the general formula (II), $D^1$ represents —COO—, —OCO—, —$CH_{20}$CO—, —$CH_2$COO—, —O—, —CONH—, —$SO_2$NH— or

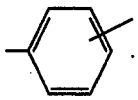

Moreover, the resin (A) may further contain other polymer components corresponding to monomers copolymerizable with monomers corresponding to the polymer components represented by the general formula (II). Examples of such monomers include acrylonitrile, methacrylonitrile and heterocyclic vinyl compounds (e.g., vinylpyridine, vinylimidazole, vinylpyrrolidone, vinylthiophene, vinylpyrazoles, vinyldioxane and vinyloxazine). However, such other monomers are preferably employed in an amount of not more than 20 parts by weight per 100 parts by weight of the resin (A).

The organic molecule to which at least three polymer chains are bonded and which is used in the resin (A) according to the present invention is any organic molecule having a molecular weight of 1000 or less. Suitable examples of the organic molecules include those containing a trivalent or more hydrocarbon moiety shown below.

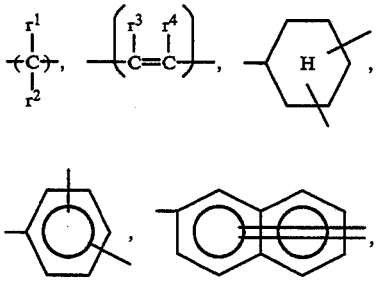

wherein ( ) represents a repeating unit; $r^1$, $r^2$, $r^3$ and $r^4$ each represents a hydrogen atom or a hydrocarbon group, provided that at least one of $r^1$ and $r^2$ or $r^3$ and $r^4$ is bonded to a polymer chain.

These organic moieties may be employed individually or as a combination thereof. In the latter case, the combination may further contain an appropriate linking unit, for example, —O—, —S—,

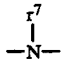

(wherein $r^7$ represents a hydrogen atom or a hydrocarbon group), —CO—, —CS—, —COO—,

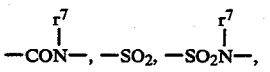

—NHCOO—, —NHCONH— and a heterocyclic group containing at least one hetero atom such as oxygen, sulfur or nitrogen (e.g., thiophene, pyridine, pyran, imidazole, benzimidazole, furan, piperidine, pyrazine, pyrrole and piperazine, as the hetero ring).

Other examples of the organic molecules to which the polymer chains are bonded include those comprising a combination of

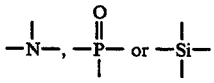

with a linking unit described above. However, the organic molecules which can be used in the present invention should not be construed as being limited to those described above.

The starlike polymer according to the present invention can be prepared by utilizing conventionally known synthesis methods of starlike polymers using monomers containing the polar group and a polymerizable double bond group. For instance, a method of polymerization reaction using a carboanion as an initiator can be employed. Such a method is specifically described in M. Morton, T. E. Helminiak et al, *J. Polym. Sci.*, 57, 471 (1962), B. Gordon III, M. Blumenthal, J. E. Loftus, et al *Polym. Bull.*, 11, 349 (1984), and R. B. Bates, W. A. Beavers, et al, *J. Org. Chem.*, 44, 3800 (1979). In case of using the reaction, it is required that the specified polar group according to the present invention be protected to form a functional group and the protective group be removed after polymerization.

The protection of the specified polar group of the present invention by a protective group and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, *Hannosei Kobunshi* (*Reactive Polymer*), Kodansha (1977), T. W. Greene, *Protective Groups in Organic Synthesis*, John Wiley & Sons (1981), and J. F. W. McOmie, *Protective Groups in Organic Chemistry*, Plenum Press, (1973), as well as methods as described in the above references.

Further, in another method, the polymer can be synthesized by conducting a polymerization reaction under light irradiation using a monomer having the unprotected polar group and also using a dithiocarbamate group-containing compound and/or a xanthate group-containing compound as an initiator. For example, copolymer can be synthesized according to the synthesis methods described, e.g., in Takayuki Otsu, *Kobunshi* (*Polymer*), 37, 248 (1988), Shunichi Himori and Ryichi Otsu, *Polym. Rep. Jap.* 37, 3508 (1988), JP-A-64-111, JP-A-64-26619, Nobuyuki Higashi et al, *Polymer Preprints Japan*, 36 (6) 1511 (1987), and M. Niwa, N. Higashi et al, *J. Macromol. Sci. Chem.*, *A*24(5), 567 (1987).

The weight average molecular weight of the resin (A) can be easily controlled in the desired range by appropriately selecting the kinds of monomers and polymerization initiator, the amounts of these components, the polymerization temperature, etc., as conventionally known in a polymerization reaction.

Now, the resin (B) which can be used as the binder resin for the photoconductive layer of the electrophotographic light-sensitive material according to the present invention will be described in more detail below.

The resin (B) is an AB block copolymer comprising an A block which comprises a polymer component containing the specified polar group and a B block which comprises a polymer component corresponding to the repeating unit represented by the general formula (I) and does not contain a polymer component containing the specified polar group described above.

The AB block copolymer according to the present invention includes a block copolymer wherein the A block and the B block are bonded to each other (Embodiment (1)), a block copolymer of Embodiment (1) wherein the specified polar group is further bonded at one terminal of the A block polymer chain and the B block is bonded at the other terminal of the A block polymer chain (Embodiment (2)), and a block copolymer wherein the B blocks are bonded at both terminals of the A block polymer chain (Embodiment (3)). These AB block copolymers are schematically illustrated as follows.

Embodiment (1) (A Block)—b—(B Block)

Embodiment (2) (Polar Group)-(A Block)—b—(B Block)

Embodiment (3) (B Block)—b—(A Block)—b—(B Block)

wherein —b— represents a bond connecting two blocks present on both sides.

The resin (B) is characterized by containing from 0.05 to 10% by weight of polymer component containing the specified polar group and not less than 30% by weight of polymer component represented by the general formula (I) bases on the resin (B) as described above.

If the content of the polar group-containing component in the resin (B) is less than 0.05% by weight, the initial potential is low and thus satisfactory image density can not be obtained. On the other hand, if the content of the polar group-containing component is larger than 10% by weight, various undesirable problems may occur, for example, the dispersibility of particles of photoconductive substance is reduced, the film smoothness and the electrophotographic characteristics under high temperature and high humidity condition deteriorate, and further when the light-sensitive material is used as an offset master plate, the occurrence of background stains increases.

It is also preferred that the total amount of the specified polar group-containing polymer component contained in the resin (B) is from 10 to 50% by weight based on the total amount of the specified polar group-containing polymer component present in the resin (A).

If the total amount of the specified polar group-containing component in the resin (B) is less than 10% by weight of that in the resin (A), the electrophotographic characteristics (particularly, dark charge retention rate and photosensitivity) and film strength tend to decrease. On the other hand, if it is larger than 50% by weight, a sufficiently uniform dispersion of particles of photoconductive substance may not be obtained, whereby the electrophotographic characteristics decrease and water retentivity declines when used as an offset master plate.

The weight average molecular weight of the resin (B) is from $3\times10^4$ to $1\times10^6$ and preferably from $5\times10^4$ to $5\times10^5$. If the weight average molecular weight of the resin (B) is less than $3\times10^4$, the film-forming property of the resin is lowered, whereby a sufficient film strength cannot be maintained, while if the weight average molecular weight of the resin (B) is higher than $1\times10^6$, the effect of the resin (B) of the present invention is reduced, whereby the electrophotographic characteristics thereof become almost the same as those of conventionally known resins.

The glass transition point of the resin (B) is preferably from −10° C. to 100° C., and more preferably from 0° C. to 90° C.

Specific examples of the polymer component containing the specified polar group which constitutes the A block of the AB block copolymer (resin (B)) according to the present invention include those for the polymer component containing the specified polar group present in the resin (A) described above.

Two or more kinds of the polymer components containing the specified polar group may be employed in the A block. In such a case, two or more kinds of the polar group-containing components may be contained in the A block in the form of a random copolymer or a block copolymer.

The A block may contain other polymer components than the polar group-containing polymer components. Preferred examples of such other polymer components include those corresponding to the repeating unit represented by the general formula (II) as described in detail with respect to the resin (A) above.

Moreover, the A block may further contain other polymer components corresponding to monomers copolymerizable with monomers corresponding to the polymer components represented by the general formula (II). Examples of such monomers include acrylonitrile, methacrylonitrile and heterocyclic vinyl compounds (e.g., vinylpyridine, vinylimidazole, vinylpyrrolidone, vinylthiophene, vinylpyrazoles, vinyldioxane and vinyloxazine). However, such other monomers are preferably employed in an amount of not more than 20 parts by weight per 100 parts by weight of the total polymer components constituting the A Block.

The polymer component which constitutes the B block of the AB block copolymer (resin (B)) will be described in greater detail below.

The B block contains at least the polymer component corresponding to the repeating unit represented by the general formula (I) described above. The content of the polymer component corresponding to the general formula (I) in the B block is preferably not less than 30% by weight, more preferably not less than 50% by weight.

The polymer component corresponding to the general formula (I) is the same as that described in detail with respect to the resin (A) hereinbefore. As other polymer components, the B block may contain the above described polymer components represented by the general formula (II) and above described other polymer components corresponding to monomers copolymerizable with monomers corresponding to the polymer components represented by the general formula (II) which may be present in the A block described above. However, the B block does not contain any specified polar group-containing polymer component used in the A block.

Preferred examples of polymer components constituting the B block include those represented by the general formula (I) wherein both $a^1$ and $a^2$ are hydrogen atoms and the hydrocarbon group represented by $R^3$ is an alkyl group having from 1 to 6 carbon atoms which may be substituted (e.g., methyl, ethyl, propyl, butyl, pentyl, hexyl, 2-chloroethyl, 2-cyanoethyl, 2-methoxyethyl, 2-thienylethyl and 2,3-dichloropropyl), and those represented by the general formula (II) wherein both $m^1$ and $m^2$ are hydrogen atoms and the hydrocarbon group represented by $D^2$ is selected from the alkyl group described for $R^3$ above.

The AB block copolymer (resin (B)) used in the present invention can be produced by a conventionally known polymerization reaction method. More specifically, it can be produced by the method comprising previously protecting the specified polar group in a monomer corresponding to the polymer component having the specified polar group to form a functional group, synthesizing an AB block copolymer by a so-called known living polymerization reaction, for example, an ion polymerization reaction with an organic metal compound (e.g., alkyl lithiums, lithium diisopropylamide and alkylmagnesium halides) or a hydrogen iodide/iodine system, a photopolymerization reaction using a porphyrin metal complex as a catalyst, or a group transfer polymerization reaction, and then conducting a protection-removing reaction of the functional group which had been formed by protecting the polar group by a hydrolysis reaction, a hydrogenolysis reaction, an oxidative decomposition reaction, or a photodecomposition reaction to form the polar group. One example thereof is shown by the following reaction scheme (A):

Reaction Scheme (A)

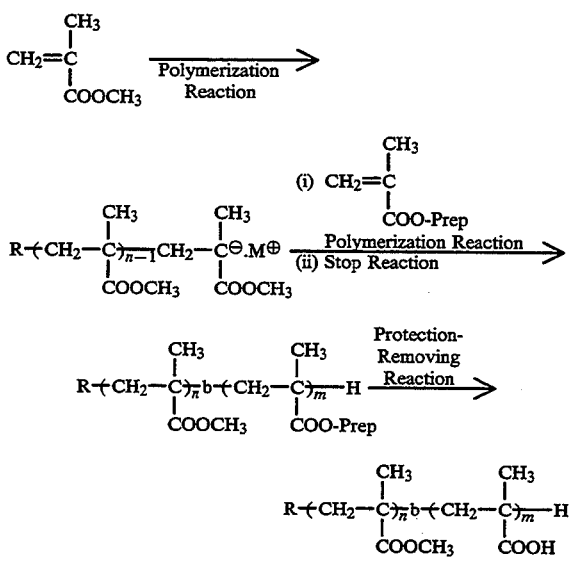

R: Alkyl group, porphyrin ring residue, etc.
Prep: Protective group (e.g., $-C(C_6H_5)_3$, $-Si(C_3H_7)_3$, etc.)
—b—: A bond connecting two blocks present on both sides
n, m: Repeating unit Specifically, the AB block copolymer can be easily synthesized according to the synthesis methods described, e.g., in P. Lutz, P. Masson et al, *Polym. Bull.*, 12., 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Ute and Koichi Hatada, *Kobunshi Kako* (*Polymer Processing*), 36, 366 (1987), Toshinobu Higashimura and Mitsuo Sawamoto, *Kobunshi Ronbun Shu (polymer Treatises*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler et al, *Macromolecules*, 20, 1473 (1987).

Also, the protection of the specified polar group by a protective group and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, *Hannosei Kobunshi* (*Reactive Polymer*), Kodansha (1977), T. W. Greene, *Protective Groups in Organic Synthesis*, John Wiley & Sons (1981), and J. F. W. McOmie, *Protective Groups in Organic Chemistry*, Plenum Press, (1973), as well as the methods as described in the above references.

Further, the AB block copolymer can be also synthesized by performing a polymerization reaction under light irradiation using a monomer having an unprotected polar group and also using a dithiocarbamate group-containing compound and/or xanthate group-containing compound as an initiator. For example, the block copolymer can be synthesized according to the synthesis methods described, e.g., in Takayuki Otsu, *Kobunshi* (*Polymer*), 37, 248 (1988), Shunichi Himori and Ryuichi Otsu, *Polym. Rep. Jap.* 37, 3508 (1988), JP-A-64-111, JP-A-64-26619, Nobuyuki Higashi et al, *Polymer Preprints Japan*, 36, (6), 1511 (1987), and M. Niwa, N. Higashi et al, *J. Macromol. Sci. Chem.*, *A24*, (5), 567 (1987).

Moreover, the AB block copolymer can be synthesized by a method wherein an azobis compound containing either the A block portion or the B block portion is synthesized and using the resulting polymer azobis initiator as an initiator, a radical polymerization reaction is conducted with monomers for forming another block. Specifically, the AB block copolymer can be synthesized by the methods described, for example, in Akira Ueda and Susumu Nagai, *Kobunshi Ronbun Shu*, 44, 469(1987), and Akira Ueda, *Osakashiritsu Kogyo Kenkyusho Hokoku*, 84, (1989).

In case of utilizing the above described synthesis method, a weight average molecular weight of the polymer azobis initiator is preferably not more than $2\times10^4$ in view of the easy synthesis of polymer azobis initiator and the regular polymerization reaction for the formation of block. On the other hand, it is preferred that the polymer chain of B block is longer than that of A block in the resin (B) according to the present invention. As a result, a polymer azobis initiator containing the A block portion is preferably employed when the AB block copolymer is synthesized according to the method. For example, the AB block copolymer is synthesized according to the following reaction scheme (B):

Reaction Scheme (B)

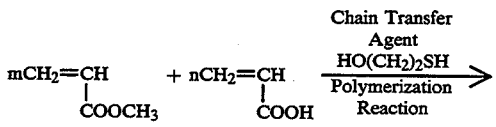

-continued

Reaction Scheme (B)

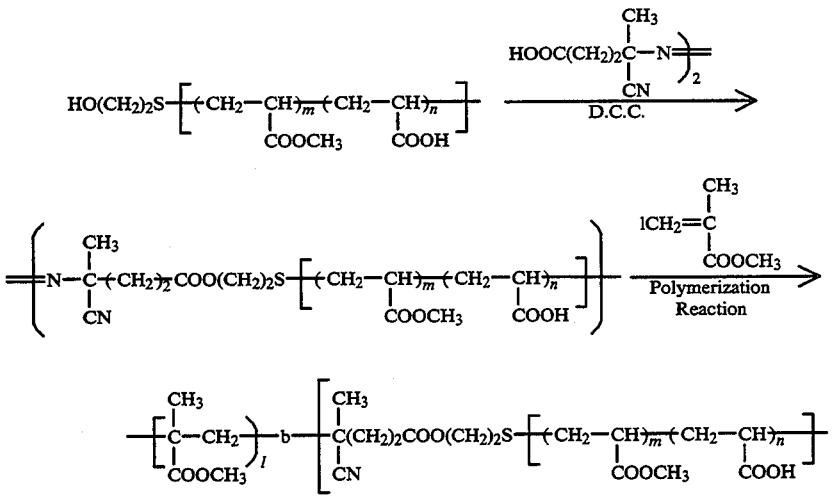

l, m, n: Repeating unit

The resin (B) may have the specified polar group bonded either directly or via an appropriate linking group at one terminal of the polymer chain of the A block comprising the polar group-containing polymer component as described above. In such a case, the polar group bonded at the terminal may be the same as or different from the polar group present in the polymer component constituting the A block. Suitable examples of the linking groups include those illustrated for the cases wherein the polar groups are present in the polymer chain of the resin (A) described hereinbefore.

The AB block copolymer having the specified polar group at the terminal of its polymer chain can be produced by a conventionally known polymerization reaction method. More specifically, it can be produced by a method comprising previously protecting the specified polar group in a monomer corresponding to the polymer component having the specified polar group to form a functional group, synthesizing an AB block copolymer by a so-called known living polymerization reaction, for example, an ion polymerization reaction with an organic metal compound (e.g., alkyl lithiums, lithium diisopropylamide and alkylmagnesium halides) or a hydrogen iodide/iodine system, a photopolymerization reaction using a porphyrin metal complex as a catalyst or a group transfer polymerization reaction, introducing at the stop reaction, directly the specified polar group or introducing at first a functional group capable of connecting the specified polar group, then chemically bonding the specified polar group, and then conducting a protection-removing reaction of the functional group formed by protecting the polar group in the polymer by a hydrolysis reaction, hydrogenolysis reaction, an oxidative decomposition reaction or a photodecomposition reaction to form the polar group. One example thereof is shown by the following reaction scheme (C):

Reaction Scheme (C)

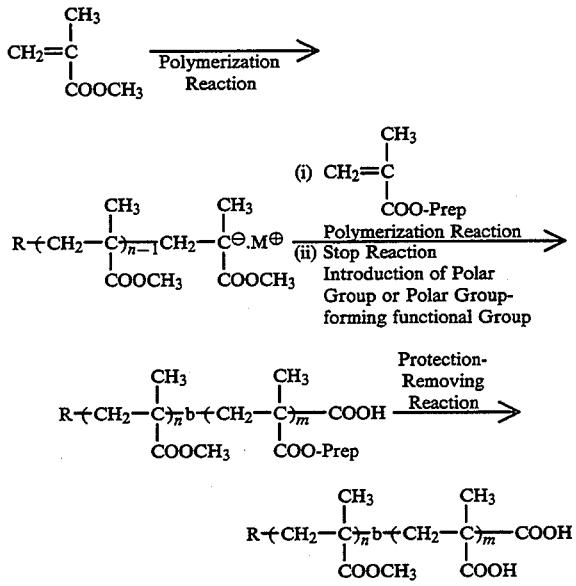

R: Alkyl group, porphyrin ring residue, etc.
Prep: Protective group (e.g., $-C(C_6H_5)_3$, $-Si(C_3H_7)_3$, etc.)
b: A bond connecting two blocks present on both sides
m, n: Repeating unit Specifically, the AB block copolymer can be easily synthesized according to the synthesis methods described in the literatures cited hereinbefore with respect to the synthesis of the resin (B).

Furthermore, the, AB block copolymer can also be synthesized by performing a polymerization reaction under light irradiating using a monomer having an unprotected polar group and also using a dithiocarbamate group-containing compound and/or xanthate group-containing compound which also contains the specific polar group as a substituent as an initiator. For example, the block copolymer can be synthesized according to the synthesis methods described in the literature references cited hereinbefore with respect to the synthesis of the resin (B).

Also, the protection of the specified polar group by a protective group and the release of the protective group (a reaction for removing a protective group) described above can be easily conducted by utilizing conventionally known knowledges. More specifically, they can be performed by appropriately selecting methods described in the literatures cited hereinbefore with respect to the synthesis of the resin (B), as well as the methods as described in the above references.

Of the resins (B), the block copolymer wherein the B blocks are bonded to the both terminals of the A block (hereinafter sometimes referred to as a BAB block copolymer) is described below.

The B blocks bonded to the both terminals of the A block may be structurally the same or different and each contains the polymer component represented by the general formula (I) and does not contain the specified polar group-containing component present in the A block. The lengths of the polymer chains may be the same or different.

The BAB block copolymer used in the present invention can be produced by a conventionally known polymerization reaction method. More specifically, it can be produced by the method comprising previously protecting the specified polar group in a monomer corresponding to the polymer component having the specified polar group to form a functional group, synthesizing an AB block copolymer by a so-called known living polymerization reaction, for example, an ion polymerization reaction with an organic metal compound (e.g., alkyl lithiums, lithium diisopropylamide and alkylmagnesium halides) or a hydrogen iodide/iodine system, a photopolymerization reaction using a porphyrin metal complex as a catalyst or a group transfer polymerization reaction, and then conducting a protection-removing reaction of the functional group which had been formed by protecting the polar group by a hydrolysis reaction, a hydrogenolysis reaction, an oxidative decomposition reaction or a photodecomposition reaction to form the polar group. One example thereof is shown by the following reaction scheme (D):

Reaction Scheme (D)

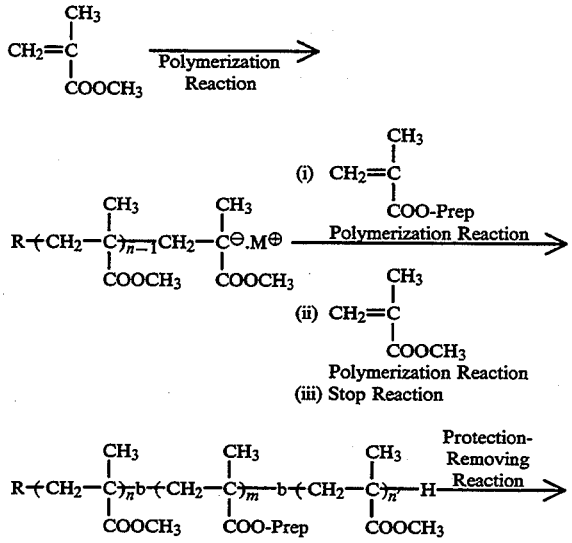

-continued

Reaction Scheme (D)

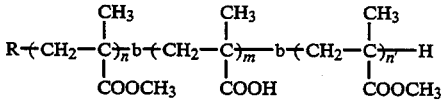

R: Alkyl group, porphyrin ring residue, etc.
Prep: Protective group (e.g., $-C(C_6H_5)_3$, $-Si(C_3H_7)_3$, etc.)
b: A bond connecting two blocks present on both sides
n, m, n': Repeating unit Specifically, the BAB block copolymer can be easily synthesized according to the synthesis methods described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Ute and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler et al, *Macromolecules*, 20, 1473 (1987), M. Morton, T. E. Helminiake et al, *J. Polym. Sci.*, 57, 471 (1962), B. Gordon III, M. Blumenthal and J. E. Loftus, *Polym. Bull.*, 11, 349 (1984), and R. B. Bates, W. A. Beavers et al, *J. Org. Chem.*, 44, 3800 (1979).

Also, the protection of the specified polar group by a protective group and the release of the protective group (a reaction for removing a protective group) can be easily conducted by utilizing conventionally known knowledges. More specifically, they can be performed by appropriately selecting methods described in the literature references cited hereinbefore with respect to the synthesis of the resin (B), as well as the methods as described in the above references.

Further, the BAB block copolymer can also be synthesized by performing a polymerization reaction under light irradiation using a monomer having an unprotected polar group and also using a dithiocarbamate group-containing compound and/or xanthate group-containing compound as an initiator. For example, the block copolymer can be synthesized according to the synthesis methods described in the literature references cited hereinbefore with respect to the synthesis of the resin (B).

The ratio of resin (A) to resin (B) used in the present invention is preferably 0.05 to 0.60/0.95 to 0.40, more preferably 0.10 to 0.40/0.90 to 0.60 in terms of a weight ratio of resin (A)/resin (B).

When the weight ratio of resin (A)/resin (B) is less than 0.05, the effect for improving the electrostatic characteristics may be reduced. On the other hand, when it is more than 0.60, the film strength of the photoconductive layer may not be sufficiently maintained in some cases (particularly, in case of using as an electrophotographic printing plate precursor).

Two or more kinds of each of the resins (A) and the resins (B) may be employed in the photoconductive layer. What is important is that the resin (A) and the resin (B) are employed in the ratio described above.

Furthermore, in the present invention, the binder resin used in the photoconductive layer may contain other resin(s) known for inorganic photoconductive substance in addition to the resin (A) and the resin (B)

according to the present invention. However, the amount of other resins descried above should not exceed 30 parts by weight per 100 parts by weight of the total binder resins since, if the amount is more than 30 parts by weight, the effects of the present invention are remarkably reduced.

Representative other resins which can be employed together with the resins (A) and (B) according to the present invention include vinyl chloride-vinyl acetate copolymers, styrene-butadiene copolymers, styrene-methacrylate copolymers, methacrylate copolymers, acrylate copolymers, vinyl acetate copolymers, polyvinyl butyral resins, alkyd resins, silicone resins, epoxy resins, epoxyester resins, and polyester resins.

Specific examples of other resins used are described, for example, in Takaharu Shibata and Jiro Ishiwatari, *Kobunshi* (*High Molecular Materials*), 17, 278 (1968), Harumi Miyamoto and Hidehiko Takei, *Imaging* No. 8, 9 (1973), Koichi Nakamura, *Kiroku Zairyoyo Binder no Jissai Gijutsu* (*Practical Technique of Binders for Recording Materials*), Cp. 10, published by C. M. C. Shuppan (1985), D. Tatt, S.C. Heidecker *Tappi,* 49, No. 10, 439 (1966), E. S. Baltazzi, R. G. Blanckette, et al., *Photo. Sci. Eng.,* 16, No. 5, 354 (1972), Nguyen Chank Keh, Isamu Shimizu and Eiichi Inoue, *Denshi Shashin Gakkaishi* (*Journal of Electrophotographic Association*), 18, No. 2, 22 (1980), JP-B-50-31011, JP-A-53-54027, JP-A-54-20735, JP-A-57-202544 and JP-A-58-68046.

The total amount of binder resin used in the photoconductive layer according to the present invention is preferably from 10 to 100 parts by weight, more preferably from 15 to 50 parts by weight, per 100 parts by weight of the inorganic photoconductive substance.

When the total amount of binder resin used is less than 10 parts by weight per 100 parts by weight of the inorganic photoconductive substance, it may be difficult to maintain the film strength of the photoconductive layer. On the other hand, when it is more than 100 parts by weight, the electrostatic characteristics may decrease and the image forming performance may degrade to result in the formation of poor duplicated image.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide.

As the spectral sensitizing dye which can be used in the present invention, various dyes can be employed individually or as a combination of two or more thereof. Examples of the spectral sensitizing dyes include, for example, carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes) as described for example, in Harumi Miyamoto and Hidehiko Takei, *Imaging,* 1973, No. 8, 12, C. J. Young e t al., *RCA Review,* 15, 469 (1954) , Kohei Kiyota et al., *Denkitsushin Gakkai Ronbunshi, J* 63-*C,* No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hamer, *The Cyanine Dyes and Related Compounds.* Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122 , JP-A-57-46245 , JP-A-56-35141, JP-A-57-157254, JP-A-61-26044 , JP-A-61-27551 , U.S. Pat. Nos. 3,619,154 and 4,175,956, and *Research Disclosure,* 216, 117 to 118 (1982).

The electrophotographic light-sensitive material of the present invention is excellent in that the performance properties thereof are not liable to vary even when various kinds of sensitizing dyes are employed together.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned Imaging, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka,* Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, preferably from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, preferably from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges usually from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, pp. 2 to 11 (1975), Hiroyuki Moriga, *Nyumon Tokushushi no Kagaku,* Kobunshi Kankokai (1975), and M. F. Hoover, *J. Macromol. Sci. Chem.,* A-4(6), pp. 1327 to 1417 (1970).

The electrophotographic light-sensitive material according to the present invention can be utilized in any known electrophotographic process. Specifically, the light-sensitive material of the present invention is employed in any recording system including a PPC system and a CPC system in combination with any developer including a dry type developer and a liquid developer. In particular, the light-sensitive material is preferably employed in combination with a liquid developer in order to obtain the excellent effect of the present invention since the light-sensitive material is capable of providing faithfully duplicated image of highly accurate original.

Further, a color duplicated image can be produced by using it in combination with a color developer in addition to the formation of black and white image. Reference can be made to methods described, for example, in Kuro Takizawa, *Shashin Kogyo,* 33, 34 (1975) and Masayasu Anzai, *Denshitsushin Gakkai Gijutsu Kenkyu Hokoku,* 77, 17 (1977).

Moreover, the light-sensitive material of the present invention is effective for recent other uses utilizing an electrophotographic process. For instance, the light-sensitive material containing photoconductive zinc oxide as a photoconductive substance is employed as an offset printing plate precursor, and the light-sensitive material containing photoconductive zinc oxide or titanium oxide which does not cause environmental pollution and has good whiteness is employed as a recording material for forming a block copy usable in an offset printing process or a color proof.

BEST MODE FOR CONDUCTING THE INVENTION

The present invention is illustrated in greater detail with reference to the following examples, but the present invention is not to be construed as being limited thereto.

Synthesis examples of the resin (A) are specifically illustrated below.

SYNTHESIS EXAMPLE 1 OF RESIN (A): Resin (A-1)

A mixed solution of 66 g of methyl methacrylate, 30 g of methyl acrylate, 4 g of acrylic acid, 28 g of Initiator (I-1) having the following structure and 150 g of tetrahydrofuran was heated to a temperature of 50° C. under nitrogen gas stream.

Initiator (I-1)

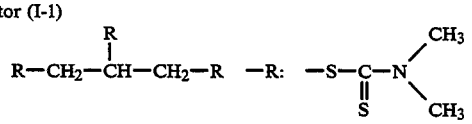

The solution was irradiated with light from a high-pressure mercury lamp of 400 W at a distance of 10 cm through a glass filter, and a photopolymerization reaction was conducted for 10 hours. The reaction mixture obtained was reprecipitated in one liter of methanol, and the precipitates formed were collected by filtration and dried. The yield of the resulting polymer was 72 g and the weight average molecular weight (Mw) (which was a value measured by a GPC method and calculated in terms of polystyrene) thereof was $8\times10^3$.

Resin (A-1)

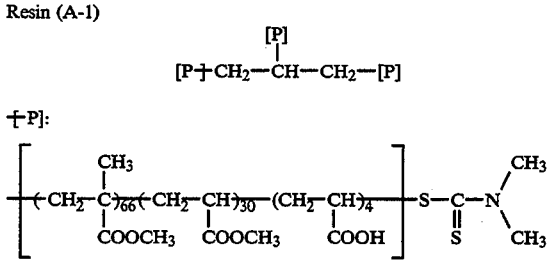

SYNTHESIS EXAMPLE 2 OF RESIN (A): Resin (A-2)

Resin (A-2) was synthesized under the same condition as described in Synthesis Example 1 of Resin (A) except for using 36.3 g of Initiator (I-2) shown below in place of 28 g of Initiator (I-1) used in Synthesis Example 1 of Resin (A). The yield of the resulting polymer was 75 g and the Mw was $7.5\times10^3$.

Initiator (I-2)

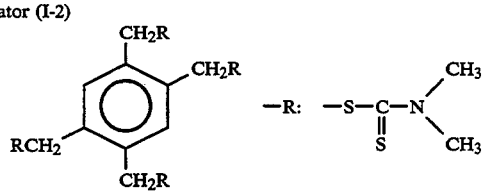

Resin (A-2)

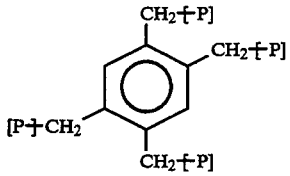

-continued

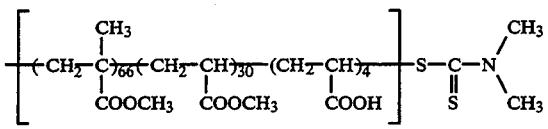

SYNTHESIS EXAMPLES 3 TO 9 OF RESIN (A): Resins (A-3) to (A-9)

Each of resins (A) shown in Table 1 below was synthesized under the same condition as described in Synthesis Example 1 of Resin (A) except for using a mixed solution of 95 g of 2-chlorophenyl methacrylate, 5 g of methacrylic acid, 0.10 mole of each of the initiators shown in Table 1 below and 100 g of tetrahydrofuran. The Mw of each of the resulting resins (A) was in a range of from $6\times10^3$ to $8\times10^3$.

TABLE 1

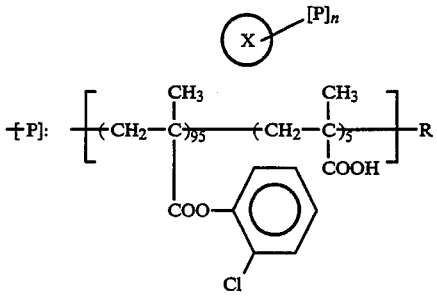

| Synthesis Example of Resin (A) | Initiator (I) | —R | 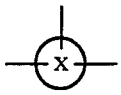 |
|---|---|---|---|
| 3 | 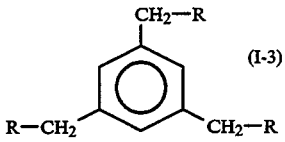 (I-3) | 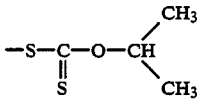 | 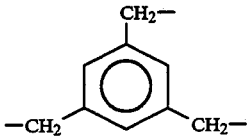 |
| 4 | 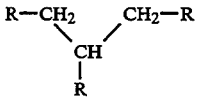 (I-4) | 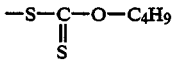 | 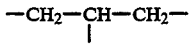 |
| 5 | 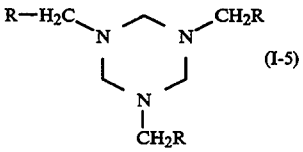 (I-5) | 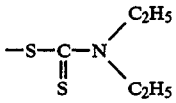 | 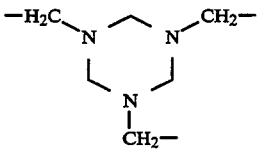 |
| 6 | 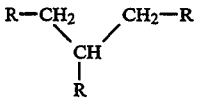 (I-6) | 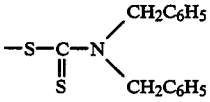 | 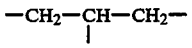 |
| 7 | 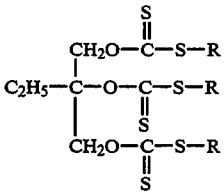 (I-7) | $-CH_2C_6H_5$ | 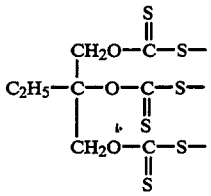 |
| 8 | 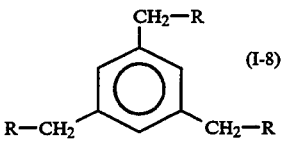 (I-8) | 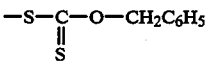 | 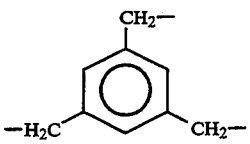 |

TABLE 1-continued

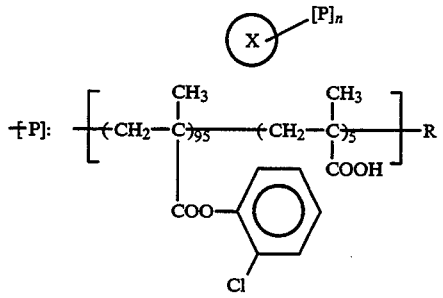

| Synthesis Example of Resin (A) | Initiator (I) | —R | 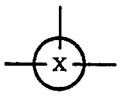 |
|---|---|---|---|
| 9 | 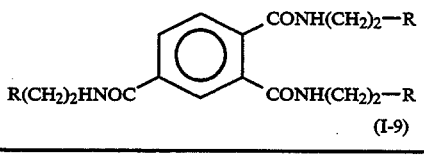 (I-9) | 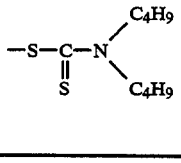 | 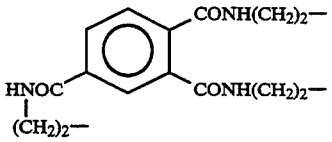 |

SYNTHESIS EXAMPLES 10 TO 25 OF RESIN (A): Resins (A-10) to (A-25)

Each of the resins (A) shown in Table 2 below was synthesized under the same condition as described in Synthesis Example 1 of Resin (A) except for using each of monomers corresponding to the polymer components shown in Table 2 below in place of methyl methacrylate, methyl acrylate and acrylic acid. The Mw of each of the resulting resins (A) was in a range of from $6\times10^3$ to $9\times10^3$.

TABLE 2

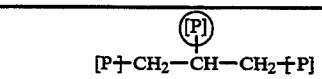

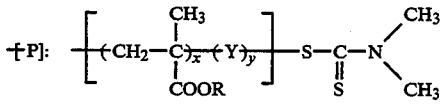

| Synthesis Example of Resin (A) | Resin (A) | —R | —Y— | x/y (weight ratio) |
|---|---|---|---|---|
| 10 | A-10 | $-CH_2C_6H_5$ | $-CH_2-CH-$ (COOH) | 95/5 |
| 11 | A-11 | $-CH_2C_6H_5$ | 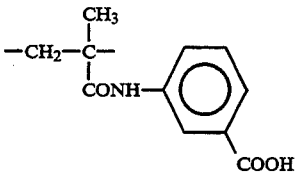 | 94/6 |
| 12 | A-12 | 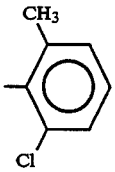 | $-CH_2-CH-$ (COOH) | 95/5 |
| 13 | A-13 | 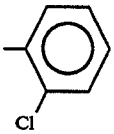 | 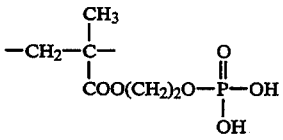 | 94/6 |

TABLE 2-continued
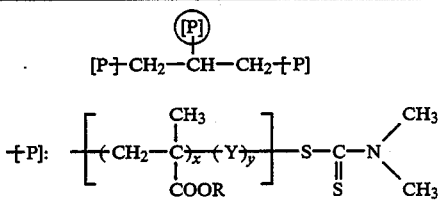
| Synthesis Example of Resin (A) | Resin (A) | —R | —Y— | x/y (weight ratio) |
|---|---|---|---|---|
| 14 | A-14 | 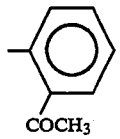 | 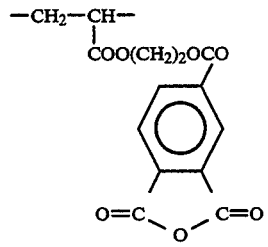 | 93/7 |
| 15 | A-15 | 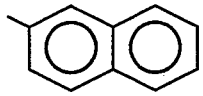 | 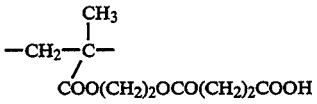 | 95/5 |
| 16 | A-16 | 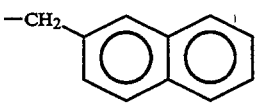 | 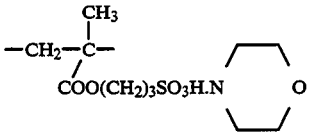 | 96/4 |
| 17 | A-17 | $-CH_3$ | 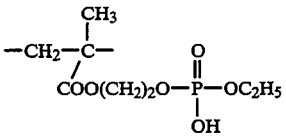 | 94/6 |
| 18 | A-18 | 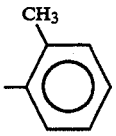 | 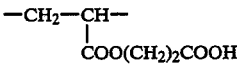 | 95/5 |
| 19 | A-19 | $-CH_2C_6H_5$ | 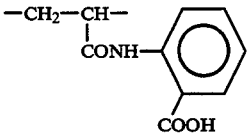 | 94/6 |
| 20 | A-20 | 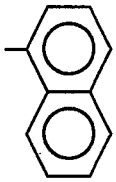 | 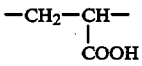 | 95/5 |

TABLE 2-continued

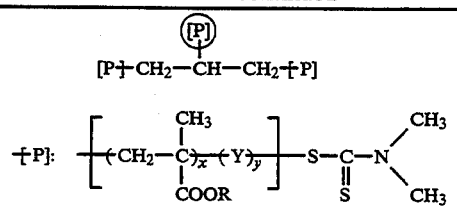

| Synthesis Example of Resin (A) | Resin (A) | —R | —Y— | x/y (weight ratio) |
|---|---|---|---|---|
| 21 | A-21 | 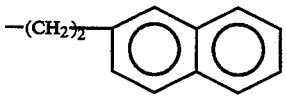 | 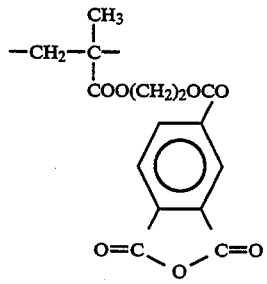 | 94/6 |
| 22 | A-22 | $-C_2H_5$ | 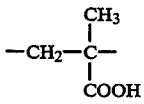 | 94/6 |
| 23 | A-23 | $-C_6H_5$ | 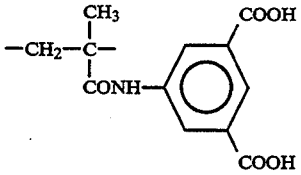 | 97/3 |
| 24 | A-24 | 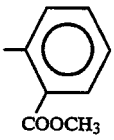 | 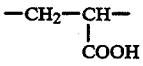 | 95/5 |
| 25 | A-25 | $-CH_2C_6H_5$ | 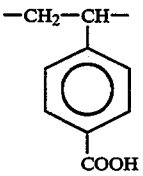 | 96/4 |

SYNTHESIS EXAMPLES 26 TO 30 OF RESIN (A): Resins (A-26) to (A-30)

A mixture of 33.9 g of Initiator (I-2) described above and monomers corresponding to the polymer components shown in Table 3 below was heated to a temperature of 40° C. under nitrogen gas stream, followed by light irradiation for polymerization in the same manner as described in Synthesis Example 1 of Resin (A). The solid material obtained was collected, dissolved in 250 ml of tetrahydrofuran, reprecipitated in 1.5 liters of methanol, and the precipitates formed were collected by filtration and dried. The yield of each of the resulting polymers was in a range of from 60 to 75 g and the Mw thereof was in a range of from $6\times10^3$ to $8\times10^3$.

TABLE 3

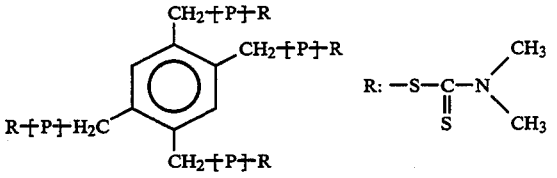

| Synthesis Example of Resin (A) | Resin (A) | Component of (P) (weight ratio) |
|---|---|---|
| 26 | (A-26) | 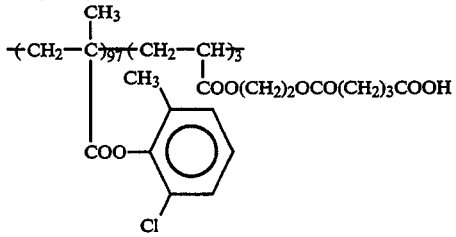 |
| 27 | (A-27) | 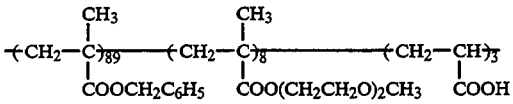 |
| 28 | (A-28) | 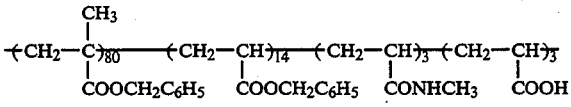 |
| 29 | (A-29) | 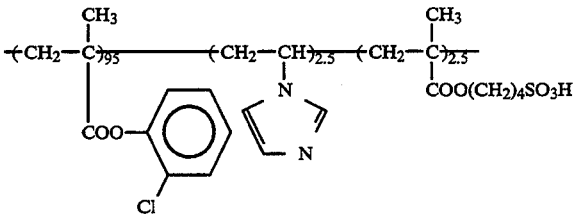 |
| 30 | (A-30) | 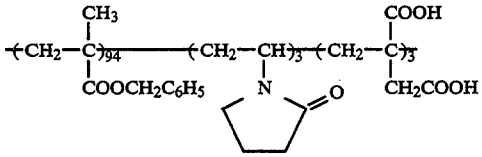 |

SYNTHESIS EXAMPLE 101 OF RESIN (A): Resin (A-101)

A mixture of 47.5 g of benzyl methacrylate, 24.8 g of Initiator (I-101) shown below and 70 g of tetrahydrofuran was heated to a temperature of 40° C. under nitrogen gas stream.

Initiator (I-101)

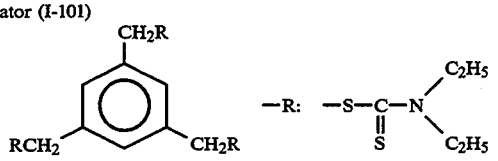

The solution was irradiated with light from a high-pressure mercury lamp of 400 W at a distance of 10 cm through a glass filter, and a photopolymerization reaction was conducted for 10 hours. To the reaction mixture was added a mixed solution of 2.5 g of methacrylic acid and 5 g of tetrahydrofuran, and the mixture was further irradiated with light in the same manner as above for 10 hours at a temperature of 40° C. under nitrogen gas stream. The reaction mixture was re-precipitated in 800 ml of a solvent mixture of water and methanol (2:1 by volume), and the precipitates formed were collected by filtration and dried. The yield of the resulting polymer was 38 g and the Mw thereof was $8.5\times10^3$.

Resin (A-101)

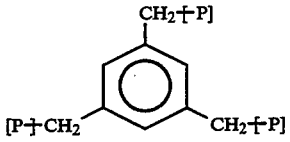

+P]:

-continued

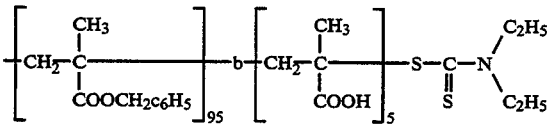

SYNTHESIS EXAMPLES 102 TO 110 OF RESIN (A): Resins (A-102) to (A-110)

Each of resins (A) shown in Table 4 below was synthesized under the same condition as described in Synthesis Example 101 of Resin (A) except for using each of monomers corresponding to the polymer components shown in Table 4 below in place of 47.5 g of benzyl methacrylate and 2.5 g of methacrylic acid. The Mw of each of the resulting resins (A) was in a range of from $7\times10^3$ to $1\times10^4$.

TABLE 4

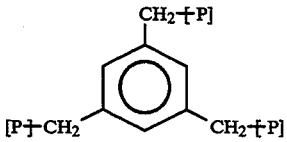

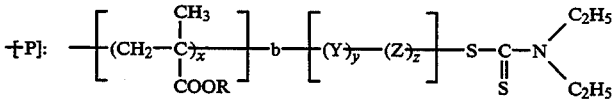

| Synthesis Example of Resin (A) | Resin (A) | —R | —Y— | —Z— | x/y/z |
|---|---|---|---|---|---|
| 102 | A-102 | 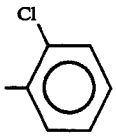 | — | $-CH_2-CH-$ (COOH) | 95/0/5 |
| 103 | A-103 | 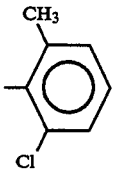 | — | $-CH_2-C-$ ($CH_3$, COOH) | 94/0/6 |
| 104 | A-104 | 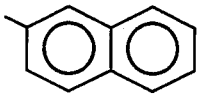 | — | $-CH_2-CH-$ ($COO(CH_2)_2COOH$) | 93/0/7 |
| 105 | A-105 | 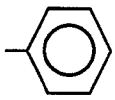 | $-CH_2-CH-$ ($COOCH_2C_6H_5$) | $-CH_2-CH-$ (COOH) | 87/10/3 |
| 106 | A-106 | 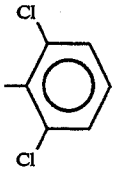 | $-CH_2-CH-$ 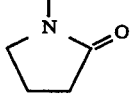 | $-CH_2-C-$ ($CH_3$, COOH) | 93/3/4 |
| 107 | A-107 | 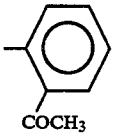 | — | $-CH_2-C-$ ($CH_3$, $COO(CH_2)_2O-P(=O)(OH)-OH$) | 94/0/6 |

TABLE 4-continued

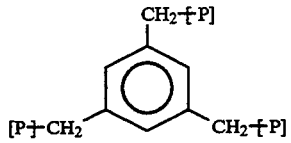

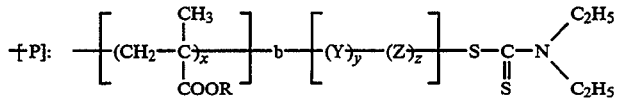

| Synthesis Example of Resin (A) | Resin (A) | —R | —Y— | —Z— | x/y/z |
|---|---|---|---|---|---|
| 108 | A-108 | 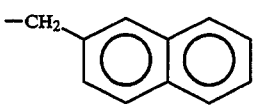 |  | 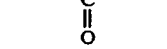 | 89/5/6 |
| 109 | A-109 | 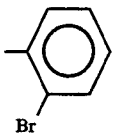 | — | 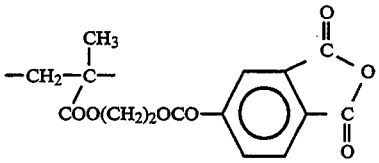 | 92/0/8 |
| 110 | A-110 | $-CH_2C_6H_5$ | 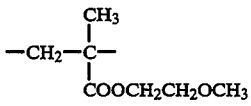 | 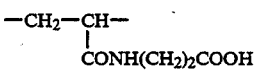 | 87/8/5 |

SYNTHESIS EXAMPLES 111 TO 116 OF RESIN (A): Resins (A-111) to (A-116)

A mixed solution of 40 g of 2-chlorophenyl methacrylate, 0.02 moles of each of the initiators shown in Table 5 below and 50 g of tetrahydrofuran was subjected to light irradiation for 8 hours in the same manner as described in Synthesis Example 101 of Resin (A). To the reaction mixture was added a mixed solution of 7.5 g of benzyl methacrylate, 2.5 of methacrylic acid and 10 g of tetrahydrofuran, followed by reacting in the same manner as described in Synthesis Example 101 of Resin (A). The Mw of each of the resulting resins (A) was in a range of from $5\times10^3$ to $9\times10^3$.

TABLE 5
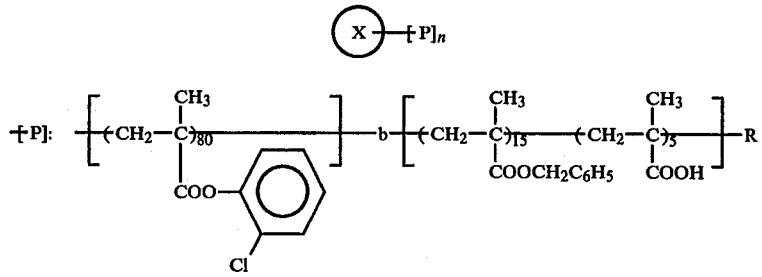
| Synthesis Example of Resin (A) | Resin (A) | Initiator (I) | —R | X—[P]$_n$ |
|---|---|---|---|---|
| 111 | A-111 | 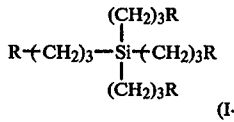 (I-102) | 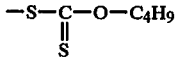 | 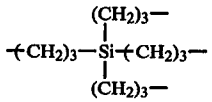 |
| 112 | A-112 | 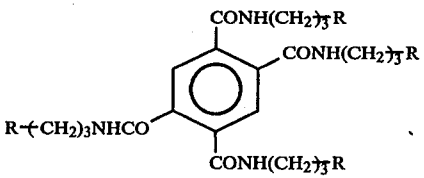 (I-103) | 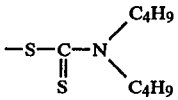 | 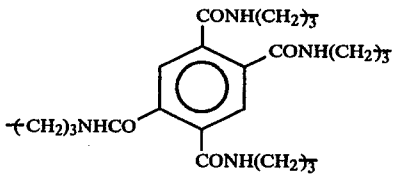 |
| 113 | A-113 | 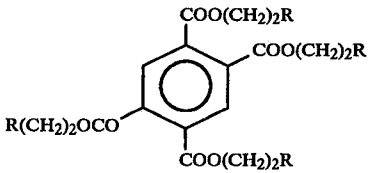 (I-104) | 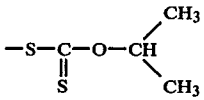 | 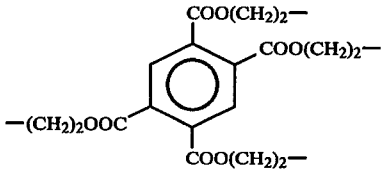 |
| 114 | A-114 | 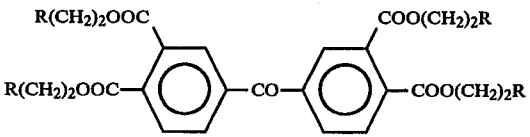 (I-105) | 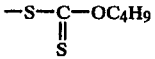 | 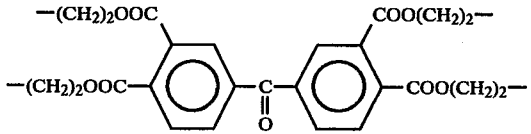 |

TABLE 5-continued
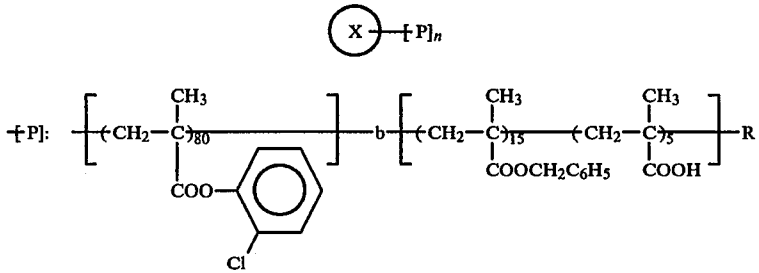
| Synthesis Example of Resin (A) | Resin (A) | Initiator (I) | —R | X—{P}$_n$ |
|---|---|---|---|---|
| 115 | A-115 | 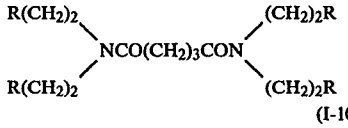 (I-106) | 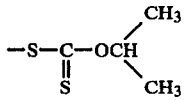 | 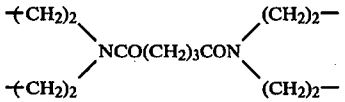 |
| 116 | A-116 | 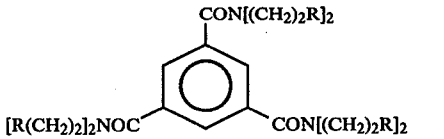 (I-107) | 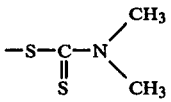 | 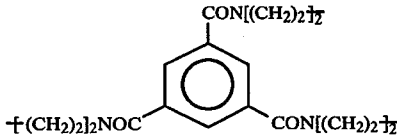 |

SYNTHESIS EXAMPLES 117 TO 125 OF RESIN (A): Resins (A-117) to (A-125)

A mixed solution of 52.5 g of methyl methacrylate, 17.5 g of methyl acrylate, 44 g of Initiator (I-108) shown below and 75 g of tetrahydrofuran was irradiated with light for 15 hours in the same manner as described in Synthesis Example 101 of Resin (A) at a temperature of 50° C. under nitrogen gas stream.

Initiator (I-108)

-continued

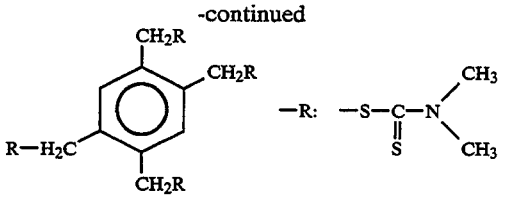

To the reaction mixture was added a mixture of monomers corresponding to the polymer components shown in Table 6 below and 25 g of tetrahydrofuran, and the mixture was further irradiated with light for 15 hours in the same manner as described above. The Mw of each of the resulting resins (A) was in a range of from $5\times10^3$ to $8\times10^3$.

TABLE 6

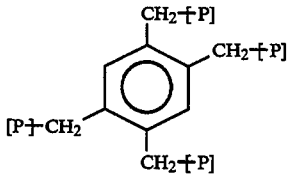

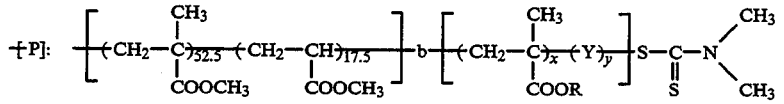

| Synthesis Example of Resin (A) | Resin (A) | —R | —Y— | x/y |
|---|---|---|---|---|
| 117 | A-117 | 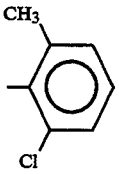 | 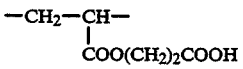 | 28/2 |
| 118 | A-118 | 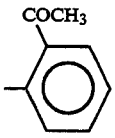 | 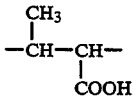 | 28.5/1.5 |
| 119 | A-119 | 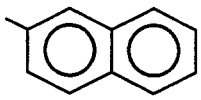 | 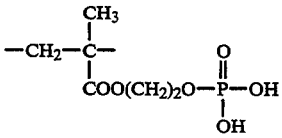 | 27/3 |
| 120 | A-120 | 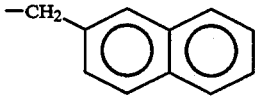 | 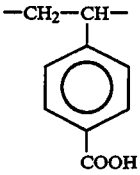 | 27.5/2.5 |
| 121 | A-121 | 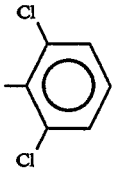 | 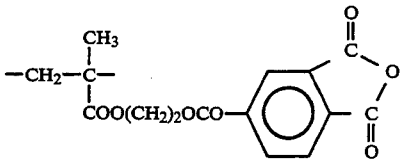 | 26/4 |

TABLE 6-continued

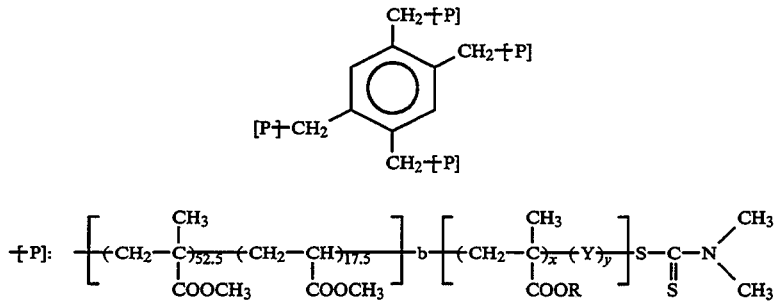

| Synthesis Example of Resin (A) | Resin (A) | —R | —Y— | x/y |
|---|---|---|---|---|
| 122 | A-122 | $-C_6H_5$ | 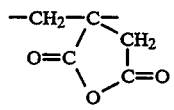 | 27/3 |
| 123 | A-123 | 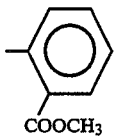 | 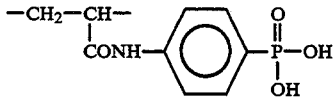 | 27.5/2.5 |
| 124 | A-124 | 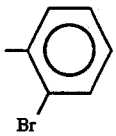 | 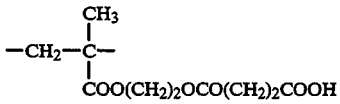 | 26.5/3.5 |
| 125 | A-125 | 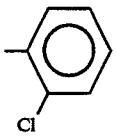 | 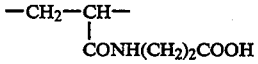 | 27.5/2.5 |

SYNTHESIS EXAMPLES 126 TO 131 OF RESIN (A): Resins (A-126) to (A-131)

Each of resins (A) shown in Table 7 below was synthesized in the same manner as described in Synthesis Example 101 of Resin (A) except for using monomers corresponding to the polymer components shown in Table 7 below and 0.03 moles of Initiator (I-109) shown below. The Mw of each of the resulting resins (A) was in a range of from $4\times10^3$ to $9\times10^3$.

Initiator (I-109)

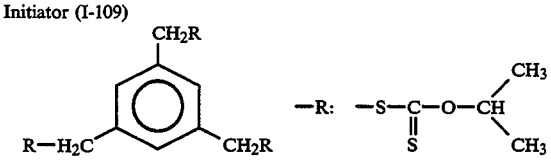

TABLE 7

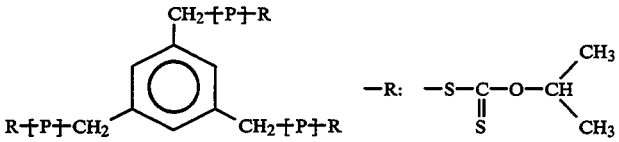

| Synthesis Example of Resin (A) | Resin (A) | ⊣P⊢ (weight ratio) |
|---|---|---|
| 126 | A-126 | 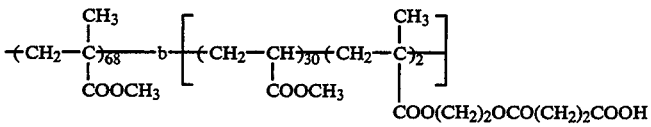 |

TABLE 7-continued

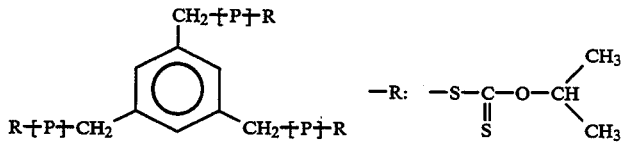

| Synthesis Example of Resin (A) | Resin (A) | ⊣P⊢ (weight ratio) |
|---|---|---|
| 127 | A-127 | 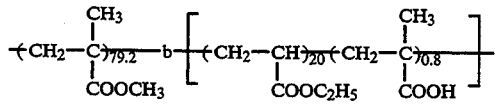 |
| 128 | A-128 | 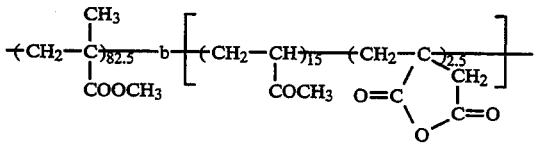 |
| 129 | A-129 | 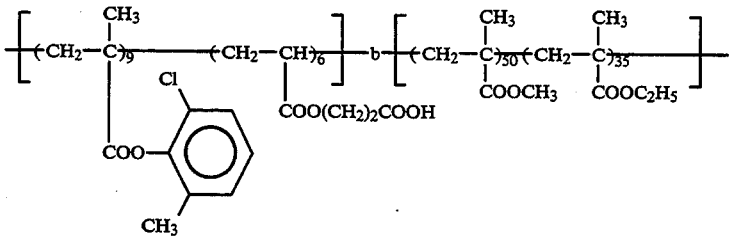 |
| 130 | A-130 | 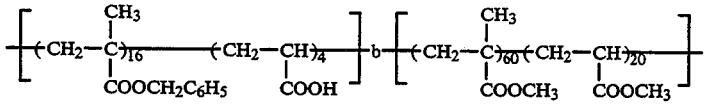 |
| 131 | A-131 | 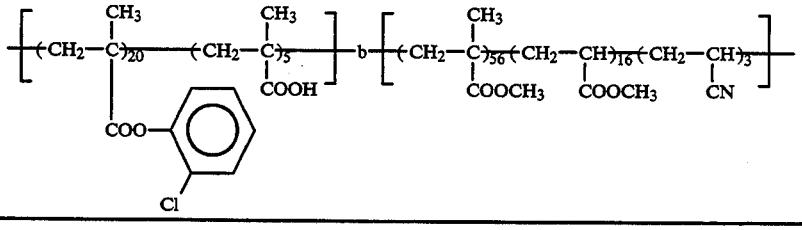 |

Synthesis examples of the resin (B) are specifically illustrated below.

SYNTHESIS EXAMPLE 1 OF RESIN (B): Resin (B-1)

A mixed solution of 100 g of methyl methacrylate and 200 g of tetrahydrofuran was sufficiently degassed under nitrogen gas stream and cooled to −20° C. Then, 0.8 g of 1,1-diphenylbutyl lithium was added to the mixture, and the reaction was conducted for 12 hours. Furthermore, a mixed solution of 60 g of methyl acrylate, 6 g of triphenylmethyl methacrylate and 5 g of tetrahydrofuran was sufficiently degassed under nitrogen gas stream, and, after adding the mixed solution to the above described mixture, the reaction was further conducted for 8 hours. The reaction mixture was adjusted to 0° C. and after adding thereto 10 ml of methanol, the reaction was conducted for 30 minutes and the polymerization was terminated.

The temperature of the polymer solution obtained was adjusted to a temperature of 30° C. under stirring and, after adding thereto 3 ml of an ethanol solution of 30% hydrogen chloride, the resulting mixture was stirred for one hour. Then, the solvent of the reaction mixture was distilled off under reduced pressure until the whole volume was reduced to a half, and then the mixture was reprecipitated from one liter of petroleum ether.

The precipitates formed were collected and dried under reduced pressure to obtain 72 g of the polymer having an Mw of $7.3\times10^4$.

Resin (B-1)

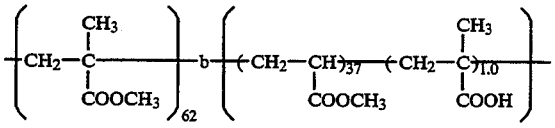

(weight ratio)

SYNTHESIS EXAMPLE 2 OF RESIN (B): Resin (B-2)

A mixed solution of 70 g of methyl methacrylate, 30 g of methyl acrylate, 0.5 g of (tetraphenyl prophynato)

aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture were further added 60 g of methyl acrylate and 3.2 g of benzyl methacrylate, after light-irradiating in the same manner as above for 8 hours, 3 g of methanol was added to the reaction mixture followed by stirring for 30 minutes, and the reaction was terminated. Then, Pd-C was added to the reaction mixture, and a catalytic reduction reaction was conducted for one hour at a temperature of 25° C.

After removing insoluble substances from the reaction mixture by filtration, the reaction mixture was reprecipitated from 500 ml of petroleum ether and the precipitates formed were collected and dried to obtain 118 g of the resin having an Mw of $8\times10^4$.

Resin (B-2)

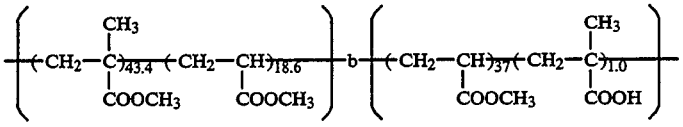

SYNTHESIS EXAMPLE 3 OF RESIN (B): Resin (B-3)

A mixed solution of 100 g of ethyl methacrylate and 200 g of toluene was sufficiently degassed under nitrogen gas stream and cooled to 0° C. Then, 2.5 g of 1,1-diphenyl-3-methylpentyl lithium was added to the mixture followed by stirring for 6 hours. Further, 60 g of methyl methacrylate and 11.7 g of 4-vinylbenzenecarboxylic acid triisopropylsilyl ester were added to the mixture and, after stirring the mixture for 6 hours, 3 g of methanol was added to the mixture followed by stirring for 30 minutes.

Then, to the reaction mixture was added 10 g of an ethanol solution of 30% hydrogen chloride and, after stirring the mixture at 25° C. for one hour, the mixture was reprecipitated from one liter of methanol. The precipitates thus formed were collected, washed twice with 300 ml of methanol and dried to obtain 121 g of the polymer having an Mw of $6.5\times10^4$.

Resin (B-3)

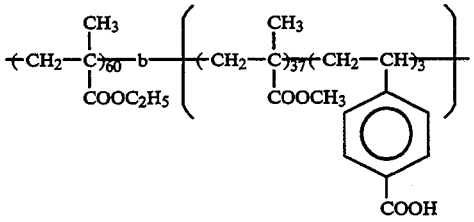

SYNTHESIS EXAMPLE 4 OF RESIN (B): Resin (B-4)

A mixture of 67 g of methyl methacrylate and 4.8 g of benzyl N,N-diethyldithiocarbamate was placed in a vessel under nitrogen gas stream followed by closing the vessel and heated to a temperature of 50° C. The mixture was irradiated with light from a high-pressure mercury lamp of 400 W at a distance of 10 cm through a glass filter for 6 hours to conduct photopolymerization.

Then, 32 g of methyl acrylate, 1 g of acrylic acid and 180 g of methyl ethyl ketone were added to the mixture and, after replacing the gas in the vessel with nitrogen, the mixture was light-irradiated again for 10 hours. The reaction mixture was reprecipitated from one liter of methanol and the precipitates formed were collected and dried to obtain 73 g of the polymer having an Mw of $4.8\times10^4$.

Resin (B-4)

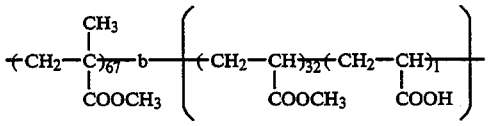

SYNTHESIS EXAMPLE 5 OF RESIN (B): Resin (B-5)

A mixture of 50 g of methyl methacrylate, 25 g of ethyl methacrylate and 1.0 g of benzyl isopropylxanthate was placed in a vessel under nitrogen gas stream followed by closing the vessel and heated to a temperature of 50° C. The mixture was irradiated with light from a high-pressure mercury lamp of 400 W at a distance of 10 cm through a glass filter for 6 hours to conduct photopolymerization. The polymerization product was dissolved in tetrahydrofuran to make a 40% solution, then 22 g of methyl acrylate was added thereto and, after replacing the gas in the vessel with nitrogen, the mixture was light-irradiated again for 10 hours.

Then, 3 g of 2-(2'-carboxyethyl)carbonyloxyethyl methacrylate was added to the mixture and, after replacing the gas in the vessel with nitrogen, the mixture was light-irradiated again for 8 hours. The reaction mixture was reprecipitated from 2 liters of methanol and the powder collected was dried to obtain 63 g of the polymer having an Mw of $6\times10^4$.

Resin (B-5)

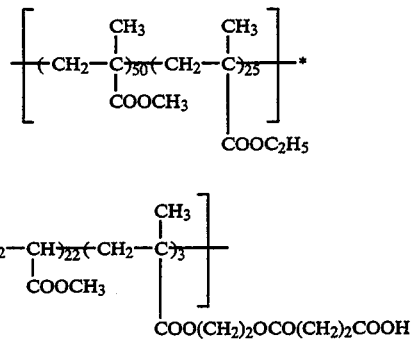

SYNTHESIS EXAMPLE 6 OF RESIN (B): Resin (B-6)

A mixed solution of 97 g of ethyl acrylate, 3 g of methacrylic acid, 2 g of 2-mercaptoethanol and 200 g of tetrahydrofuran was heated to a temperature of 60° C. under nitrogen gas stream with stirring, and 1.0 g of 2,2'-azobisisovaleronitrile (abbreviated as AIVN) was added thereto to effect a reaction for 4 hours. To the reaction mixture was further added 0.5 g of AIVN, followed by reacting for 4 hours. The temperature of the reaction mixture was adjusted to a temperature of 20° C., then a mixed solution of 8.6 g of 4,4'-azobis(4-cyanovaleric acid), 12 g of dicyclohexylcarbodiimide, 0.2 g of 4-(N,N-dimethylamino)pyridine and 30 g of tetrahydrofuran was added dropwise thereto over a period of one hour. After further stirring for 2 hours, 5 g of a 85% aqueous formic acid solution was added thereto, followed by stirring for 30 minutes. The crystals thus-deposited were removed by filtration, the filtrate was distilled under reduced pressure at a temperature of 25° C. to remove the solvent. The polymer thus-obtained (polymer initiator) shown below had an Mw of $6.3\times10^3$.

Polymer Initiator

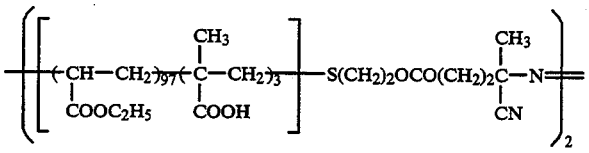

A mixed solution of 70 g of methyl methacrylate and 170 g of toluene was heated to a temperature of 70° C. under nitrogen gas stream with stirring. A solution prepared by dissolving 30 g of the above described polymer initiator in 30 g of toluene and replacing the gas in the vessel with nitrogen was added to the above mixed solution, followed by reacting for 8 hours. The polymer formed was reprecipitated from 2 liters of methanol and the powder collected was dried to obtain 72 g of the polymer having an Mw of $4\times10^4$.

Resin (B-6)

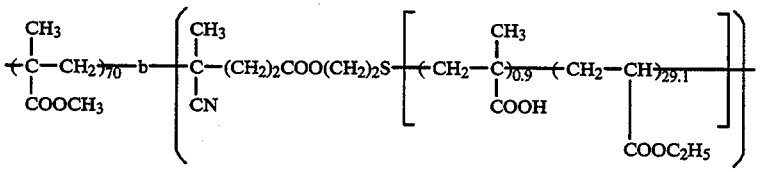

SYNTHESIS EXAMPLES 7 TO 16 OF RESIN (B): Resins (B-7) to (B-16)

Each of the resins (B) shown in Table 8 below was synthesized in the same reaction procedure as described in Synthesis Example 3 of Resin (B). The Mw of each of the resins obtained was in a range of from $5\times10^4$ to $9\times10^4$.

TABLE 8
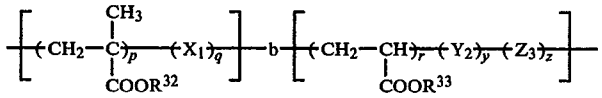
| Synthesis Examples of Resin (B) | Resin (B) | $R^{32}$ | $-X_1-$ | $R^{33}$ | $-Y_2-$ | $-Z_3-$ | p/q/r/y/z (weight ratio) |
|---|---|---|---|---|---|---|---|
| 7 | B-7 | $-CH_3$ | — | $-CH_3$ | — | $-CH_2-CH(COO(CH_2)_2COOH)-$ | 65/0/32/0/3 |
| 8 | B-8 | $-CH_3$ | — | $-C_2H_5$ | — | 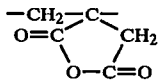 | 72/0/25/0/3 |
| 9 | B-9 | $-CH_3$ | $-CH_2-CH(COOCH_3)-$ | $-CH_3$ | 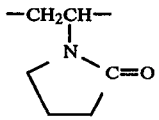 | $-CH_2-C(CH_3)(COOH)-$ | 66/10/20/3/1 |
| 10 | B-10 | $-C_2H_5$ | $-CH_2-CH(COOCH_2C_6H_5)-$ | $-CH_3$ | — | $-CH_2-CH(COO(CH_2)_3SO_3H)-$ | 74.2/10/15/0/0.8 |
| 11 | B-11 | $-C_3H_7$ | 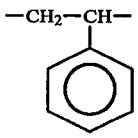 | $-CH_3$ | $-CH_2CH(COOCH_2CH_2OCH_3)-$ | $-CH_2-C(COOH)(CH_2COOH)-$ | 61/10/20/8/1.0 |
| 12 | B-12 | $-CH_3$ | $-CH_2-CH(COOC_2H_5)-$ | $-CH_3$ | $-CH_2CH(COCH_3)-$ | $-CH_2-C(CH_3)(COO(CH_2)_2O-P(=O)(OH)-OH)-$ | 59/10/20/10/1.0 |

TABLE 8-continued
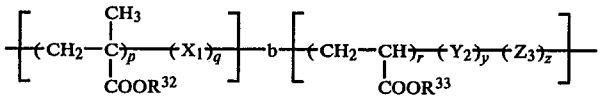
| Synthesis Examples of Resin (B) | Resin (B) | $R^{32}$ | $-X_1-$ | $R^{33}$ | $-Y_2-$ | $-Z_3-$ | p/q/r/y/z (weight ratio) |
|---|---|---|---|---|---|---|---|
| 13 | B-13 | $-CH_3$ | — | $-C_2H_5$ | — | 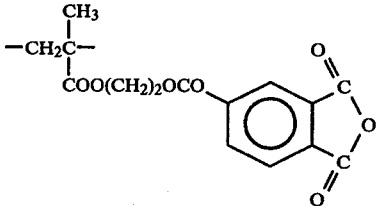 | 81/0/15/0/4 |
| 14 | B-14 | $-C_6H_5$ | 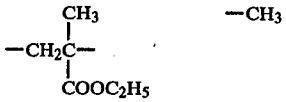 | $-CH_3$ | 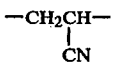 | 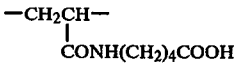 | 30/20/45/3/2 |
| 15 | B-15 | $-CH_2C_6H_5$ | — | $-CH_3$ | 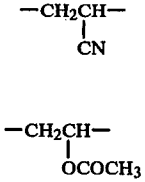 | 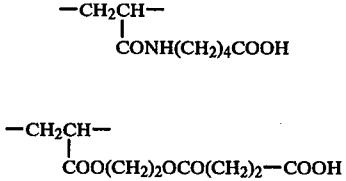 | 75/0/15/6.5/3.5 |
| 16 | B-16 | $-CH_3$ | — | $-C_2H_5$ | 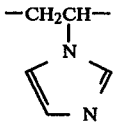 | 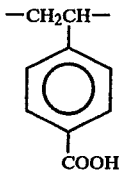 | 80/0/14/4/2 |

SYNTHESIS EXAMPLES 17 TO 23 OF RESIN (B): Resins (B-17) to (B-23)

Each of the resins (B) shown in Table 9 below was synthesized in the same reaction procedure as described in Synthesis Example 4 of Resin (B). The Mw of each of the resins obtained was in a range of from $4\times10^4$ to $8\times10^4$.

TABLE 9

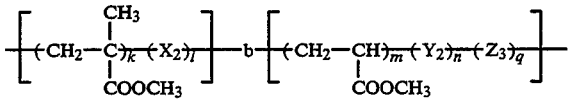

| Synthesis Example of resin (B) | Resin (B) | $-X_2-$ | $-Y_2-$ | $-Z_3-$ | k/l/m/n/q (weight ratio) |
|---|---|---|---|---|---|
| 17 | B-17 | $-CH_2-CH(COOC_2H_5)-$ | $-CH_2-CH(OCH_3)-$ | $-CH_2-CH(COOH)-$ | 64/15/15/4.8/1.2 |
| 18 | B-18 | — | $-CH_2-CH(OC_2H_5)-$ | $-CH_2-C(CH_3)(COOH)-$ | 70/0/20/9/1.0 |
| 19 | B-19 | — | — | $-CH_2-C(CH_3)(COO(CH_2)_2OP(=O)(OH)-OH)-$ | 67/0/31.5/0/1.5 |
| 20 | B-20 | — | $-CH_2-CH(COO(CH_2)_2)-$ 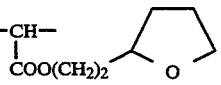 | $-CH_2-CH(COOH)-$ | 65/0/28/6/1.0 |
| 21 | B-21 | $-CH_2-C(CH_3)(COOC_2H_5)-$ | $-CH_2-CH(CH_3)(COO(CH_2)_2)-$ 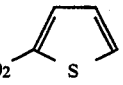 | $-CH_2-CH(COO(CH_2)_2COOH)-$ | 53.4/10/30/5/1.6 |
| 22 | B-22 | $-CH_2-CH(CN)-$ | $-CH_2-CH(COOC_2H_5)-$ | $-CH(CH_3)-CH(COOH)-$ | 64/5/20/10/1.0 |
| 23 | B-23 | — | $-CH_2-CH-$ 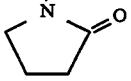 | $-CH_2-CH(CONH-$ 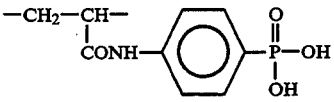 | 70/0/25/3/2.0 |

SYNTHESIS EXAMPLE 101 OF RESIN (B): Resin (B-101)

A mixture of 47.5 g of methyl acrylate, 2.5 g of acrylic acid, 7.6 g of 2-carboxyethyl N,N-diethyldithiocarbamate (Initiator I-101) and 50 g of tetrahydrofuran was placed in a vessel under nitrogen gas stream followed by closing the vessel and heated to a temperature of 50° C. The mixture was irradiated with light from a high-pressure mercury lamp for 400 W at a distance of 10 cm through a glass filter for 8 hours to conduct photopolymerization. The reaction mixture obtained was reprecipitated from 500 ml of petroleum ether, and the precipitates formed were collected and dried to obtain 41 g of the polymer having an Mw of $1.0\times10^4$.

A mixture of 10 g of the above described polymer (polymer initiator), 65 g of methyl methacrylate, 25 g of methyl acrylate and 100 g of tetrahydrofuran was heated to a temperature of 50° C. under nitrogen gas stream and irradiated with light under the same condition as above for 10 hours to conduct photopolymerization. The reaction mixture was reprecipitated from one liter of methanol and the precipitates thus formed were collected and dried to obtain 85 g of the block polymer having an Mw of $8.5\times10^4$.

Resin (B-101)

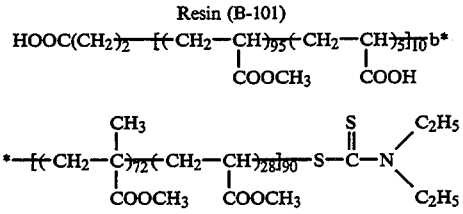

SYNTHESIS EXAMPLE 102 OF RESIN (B): Resin (B-102)

A mixed solution of 67 g of methyl methacrylate, g of methyl acrylate, 2.2 g of benzyl N-ethyl—N-(2-carboxyethyl)dithiocarbamate (Initiator I-102) and 100 g of tetrahydrofuran was heated to a temperature of 50° C. under nitrogen gas stream and irradiated with light under the same condition as described in Synthesis Example 101 of Resin (B) for 8 hours to conduct photopolymerization. The reaction mixture was reprecipitated from one liter of methanol and the precipitates formed were collected and dried to obtain 85 g of the polymer having an Mw of $8\times10^4$.

A mixture of 85 g of the above described polymer, 14 g of methyl methacrylate, 1 g of methacrylic acid and 150 g of tetrahydrofuran was heated to a temperature of 50° C. under nitrogen gas stream and irradiated to light under the same condition as described in Synthesis Example 101 of Resin (B) for 16 fours to conduct photopolymerization. The reaction mixture was reprecipitated from one liter of methanol and the precipitates formed were collected and dried to obtain 83 g of the block polymer having an Mw of $9.5\times10^4$.

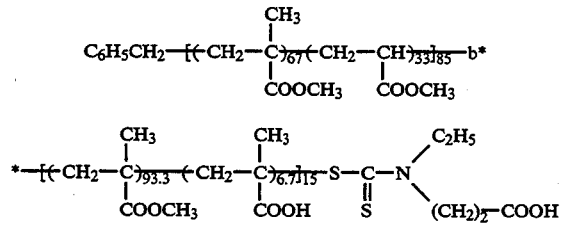

SYNTHESIS EXAMPLE 103 OF RESIN (B): Resin (B-103)

A mixed solution of 80 g of ethyl methacrylate and 200 g of toluene was sufficiently degassed under nitrogen gas stream and cooled to −20° C. Then, 2.0 g of 1,1-diphenyl-3-methylpentyl lithium was added to the mixture followed by stirring for 12 hours. To the mixture were further added 19 g of methyl methacrylate and 1.5 g of 4-vinylphenylcarbonyloxytrimethylsilane and the mixture was subjected to reaction for 12 hours. Then, the mixture was reacted for 2 hours under carbon dioxide gas stream, followed by reacting at a temperature of 0° C. for 2 hours. To the reaction mixture was added dropwise one liter of a methanol solution containing 10 g of 30% hydrochloric acid with stirring over a period of 30 minutes, followed by stirring for one hour. The powder thus deposited was collected by filtration, washed with methanol and dried to obtain 75 g of the block polymer having an Mw of $6.5\times10^4$.

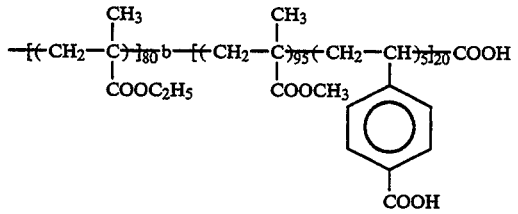

SYNTHESIS EXAMPLES 104 TO 113 OF RESIN (B): Resins (B-104) to (B-113)

Each of the resins (B) Shown in Table 10 below was synthesized in the same reaction procedure as described in Synthesis Example 102 of Resin (B). The Mw of each of the resins obtained was in a range of from $7\times10^4$ to $9\times10^4$ TABLE 10
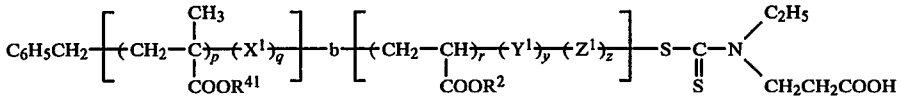
| Synthesis Examples of Resin (B) | Resin (B) | $R^{41}$ | $-X^1-$ | $R_2$ | $-Y^1-$ | $-Z^1-$ | p/q/r/y/z (weight ratio) |
|---|---|---|---|---|---|---|---|
| 104 | B-104 | $-CH_3$ | — | $-CH_3$ | — | $-CH_2-CH(COO(CH_2)_2COOH)-$ | 65/0/32/0/3 |
| 105 | B-105 | $-CH_3$ | — | $-C_2H_5$ | — | 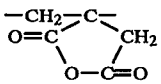 | 72/0/25/0/3 |
| 106 | B-106 | $-CH_3$ | $-CH_2-CH(COOCH_3)-$ | $-CH_3$ | 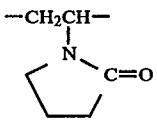 | $-CH_2-C(CH_3)(COOH)-$ | 66/10/20/3/1 |
| 107 | B-107 | $-C_2H_5$ | $-CH_2-CH(COOCH_2C_6H_5)-$ | $-CH_3$ | — | $-CH_2-CH(COO(CH_2)_3SO_3H)-$ | 74.2/10/15/0/0.8 |
| 108 | B-108 | $-C_3H_7$ | 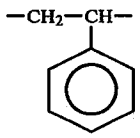 | $-CH_3$ | $-CH_2CH(COOCH_2CH_2OCH_3)-$ | $-CH_2-C(COOH)(CH_2COOH)-$ | 61/10/20/8/1.0 |
| 109 | B-109 | $-CH_3$ | $-CH_2-CH(COOC_2H_5)-$ | $-CH_3$ | $-CH_2CH(COCH_3)-$ | $-CH_2C(CH_3)(COO(CH_2)_2O-P(=O)(OH)-OH)-$ | 59/10/20/10/1.0 |

TABLE 10-continued
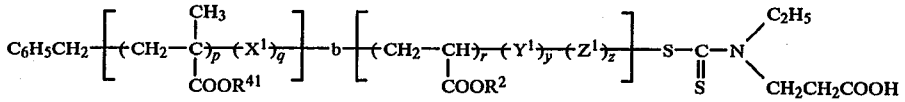
| Synthesis Examples of Resin (B) | Resin (B) | $R^{41}$ | $-X^1-$ | $R_2$ | $-Y^1-$ | $-Z^1-$ | p/q/r/y/z (weight ratio) |
|---|---|---|---|---|---|---|---|
| 110 | B-110 | $-CH_3$ | — | $-C_2H_5$ | — | 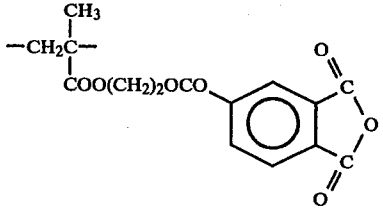 | 81/0/15/0/4 |
| 111 | B-111 | $-C_6H_5$ | 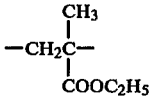 | $-CH_3$ | 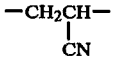 | 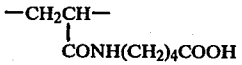 | 30/20/45/3/2 |
| 112 | B-112 | $-CH_2C_6H_5$ | — | $-CH_3$ | 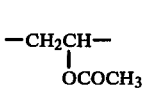 | 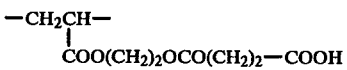 | 75/0/15/6.5/3.5 |
| 113 | B-113 | $-CH_3$ | — | $-C_2H_5$ | 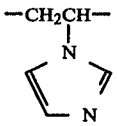 | 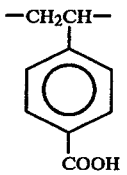 | 80/0/14/4/2 |

SYNTHESIS EXAMPLES 114 TO 120 OF RESIN (B): Resins (B-114) to (B-120)

Each of the block polymers shown in Table 10 below was synthesized in the same manner as described in Synthesis Example 101 of Resin (B) except for using $4.2\times10^{-3}$ moles of each of the initiators shown in Table 11 below in place of 7.6 g of Initiator (I-101) used in Synthesis Example 101 of Resin (B). The Mw of each of the resins was in a range of from $8\times10^{4}$ to $10\times10^{4}$.

TABLE 11

| Synthesis Example of Resin (B) | Resin (B) | Initiator |
|---|---|---|
| 114 | B-114 | I-103 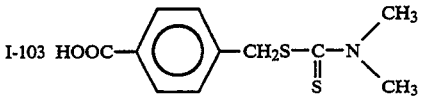 |
| 115 | B-115 | I-104 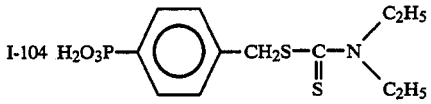 |
| 116 | B-116 | I-105 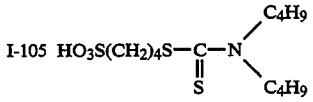 |
| 117 | B-117 | I-106 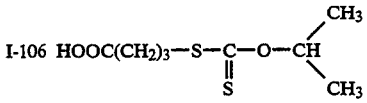 |
| 118 | B-118 | I-107 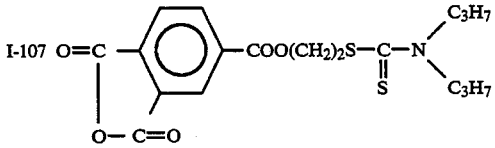 |
| 119 | B-119 | I-108 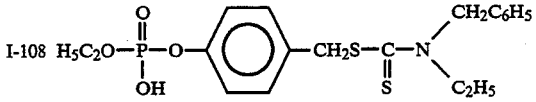 |
| 120 | B-120 | I-109 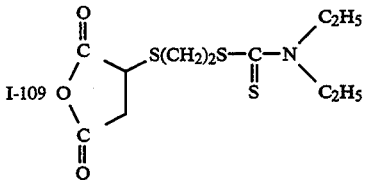 |

SYNTHESIS EXAMPLES 121 TO 130 OF RESIN (B): Resins (B-121) to (B-130)

Each of the resins (B) shown in Table 12 below was synthesized by a photopolymerization reaction in the same manner as described in Synthesis Example 102 of Resin (B). The Mw of each of the resins was in a range of from $6\times10^{4}$ to $8\times10^{4}$.

TABLE 12
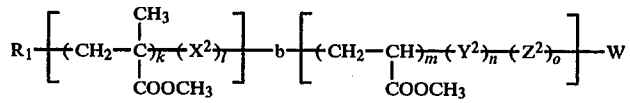
| Synthesis Example of Resin (B) | Resin (B) | $R_1$ | —W— | —$X^2$— | —$Y^2$— | —$Z^2$— | k/l/m/n/o (weight ratio) |
|---|---|---|---|---|---|---|---|
| 121 | B-121 | $C_4H_9$— | 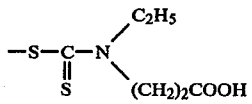 | 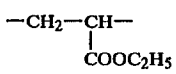 | 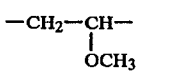 | 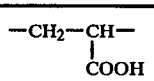 | 64/15/15/4.8/1.2 |
| 122 | B-122 | $C_4H_9$— | 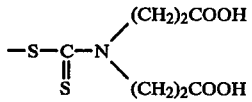 | — | 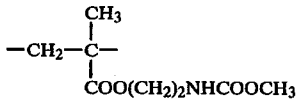 | 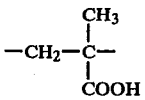 | 70/0/20/9/1.0 |
| 123 | B-123 | $C_6H_5CH_2$— | 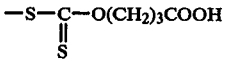 | 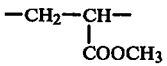 | — | 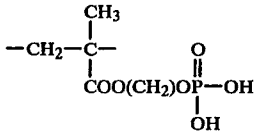 | 47/20/32/0/1.0 |
| 124 | B-124 | $C_6H_5CH_2$— | 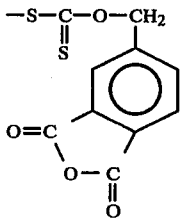 | 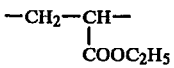 | 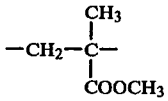 | 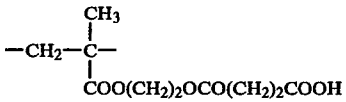 | 48.5/10/10/30/1.5 |
| 125 | B-125 | $C_6H_{13}$— |  |  | 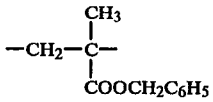 | 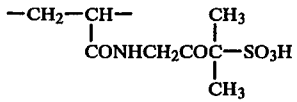 | 59/10.2/10/20/0.8 |
| 126 | B-126 | $C_6H_5CH_2$— | 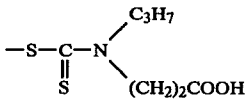 | — | 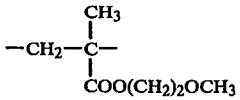 | 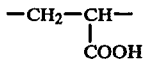 | 80/0/16.3/2.5/1.2 |

TABLE 12-continued
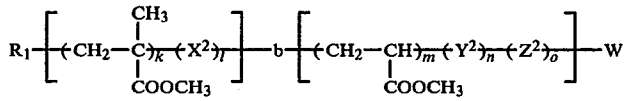
| Synthesis Example of Resin (B) | Resin (B) | $R_1$ | —W— | —$X^2$— | —$Y^2$— | —$Z^2$— | k/l/m/n/o (weight ratio) |
|---|---|---|---|---|---|---|---|
| 127 | B-127 | $C_6H_{13}$— | 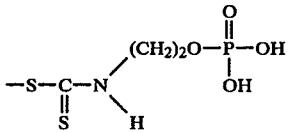 | — | 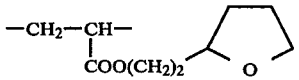 | 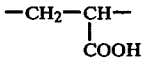 | 80/0/16/3/1.0 |
| 128 | B-128 | $C_6H_5CH_2$— | 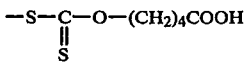 | 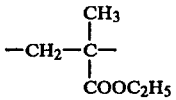 | 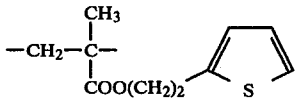 | 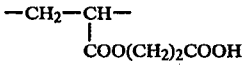 | 40/45/11/2.5/1.5 |
| 129 | B-129 | $C_3H_7$— | 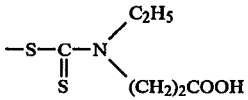 | 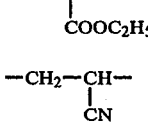 | 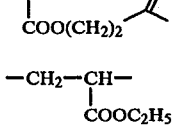 | 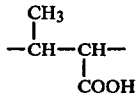 | 64/5/20/10/1.0 |
| 130 | B-130 | $C_8H_{17}$— | 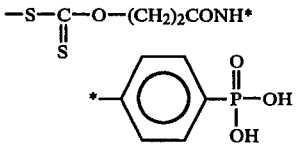 | 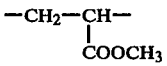 | 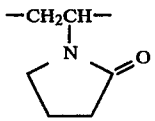 | 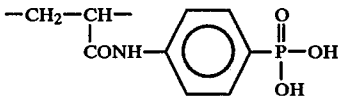 | 50/25/21/2.5/1.5 |

SYNTHESIS EXAMPLE 201 OF RESIN (B): Resin (B-201)

A mixed solution of 90 g of methyl acrylate, 10 g of acrylic acid and 13.4 g of Initiator (I-201) having the following formula was heated to a temperature of 40° C. under nitrogen gas stream.

Initiator (I-201)

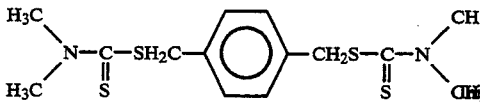

The solution was irradiated with light from a high-pressure mercury lamp of 400 W at a distance of 10 cm through a glass filter for 10 hours to conduct photopolymerization. The reaction mixture obtained was reprecipitated in one liter of methanol, and the precipitates formed were collected and dried to obtain 78 g of the polymer having a weight average molecular weight (Mw) of $2\times10^4$.

A mixed solution of 10 g of the above described polymer, 65 g of methyl methacrylate, 25 g of methyl acrylate and 100 g of tetrahydrofuran was heated to a temperature of 50° C. under nitrogen gas stream and irradiated with light under the same condition as above for 15 hours. The reaction mixture was reprecipitated from 1.5 liters of methanol and the precipitates thus formed were collected and dried to obtain 75 g of the polymer having an Mw of $8\times10^4$.

Resin (B-201)

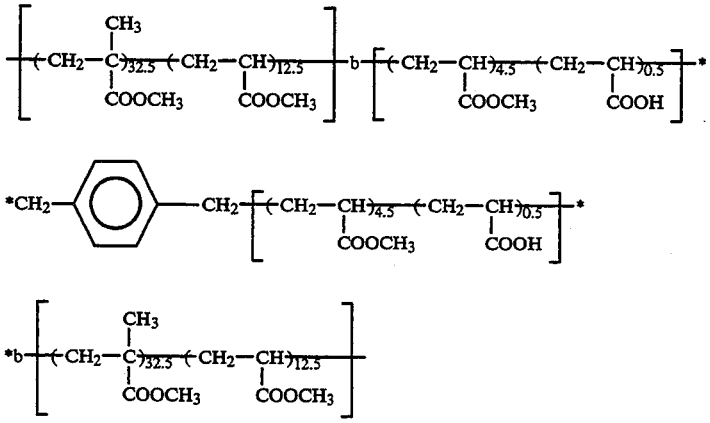

SYNTHESIS EXAMPLE 202 OF RESIN (B): Resin (B-202)

A reaction procedure was conducted under the same condition as Synthesis Example 201 of Resin (B) except using 14.8 g of Initiator (I-202) having the following structure in place of 13.4 g of Initiator (I-201) used in Synthesis Example 201 of Resin (B) to obtain 73 g of the polymer having an Mw of $5\times10^4$.

Initiator (I-202)

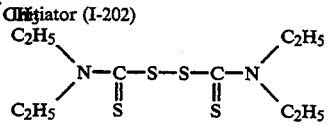

Resin (B-202)

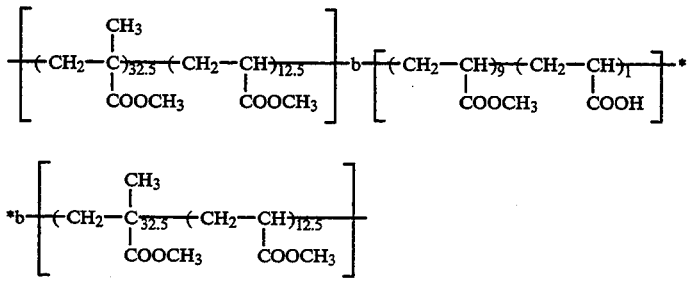

SYNTHESIS EXAMPLE 203 OF RESIN (B): Resin (B-203)

A mixed solution of 80 g of methyl methacrylate, 20 g of ethyl acrylate, 13.5 g of Initiator (I-203) having the following structure and 150 g of tetrahydrofuran was heated at a temperature of 50° C. under nitrogen gas stream.

Initiator (I-203)

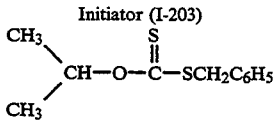

The mixture was irradiated with light under the same condition as described in Synthesis Example 201 of Resin (B) for 10 hours. The reaction mixture obtained was reprecipitated from one liter of methanol and the precipitates thus formed were collected and dried to obtain the polymer.

A mixed solution of 60 g of the above described polymer, 30 g of methyl acrylate, 10 g of methacrylic acid and 100 g of tetrahydrofuran was heated to a temperature of 50° C. under nitrogen gas stream and subjected to light irradiation in the same manner as above for 10 hours. The reaction mixture obtained was reprecipitated from one liter of methanol and the precipitates formed were collected and dried to obtain 73 g of the polymer as powder. A mixed solution of 60 g of the polymer thus obtained, 30 g of ethyl methacrylate, 10 g of methyl acrylate and 100 g of tetrahydrofuran was heated to a temperature of 50° C. under nitrogen gas stream and subjected to light irradiation in the same manner as above for 10 hours. The reaction mixture obtained was reprecipitated from 1.5 liters of methanol and the precipitates formed were collected and dried to obtain 76 g of the polymer having an Mw of $9\times10^4$.

Resin (B-203)

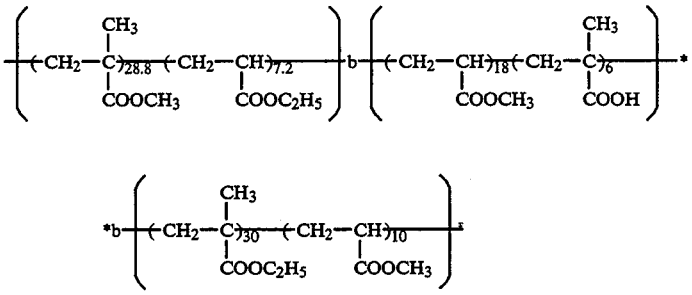

SYNTHESIS EXAMPLE 204 OF RESIN (B): Resin (B-204)

A mixed solution of 50 g of methyl methacrylate and 100 g of tetrahydrofuran was sufficiently degassed under nitrogen gas stream and cooled to −20° C. Then, 1.2 g of 1,1-diphenylpentyl lithium was added to the mixture, and the reaction was conducted for 12 hours. Separately, a mixed solution of 30 g of methyl acrylate, 3 g of triphenylmethyl methacrylate and 50 g of tetrahydrofuran was sufficiently degassed under nitrogen gas stream and the resulting mixed solution was added to the above described mixture, and then reaction was further conducted for 8 hours. Separately, a mixed solution of 50 g of methyl methacrylate and 50 g of tetrahydrofuran was sufficiently degassed under nitrogen gas stream and the resulting mixed solution was added to the above described mixture, and then reaction was further conducted for 10 hours. The temperature of the reaction mixture was adjusted to 0° C., 10 ml of methanol was added thereto, followed by reacting for 30 minutes, and the polymerization reaction was terminated. The temperature of the polymer solution obtained was adjusted to a temperature of 30° C. with stirring, 3 ml of an ethanol solution of 30% hydrogen chloride was added thereto and the mixture was stirred for one hour. Then, the solvent of the reaction mixture was distilled off under reduced pressure until the whole volume was reduced to a half, and the mixture was reprecipitated from one liter of methanol. The precipitates thus formed were collected and dried under reduced pressure to obtain 65 g of the polymer having an Mw of $8.5\times10^4$.

Resin (B-204)

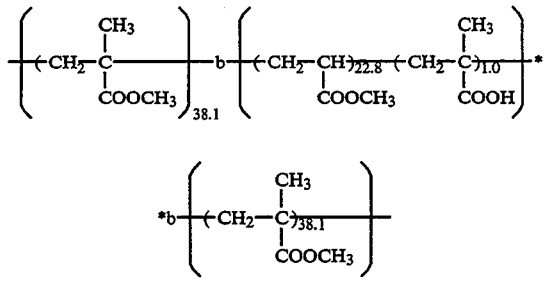

SYNTHESIS EXAMPLE 205 OF RESIN (B): Resin (B-205)

A mixed solution of 70 g of methyl methacrylate, 30 g of methyl acrylate, 0.5 g of (tetraphenyl porphinato) aluminum methyl and 200 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture were further added 40 g of ethyl acrylate and 6.4 g of benzyl methacrylate, followed by reacting for 10 hours with light irradiation in the same manner as above. Further, 70 g methyl methacrylate and 30 g of methyl acrylate were added to the mixture, followed by reacting for 12 hours with light irradiation in the same manner as above. Then, 3 g of methanol was added to the reaction mixture, followed by stirring for 30 minutes, and the reaction was terminated. Then, Pd-C was added to the reaction mixture, and a catalytic reduction reaction was conducted for one hour at a temperature of 25° C. After removing the insoluble substances from the reaction mixture by filtration, the reaction mixture was reprecipitated from 2 liters of methanol, and the precipitates thus formed were collected by filtration and dried to obtain 180 g of the polymer having an Mw of $8.5\times10^4$.

Resin (B-205)

-continued
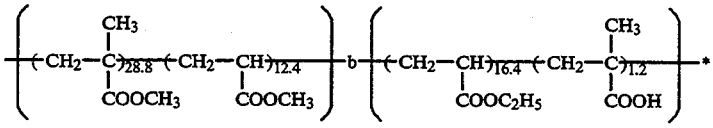
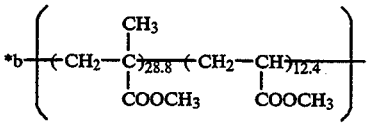
SYNTHESIS EXAMPLES 206 TO 215 OF RESIN (B): Resins (B-206) to (B-215)
Each of the resins (B) shown in Table 13 below was synthesized in the same reaction procedure as described in Synthesis Example 202 of Resin (B). The Mw of each of the polymers obtained was in a range of from $5\times10^4$ to $7\times10^4$.

TABLE 13
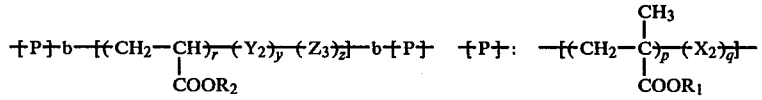
| Synthesis Example of Resin (B) | Resin (B) | $R_1$ | $-X_1-$ | $R_2$ | $-Y_2-$ | $-Z_3-$ | p/q/r/y/z (weight ratio) |
|---|---|---|---|---|---|---|---|
| 206 | B-206 | $-CH_3$ | — | $-CH_3$ | — | $-CH_2-CH(COO(CH_2)_2COOH)-$ | 32.5/0/3/0/3 |
| 207 | B-207 | $-CH_3$ | — | $-C_2H_5$ | — | 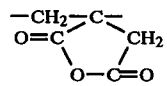 | 36/0/12.5/0/3 |
| 208 | B-208 | $-CH_3$ | $-CH_2-CH(COOCH_3)-$ | $-CH_3$ | 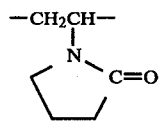 | $-CH_2-C(CH_3)(COOH)-$ | 33/5/20/3/1 |
| 209 | B-209 | $-C_2H_5$ | $-CH_2-CH(COOCH_2C_6H_5)-$ | $-CH_3$ | — | $-CH_2-CH(COO(CH_2)_3SO_3H)-$ | 37.1/5/15/0/0.8 |
| 210 | B-210 | $-C_3H_7$ | 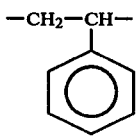 | $-CH_3$ | $-CH_2CH(COOCH_2CH_2OCH_3)-$ | $-CH_2-C(COOH)(CH_2COOH)-$ | 30.5/5/20/8/1.0 |
| 211 | B-211 | $-CH_3$ | $-CH_2-CH(COOCH_2C_6H_5)-$ | $-CH_3$ | $-CH_2CH(COCH_3)-$ | $-CH_2C(CH_3)(COO(CH_2)_2O-P(=O)(OH)-OH)-$ | 30/5/19/10/1.0 |

TABLE 13-continued
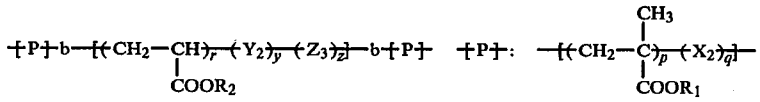
| Synthesis Example of Resin (B) | Resin (B) | $R_1$ | $-X_1-$ | $R_2$ | $-Y_2-$ | $-Z_3-$ | p/q/r/y/z (weight ratio) |
|---|---|---|---|---|---|---|---|
| 212 | B-212 | $-CH_3$ | $-CH_2-C(CH_3)(COOCH_2C_6H_5)-$ | $-C_2H_5$ | — | $-CH_2-C(CH_3)(COO(CH_2)_2OCO-C_6H_2(C(=O)-O-C(=O))-)-$ | 40.5/0/15/0/4 |
| 213 | B-213 | $-C_6H_5$ | $-CH_2-C(CH_3)(COOC_2H_5)-$ | $-CH_3$ | $-CH_2-CH(CN)-$ | $-CH_2-CH(CONH(CH_2)_4COOH)-$ | 15/10/45/3/2 |
| 214 | B-214 | $-CH_2C_6H_5$ | — | $-CH_3$ | $-CH_2-CH(OCOCH_3)-$ | $-CH_2-CH(COO(CH_2)_2OCO(CH_2)_2-COOH)-$ | 37.5/0/15/6.5/3.5 |
| 215 | B-215 | $-C_6H_5$ | $-CH_2-CH(COOC_6H_5)-$ | $-C_2H_5$ | $-CH_2-CH(N)-$ (pyrrolyl) | $-CH_2-CH(C_6H_4-COOH)-$ | 40/0/14/4/2 |

SYNTHESIS EXAMPLES 216 TO 219 OF RESIN (B): Resins (B-216) to (B-219)

Each of the polymers shown in Table 14 below was synthesized in the same procedure as described in Synthesis Example 201 of Resin (B) except for using $5\times10^{-2}$ moles of each of the initiators shown in Table 14 below in place of 13.4 g of Initiator (I-201) used in Synthesis Examples 201 of Resin (B). The Mw of each of the polymers was in a range of from $7\times10^{4}$ to $8.5\times10^{4}$.

TABLE 14

| Synthesis Examples of Resin (B) | Resin (B) | Initiator |
|---|---|---|
| 216 | B-216 | 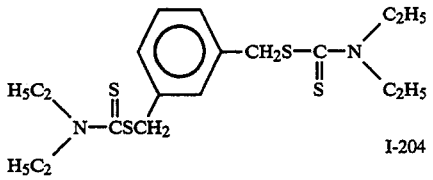 I-204 |
| 217 | B-217 | 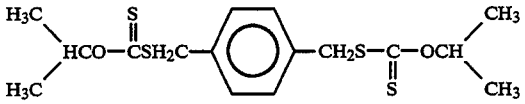 I-205 |
| 218 | B-218 | 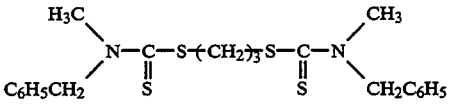 I-206 |
| 219 | B-219 | 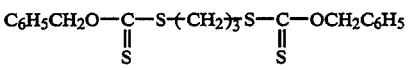 I-207 |

-continued

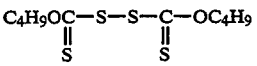

The mixture was reacted under the same condition of light irradiation as described in Synthesis Example 201 of Resin (B) for 5 hours. The polymer obtained was dissolved in 200 g of tetrahydrofuran, reprecipitated from 1.0 liter of methanol, and the precipitates formed were collected by filtration and dried.

SYNTHESIS EXAMPLES 220 TO 226 OF RESIN (B): Resins (B-220) to (B-226)

A mixed solution of 90 g of benzyl methacrylate, 10 g of acrylic acid and 7.8 g of Initiator (I-208) having the following structure was heated to a temperature of 40° C. under nitrogen gas stream.

Initiator (I-208)

A mixed solution of 20 g of the polymer thus obtained, a monomer corresponding to each of the polymer components shown in Table 15 below and 100 g of tetrahydrofuran was reacted with light irradiation in the same manner as above for 15 hours. The polymer obtained was reprecipitated from 1.5 liters of methanol and the precipitates formed were collected by filtration and dried. The yield of each polymer was in a range of from 60 to 70 g and the Mw thereof was in a range of from $4\times10^{4}$ to $7\times10^{4}$.

TABLE 15

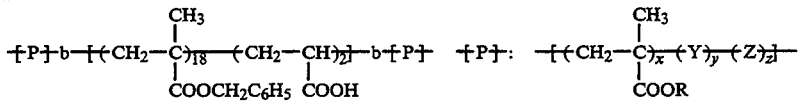

| Synthesis Example of Resin (B) | Resin (B) | —R | —Y— | —Z— | x/y/z (weight ratio) |
|---|---|---|---|---|---|
| 220 | B-220 | $-CH_3$ | — | — | 40/0/0 |
| 221 | B-221 | $-C_2H_5$ | $-CH_2-CH(CN)-$ | — | 38/2/0 |
| 222 | B-222 | $-CH_3$ | $-CH_2-CH(COOCH_3)-$ | $-CH_2-CH(CN)-$ | 27/12/1 |

TABLE 15-continued

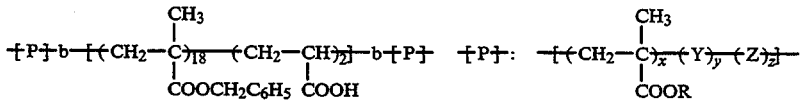

| Synthesis Example of Resin (B) | Resin (B) | —R | —Y— | —Z— | x/y/z (weight ratio) |
|---|---|---|---|---|---|
| 223 | B-223 | $-CH_3$ | $-CH_2-CH(COO(CH_2)_2OCH_3)-$ | — | 37/3/0 |
| 224 | B-224 | $-CH_2C_6H_5$ | 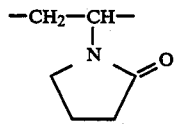 | — | 38.5/1.5/0 |
| 225 | B-225 | $-C_2H_5$ | — | — | 40/0/0 |
| 226 | B-226 | $-C_2H_5$ | 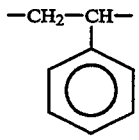 | 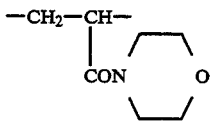 | 30/7.5/2.5 |

EXAMPLE I-1

A mixture of 6 g (solid basis) of Resin (A-8), 34 g (solid basis) of Resin (B-1), 200 g of photoconductive zinc oxide, 0.018 g of Methine Dye (I-I) having the following structure, 0.15 g of phthalic anhydride and 300 g of toluene was dispersed by a homogenizer (manufactured by Nippon Seiki K.K.) at $6\times10^3$ r.p.m. for 7 minutes to prepare a coating composition for a light-sensitive layer. The coating composition was coated on paper, which had been subjected to electrically conductive treatment, by a wire bar at a dry coverage of 25 g/m$^2$, followed by drying at 110° C. for 10 seconds. The coated material was then allowed to stand in a dark place at 20° C. and 65% RH (relative humidity) for 24 hours to prepare an electrophotographic light-sensitive material.

Methine Dye (I-I)

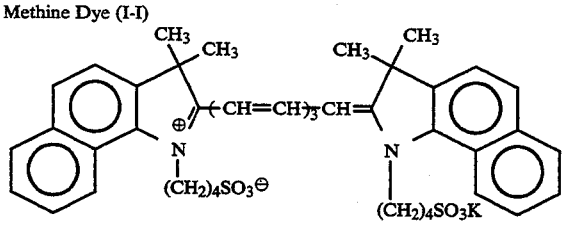

COMPARATIVE EXAMPLE I-1

An electrophotographic light-sensitive material was prepared in the same manner as in Example I-1, except for using 6 g of Resin (R-I-1) having the following structure and 34 g of Resin (R-I-2) having the following structure in place of 6 g of Resin (A-8) and 34 g of Resin (B-1) used in Example I-1, respectively.

Comparison Resin (R-I-1)

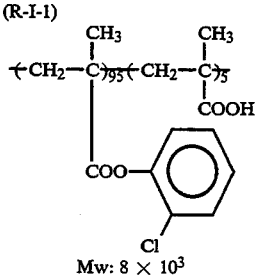

Mw: $8\times10^3$

Comparative Resin (R-I-2)

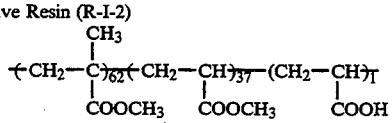

Mw: $7\times10^4$ (random copolymer)

COMPARATIVE EXAMPLE I-2

An electrophotographic light-sensitive material was prepared in the same manner as in Example I-1, except for using 6 g of Resin (R-I-3) having the following structure and 34 g of Resin (R-I-4) having the following structure in place of 6 g of Resin (A-8) and 34 g of Resin (B-1) used in Example I-1, respectively.

Comparison Resin (R-I-3)

-continued

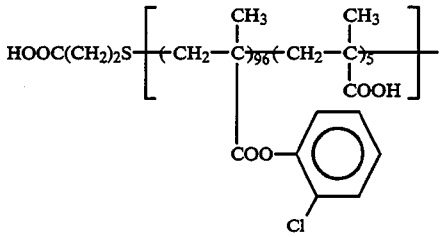

Mw: $8.5 \times 10^3$

Comparative Resin (R-I-4)

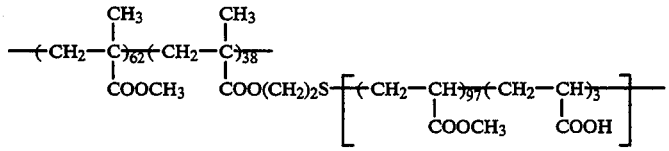

Mw: $7.5 \times 10^4$ (graft copolymer)

With each of the light-sensitive material thus prepared, film property, image forming performance and printing property were evaluated. The results obtained are shown in Table I-1 below.

TABLE I-1

| | Example I-1 | Comparative Example I-1 | Comparative Example I-2 |
|---|---|---|---|
| Smoothness of*1 Photoconductive Layer (sec/cc) | 300 | 285 | 290 |
| Image Forming*2 Performance | | | |
| I (20° C., 65% RH) | Very good | Good | Good |
| II (30° C., 80% RH) | Good | Unevenness in half tone area, slight background fog | Unevenness in half tone area, slight background fog |
| III (15° C., 30% RH) | Good | White spots in image portion | White spots in image portion |
| Water Retentivity of*3 Light-Sensitive Material | Good | Good | Very slight background stain |
| Printing Durability*4 | 8,000 Prints | Cut in image portion from the start of printing | Cut in image portion from the start of printing |

The evaluation of each item shown in Table I-1 was conducted in the following manner.

*1) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*2) Image Forming Performance

After the light-sensitive material was allowed to stand for one day under the ambient condition shown below, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of isoparaffinic solvent Isopar G (manufactured by Esso Chemical K.K.) and fixed. The duplicated image obtained was visually evaluated for fog and image quality.

The ambient condition at the time of image formation was 20° C. and 65% RH (Condition I), 30° C. and 80% RH (Condition II) or 15° C. and 30% RH (Condition III).

*3) Water Retentivity of Light-Sensitive Material

A degree of hydrophilicity of the light-sensitive material after being subjected to an oil-desensitizing treatment for use as a printing plate was evaluated by processing under the following forced condition. Specifically, the light-sensitive material without subjecting to plate making was passed once through an etching machine using an aqueous solution obtained by diluting an oil-desensitizing solution ELP-EX (produced by Fuji Photo Film Co., Ltd.) to a five-fold volume with distilled water. The material thus-treated was mounted on a printing machine ("Hamada Star Type 8005X" manufactured by Hamada Star K.K.) and printing was conducted. The extent of background stain occurred on the 50th print was visually evaluated.

*4) Printing Durability

The light-sensitive material was subjected to plate making in the same manner as described in *2) above, passed once through an etching machine with ELPEX. Printing was conducted using the plate thus-obtained and a number of prints on which background stain was first visually observed was determined.

As can be seen from the results shown in Table I-1 above, the light-sensitive material according to the present invention provided duplicated images having very clear highly accurate image portions such as fine lines, fine letters and dots of continuous gradation and no background stain. Further, it provided stably clear duplicated images even under the severe ambient condition such as a low temperature and low humidity condition or a high temperature and high humidity condition at the time of image formation.

On the contrary, although the light-sensitive materials of Comparative Examples I-1 and I-2 provided good duplicated images under the ambient condition of normal temperature and normal humidity (Condition I), the occurrence of unevenness of density was observed in the highly accurate image portions, in particular, half tone areas of continuous gradation upon the fluctuation of ambient condition at the time of image formation.

Then, in order to evaluate performance of each of the light-sensitive material as an off-set master plate, it was subjected to an oil-desensitizing treatment to prepare a printing plate.

When each of the light-sensitive materials was subjected to the oil-desensitizing treatment under the forced condition of using a solution of a reduced oil-desensitizing power, followed by practical printing, and the extent of adhesion of ink on prints was evaluated as described in *3), the adhesion of ink was observed in cases of using the light-sensitive materials of Comparative Examples I-1 and I-2, although no adhesion of ink occurred for the light-sensitive material according to the present invention.

As a result of conducting plate making, oil-desensitizing treatment under an usual condition and printing as described in *4), the light-sensitive material according to the present invention provided 8,000 prints of faithfully duplicated images without the occurrence of background stain. On the contrary, with the light-sensitive materials of Comparative Examples I-1 and I-2, only 3,000 prints and 5,000 prints could be obtained, respectively. Further, when the plate making was conducted under the severe condition of Condition II or Condition III, poor images on prints were obtained from the start of printing due to poor reproducibility of duplicated images.

From these results it is believed that the resin (A) and the resin (B) according to the present invention suitably interact with zinc oxide particles to form the condition under which the adsorption of spectral sensitizing dye and chemical sensitizer onto the surface of zinc oxide particles is not disturbed whereby the excellent electrophotographic charactenstics are achieved and to form the condition under which an oil-desensitizing reaction proceeds easily and sufficiently with an oil-desensitizing solution and that the remarkable improvement in film strength is achieved by the action of the resin (B).

EXAMPLE I-2

A mixture of 7 g (solid basis) of Resin (A-12), 33 g (solid basis) of Resin (B-2), 200 g of photoconductive zinc oxide, 0.020 g of Methine Dye (I-II) having the following structure, 0.20 g of N-hydroxymalinimide and 300 g of toluene was treated in the same manner as described in Example I-1 to prepare an electrophotographic light-sensitive material.

Methine Dye (I-II)

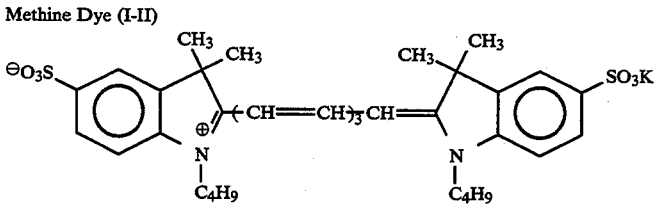

With the light-sensitive material thus-prepared, a film property in terms of surface smoothness, electrostatic characteristics, and image forming performance were evaluated. Further, printing property was evaluated when it was used as an electrophotographic lithographic printing plate precursor. The results obtained are shown in Table I-2 below.

TABLE I-2

| | | | Example I-2 |
|---|---|---|---|
| Smoothness of Photoconductive Layer (sec/cc) | | | 300 |
| Electrostatic Characteristics*5) | | | |
| $V_{10}$ (−V) | I | (20° C., 65% RH) | 830 |
| | II | (30° C., 80% RH) | 810 |
| | III | (15° C., 30% RH) | 825 |
| D.R.R. (%) | I | (20° C., 65% RH) | 92 |
| | II | (30° C., 80% RH) | 88 |
| | III | (15° C., 30% RH) | 91 |
| $E_{1/10}$ (erg/cm$^2$) | I | (20° C., 65% RH) | 28 |
| | II | (30° C., 80% RH) | 25 |
| | III | (15° C., 30% RH) | 31 |
| $E_{1/100}$ (erg/cm$^2$) | I | (20° C., 65% RH) | 38 |
| | II | (30° C., 80% RH) | 40 |
| | III | (15° C., 30% RH) | 53 |
| Image Forming Performance | I | (20° C., 65% RH) | Very good |
| | II | (30° C., 80% RH) | Good |
| | III | (15° C., 30% RH) | Good |
| Water Retentivity of Light-Sensitive | | | Good |
| Printing Durability | | | 8,000 Prints |

As can be seen from the results shown above, the light-sensitive material according to the present invention had good surface smoothness which indicated a uniform dispersion state of zinc oxide. The electrostatic characteristics were stable and good even when the ambient condition was fluctuated. With the images forming performance, duplicated images faithful to the original were obtained without the formation of background fog. Further, when it was used as an offset master plate precursor and subjected to the oil-desensitizing treatment and printing, 8,000 prints of good quality were obtained.

EXAMPLES I-3 TO 1-22

Each electrophotographic light-sensitive material was prepared in the same manner as described in Example I-2, except for using each of Resins (A) and Resins (B) shown in Table I-3 below in place of Resin (A-12) and Resin (B-2) used in Example I-2.

TABLE I-3

| Example | Resin (A) | Resin (B) |
|---|---|---|
| I-3 | A-1 | B-3 |
| I-4 | A-3 | B-4 |
| I-5 | A-4 | B-1 |
| I-6 | A-7 | B-5 |
| I-7 | A-11 | B-6 |
| I-8 | A-12 | B-7 |
| I-9 | A-16 | B-8 |
| I-10 | A-18 | B-9 |
| I-11 | A-19 | B-11 |
| I-12 | A-20 | B-12 |
| I-13 | A-21 | B-13 |
| I-14 | A-23 | B-15 |
| I-15 | A-24 | B-16 |
| I-16 | A-26 | B-20 |
| I-17 | A-27 | B-21 |
| I-18 | A-28 | B-23 |
| I-19 | A-29 | B-22 |
| I-20 | A-30 | B-19 |
| I-21 | A-15 | B-14 |

TABLE I-3-continued

| Example | Resin (A) | Resin (B) |
|---|---|---|
| I-22 | A-10 | B-17 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example I-2, more than 8,000 good prints were obtained respectively.

It can be seen from the results described above that each of the light-sensitive materials according to the present invention was satisfactory in all aspects of the surface smoothness and film strength of the photoconductive layer, electrostatic characteristics, and printing property. Also, it can be seen that the electrostatic characteristics are further improved by the use of the resin (A').

EXAMPLES 1-23 TO 1-26

Each electrophotographic light-sensitive material was prepared in the same manner as described in Example I-1, except for using each of the dyes shown in Table I-4 below in place of Methine Dye (I-I) used in Example I-1.

TABLE I-4

| Example | Dye | Chemical Structure of Dye |
|---|---|---|
| I-23 | (I-III) | 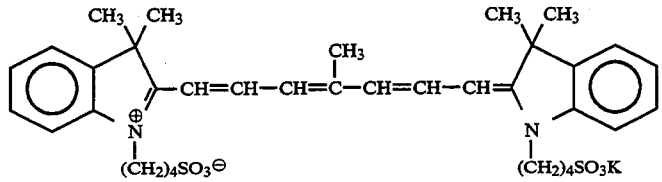 |
| I-24 | (I-IV) | 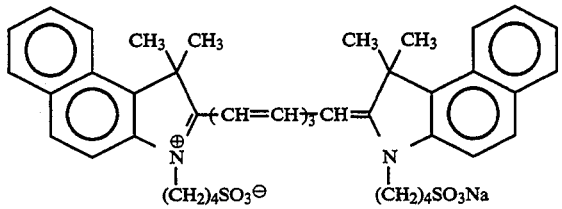 |
| I-25 | (I-V) | 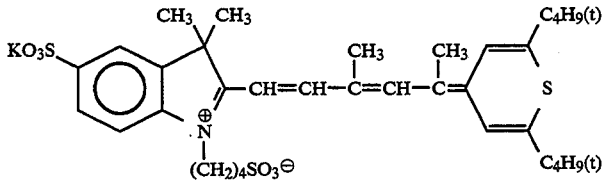 |
| I-26 | (I-VI) | 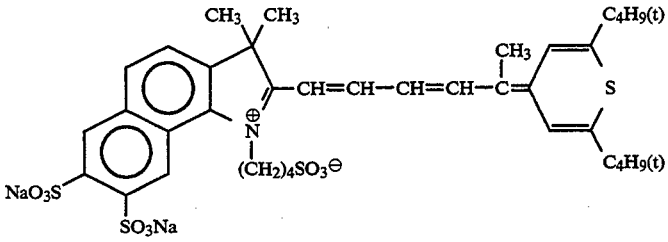 |

Each of the light-sensitive materials according to the present invention was excellent in charging properties, dark charge retention rate, and photosensitivity, and provided clear duplicated images free from background fog even when processed under severe conditions of high temperature and high humidity (30° C. and 80% RH) and low temperature and low humidity (15° C. and 30% RH).

EXAMPLES 1-27 AND 1-28

A mixture of 7 g of Resin (A-1) and 33 g of Resin (B-20) (Example 1-27) or 7 g of Resin (A-26) and 33 g of Resin (B-16) (Example 1-28), 200 g of photoconductive zinc oxide, 0.02 g of uranine, 0.03 g of Methine Dye (I-VII) having the following structure, 0.03 g of Methine Dye (I-VIII) having the following structure, 0.18 g of p-hydroxybenzoic acid and 300 g of toluene was dispersed by a homogenizer at $7\times10^3$ r.p.m. for 6 minutes to prepare a coating composition for a light-sensitive layer. The coating composition was coated on paper, which had been subjected to electrically conductive treatment, by a wire bar at a dry coverage of 20 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (I-VII)

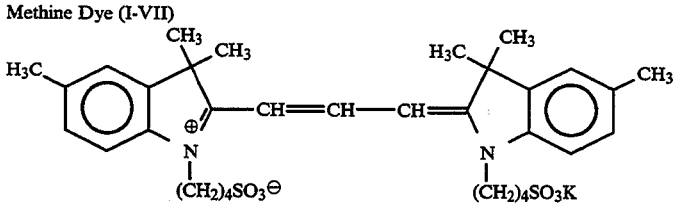

Methine Dye (I-VIII)

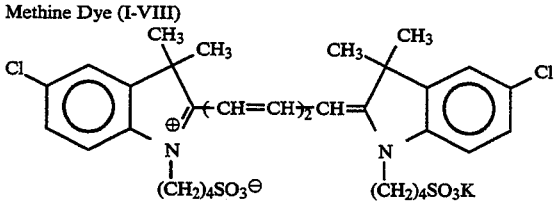

COMPARATIVE EXAMPLE I-3

An electrophotographic light-sensitive material was prepared in the same manner as in Example 1-27, except for using 6 g of Resin (R-I-1) described above and 34 g of Resin (R-I-5) having the following structure in place of Resin (A-1) and Resin (B-20) used in Example I-27, respectively.

Comparison Resin (R-I-5)

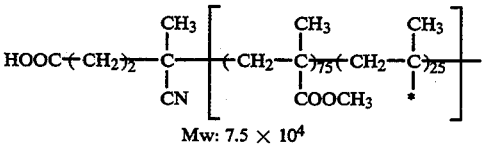

Mw: $7.5 \times 10^4$

With each of the light-sensitive materials thus prepared, various characteristics were evaluated in the same manner as in Example I-2. The results obtained are shown in Table I-5 below.

TABLE I-5

| | | | Example I-27 | Example I-28 | Comparative Example I-3 |
|---|---|---|---|---|---|
| Binder Resin | | | (A-1)/(B-20) | (A-26)/(B-16) | (R-I-1)/(R-I-5) |
| Smoothness of Photoconductive Layer (sec/cc) | | | 270 | 250 | 250 |
| Electrostatic Characteristics*6) | | | | | |
| $V_{10}$ (−V) | I | (20° C., 65% RH) | 630 | 820 | 595 |
| | II | (30° C., 80% RH) | 610 | 805 | 580 |
| | III | (15° C., 30% RH) | 640 | 815 | 600 |
| D.R.R. (%) | I | (20° C., 65% RH) | 90 | 95 | 86 |
| | II | (30° C., 80% RH) | 87 | 90 | 81 |
| | III | (15° C., 30% RH) | 91 | 94 | 85 |
| $E_{1/10}$ (lux · sec) | I | (20° C., 65% RH) | 11.8 | 8.7 | 14.2 |
| | II | (30° C., 80% RH) | 10.6 | 8.5 | 13.3 |
| | III | (15° C., 30% RH) | 12.5 | 9.6 | 16.2 |
| $E_{1/100}$ (lux · sec) | I | (20° C., 65% RH) | 19 | 12 | 24 |
| | II | (30° C., 80% RH) | 22 | 15 | 28 |
| | III | (15° C., 30% RH) | 28 | 19 | 34 |
| Image-Forming*7) Performance | I | (20° C., 65% RH) | Good | Very good | Good |
| | II | (30° C., 80% RH) | Good | Very good | Edge mark of cutting, Unevenness in half tone area |
| | III | (15° C., 30% RH) | Good | Very good | Unevenness of white spots in image portion |
| Water Retentivity of Light-Sensitive Material | | | Good | Very good | Good |
| Printing Durability | | | 8,000 Prints | 8,000 Prints | 5,000 Prints |

The characteristics were evaluated in the same manner as in Example I-2, except that some electrostatic characteristics and image forming performance were evaluated according to the following test methods.

*6) Electrostatic Characteristics: $E_{1/10}$ and $E_{1/100}$

The surface of the photoconductive layer was charged to −400 V with corona discharge, and then irradiated by visible light of the illuminance of 2.0 lux on the surface of the photoconductive layer. Then, the time required for decay of the surface potential ($V_{10}$) to 1/10 or 1/100 thereof was determined, and the exposure amount $E_{1/10}$ or $E_{1/100}$ (lux.sec) was calculated therefrom.

*7) Image Forming Performance:

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (Condition I), 30° C. and 80% RH (Condition II) or 15° C. and 30% RH (Condition III). The original used for the duplication was composed of cuttings of other originals pasted up thereon.

From the results shown above, it can be seen that each light-sensitive material exhibits good properties with respect to the surface smoothness of the photoconductive layer and electrostatic characteristics.

With respect to image-forming performance, the edge mark of cuttings pasted up was observed as background fog in the non-image areas or the occurrence of unevenness of white spots in the image portion was observed in the light-sensitive material of Comparative Example I-3 under the severe conditions. On the contrary, the light-sensitive materials according to the present invention provided clear duplicated images free from background fog.

Further, each of these light-sensitive materials was subjected to the oil-desensitizing treatment to prepare an offset printing plate and printing was conducted. The light-sensitive materials according to the present invention provided more than 8,000 prints of clear image without background stains. However, with the plate of Comparative Example I-3 subjected to plate making under the severe conditions, the above described edge mark of cuttings pasted up was not removed with the oil-desensitizing treatment and the background stains occurred from the start of printing, or the unevenness of duplicated image occurred on prints.

As can be seen from the above results, only the light-sensitive materials according to the present invention could provide the excellent performance.

EXAMPLE 1-29

A mixture of 6 g of Resin (A-13), 34 g of Resin (B-5), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in I-27 to prepare an electrophotographic light-sensitive material.

As the result of the evaluation on various characteristics in the same manner as described in Example I-27, it can be seen that the light-sensitive material according to the present invention is excellent in charging properties, dark charge retention rate, and photosensitivity, and provides a clear duplicated image free from background fog and unevenness of image portion under severe conditions of high temperature and high humidity (30° C. and 80% RH) and low temperature and low humidity (15° C. and 30% RH). Further, when the material, was employed as an offset master plate precursor, 8,000 prints of clear image quality were obtained.

EXAMPLES I-30 TO I-45

Each electrophotographic light-sensitive material was prepared in the same manner as described in Example I-29, except for using 6 g of each of Resin (A) and 34 g of each of Resin (B) shown in Table I-6 below in place of 6 g of Resin (A-13) and 34 g of Resin (B-5) used in Example I-29, respectively.

TABLE I-6

| Example | Resin (A) | Resin (B) |
|---|---|---|
| I-30 | A-2 | B-20 |
| I-31 | A-3 | B-23 |
| I-32 | A-5 | B-18 |
| I-33 | A-7 | B-10 |
| I-34 | A-9 | B-2 |
| I-35 | A-10 | B-12 |
| I-36 | A-15 | B-22 |
| I-37 | A-17 | B-16 |

TABLE I-6-continued

| Example | Resin (A) | Resin (B) |
|---|---|---|
| I-38 | A-22 | B-13 |
| I-39 | A-26 | B-21 |
| I-40 | A-27 | B-17 |
| I-41 | A-28 | B-5 |
| I-42 | A-2 | B-101 |
| I-43 | A-4 | B-102 |
| I-44 | A-16 | B-114 |
| I-45 | A-28 | B-128 |

Each of the light-sensitive materials according to the present invention was excellent in charging properties, dark charge retention rate, and photosensitivity, and provided a clear duplicated image free from background fog, unevenness of image portion and scratches of fine lines even under severe conditions of high temperature and high humidity (30° C. and 80% RH) and low temperature and low humidity (15° C. and 30% RH). Further, when these materials were employed as offset master plate precursors, more than 8,000 prints of a clear image free from background stains were obtained respectively.

EXAMPLE II-1

A mixture of 6 g (solid basis) of Resin (A-102), 34 g (solid basis) of Resin (B-1), 200 g of photoconductive zinc oxide, 0.018 g of Methine Dye (II-I) having the following structure, 0.15 g of phthalic anhydride and 300 g of toluene was dispersed by a homogenizer (manufactured by Nippon Seiki K.K.) at $7\times10^3$ r.p.m. for 8 minutes to prepare a coating composition for a light-sensitive layer. The coating composition was coated on paper, which had been subjected to electrically conductive treatment, by a wire bar at a dry coverage of 25 g/m$^2$, followed by drying at 110° C. for 10 seconds. The coated material was then allowed to stand in a dark place at 20° C. and 65% RH (relative humidity) for 24 hours to prepare an electrophotographic light-sensitive material.

Methine Dye (II-I)

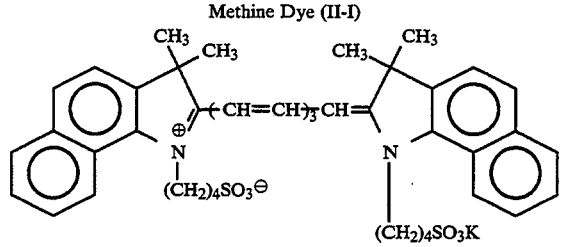

COMPARATIVE EXAMPLE II-1

An electrophotographic light-sensitive material was prepared in the same manner as in Example II-1, except for using 6 g of Resin (R-II-1) having the following structure and 34 g of Resin (R-II-2) having the following structure in place of 6 g of Resin (A-102) and 34 g of Resin (B-1) used in Example II-1, respectively.

Comparative Resin (R-II-1)

-continued

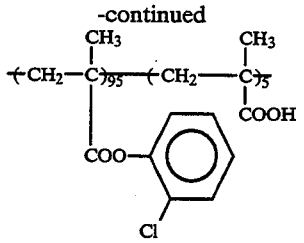

Mw: $8 \times 10^3$

Comparative Resin (R-II-2)

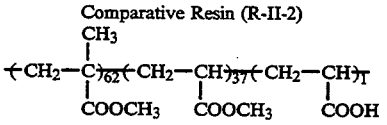

Mw: $7 \times 10^4$ (random copolymer)

COMPARATIVE EXAMPLE II-2

An electrophotographic light-sensitive material was prepared in the same manner as in Example II-1, except for using 6 g of Resin (R-II-3) having the following structure and 34 g of Resin (R-II-4) having the following structure in place of 6 g of Resin (A-102) and 34 g of Resin (B-1) used in Example II-1, respectively.

Comparative Resin (R-II-3)

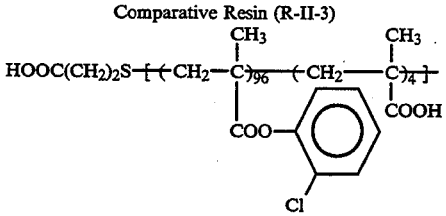

Mw: $8.5 \times 10^3$

Comparative Resin (R-II-4)

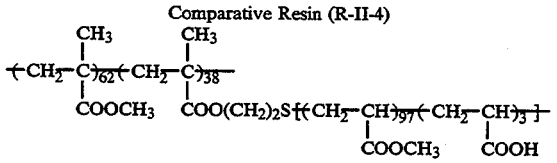

Mw: $7.5 \times 10^4$ (graft copolymer)

With each of the light-sensitive material thus prepared, film property, image forming performance and printing property were evaluated. The results obtained are shown in Table II-1 below.

TABLE II-1

| | Example II-1 | Comparative Example II-1 | Comparative Example II-2 |
|---|---|---|---|
| Smoothness of*1 Photoconductive Layer (sec/cc) | 280 | 290 | 280 |
| Image Forming*2 Performance | | | |
| I (20° C., 65% RH) | Very good | Good | Good |
| II (30° C., 80% RH) | Good | Unevenness in half tone area, slight background fog | Unevenness in half tone area, slight background fog |
| III (15° C., 30% RH) | Good | White spots in image portion | White spots in image portion |
| Water Retentivity of*3 Light-Sensitive Material | Good | Good | Very slight background stain |
| Printing Durability*4 | 8,000 Prints | Cut in image portion from the start of printing | Cut in image portion from the start of printing |

The evaluation of each item shown in Table II-1 was conducted in the following manner.

*1) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*2) Image Forming Performance

After the light-sensitive material was allowed to stand for one day under the ambient condition shown below, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of isoparaffinic solvent Isopar G (manufactured by Esso Chemical K.K.) and fixed. The duplicated image obtained was visually evaluated for fog and image quality.

The ambient condition at the time of image formation was 20° C. and 65% RH (Condition I), 30° C. and 80% RH (Condition II) or 15° C. and 30% RH (Condition III).

*3) Water Retentivity of Light-Sensitive Material

A degree of hydrophilicity of the light-sensitive material after being subjected to an oil-desensitizing treatment for use as a printing plate was evaluated by processing under the following forced condition. Specifically, the light-sensitive material without subjecting to plate making was passed once through an etching machine using an aqueous solution obtained by diluting an oil-desensitizing solution ELP-EX (produced by Fuji Photo Film Co., Ltd.) to a five-fold volume with distilled water. The material thus-treated was mounted on a printing machine ("Hamada Star Type 8005X" manufactured by Hamada Star K.K.) and printing was conducted. The extent of background stain occurred on the 50th print was visually evaluated.

*4) Printing Durability

The light-sensitive material was subjected to plate making in the same manner as described in *2) above, passed once through an etching machine with ELPEX. Printing was conducted using the plate thus-obtained and a number of prints on which background stain was first visually observed was determined.

As can be seen from the results shown in Table II-1 above, the light-sensitive material according to the present invention provided duplicated images having very clear highly accurate image portions such as fine lines, fine letters and dots of continuous gradation and no background stain. Further, it provided stably clear duplicated images even under the severe ambient condition such as a low temperature and low humidity condition or a high temperature and high humidity condition at the time of image formation.

On the contrary, although the light-sensitive materials of Comparative Examples II-1 and II-2 provided good duplicated images under the ambient condition of normal temperature and normal humidity (Condition I), the occurrence of unevenness of density was observed in the highly accurate image portions, in particular, half tone areas of continuous gradation upon the fluctuation of ambient condition at the time of image formation.

Then, in order to evaluate performance of each of the light-sensitive material as an off-set master plate, it was subjected to an oil-desensitizing treatment to prepare a printing plate.

When each of the light-sensitive materials was subjected to the oil-desensitizing treatment under the forced condition of using a solution of a reduced oil-desensitizing power, followed by practical printing, and the extent of adhesion of ink on prints was evaluated as described in *3), the adhesion of ink was observed in cases of using the light-sensitive materials of Comparative Examples II-1 and II-2, although no adhesion of ink occurred for the light-sensitive material according to the present invention.

As a result of conducting plate making, oil-desensitizing treatment under an usual condition and printing as described in *4), the light-sensitive material according to the present invention provided 8,000 prints of faithfully duplicated images without the occurrence of background stain. On the contrary, with the light-sensitive materials of Comparative Examples II-1 and II-2, only 3,000 prints and 5,000 prints could be obtained, respectively. Further, when the plate making was conducted under the severe condition of Condition II or Condition III, poor images on prints were obtained from the start of printing due to poor reproducibility of duplicated images.

From these results it is believed that the resin (A) and the resin (B) according to the present invention suitably interact with zinc oxide particles to form the condition under which the adsorption of spectral sensitizing dye and chemical sensitizer onto the surface of zinc oxide particles is not disturbed whereby the excellent electrophotographic charactenstics are achieved and to form the condition under which an oil-desensitizing reaction proceeds easily and sufficiently with an oil-desensitizing solution and that the remarkable improvement in film strength is achieved by the action of the resin (B).

EXAMPLE II-2

A mixture of 5 g (solid basis) of Resin (A-115), 35 g (solid basis) of Resin (B-2), 200 g of photoconductive zinc oxide, 0.020 g of Methine Dye (II-II) having the following structure, 0.20 g of N-hydroxymalinimide and 300 g of toluene was treated in the same manner as described in Example II-1 to prepare an electrophotographic light-sensitive material.

Methine Dye (II-II)

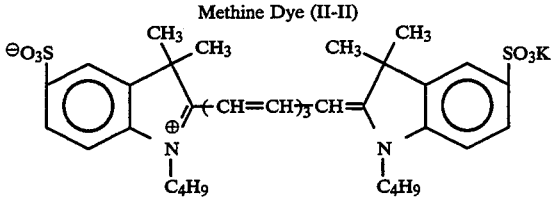

With the light-sensitive material thus-prepared, a film property in terms of surface smoothness, electrostatic characteristics, and image forming performance were evaluated. Further, printing property was evaluated when it was used as an electrophotographic lithographic printing plate precursor. The results obtained are shown in Table II-2 below.

TABLE II-2

| | | | Example II-2 |
|---|---|---|---|
| Smoothness of Photoconductive Layer (sec/cc) | | | 400 |
| Electrostatic Characteristics*5) | | | |
| $V_{10}$ (−V) | I | (20° C., 65% RH) | 740 |
| | II | (30° C., 80% RH) | 720 |
| | III | (15° C., 30% RH) | 745 |
| D.R.R. (%) | I | (20° C., 65% RH) | 88 |
| | II | (30° C., 80% RH) | 84 |
| | III | (15° C., 30% RH) | 87 |
| $E_{1/10}$ (erg/cm$^2$) | I | (20° C., 65% RH) | 15 |
| | II | (30° C., 80% RH) | 18 |
| | III | (15° C., 30% RH) | 25 |
| $E_{1/100}$ (erg/cm$^2$) | I | (20° C., 65% RH) | 25 |
| | II | (30° C., 80% RH) | 30 |
| | III | (15° C., 30% RH) | 45 |
| Image Forming Performance | I | (20° C., 65% RH) | Very good |
| | II | (30° C., 80% RH) | Good |
| | III | (15° C., 30% RH) | Good |
| Water Retentivity of Light-Sensitive Material | | | Good |
| Printing Durability | | | 10,000 Prints |

The evaluation of the electrostatic characteristics shown in Table II-2 was conducted in the following manner.

*5) Electrostatic Characteristics

The light-sensitive material was charged with a corona discharge to a voltage of −6 kV for 20 seconds in a dark room using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 120 seconds, and the potential $V_{130}$ was measured. The dark charge retention rate (DRR; %) i.e., percent retention of potential after dark decay for 120 seconds, was calculated from the following equation:

$$DRR(\%)=(V_{130}/V_{10})\times 100$$

Separately, the surface of photoconductive layer was charged to −500 V with a corona discharge and then exposed to monochromatic light having a wavelength of 780 nm, and the time required for decay of the surface potential $V_{10}$ to one-tenth was measured, and the exposure amount $E_{1/10}$ (erg/cm$^2$) was calculated therefrom. Further, the light-sensitive material was charged to −500 V with a corona discharge in the same manner as described for the measurement of $E_{1/10}$, then exposed to monochromatic light having a wavelength of 780 nm, and the time required for decay of the surface potential $V_{10}$ to one-hundredth was measured, and the exposure amount $E_{1/100}$ (erg/cm$^2$) was calculated therefrom. The measurements were conducted under ambient condition of 20° C. and 65% RH (Condition I), 30° C. and 80% RH (Condition II) or 15° C. and 30% RH (Condition III).

As can be seen from the results shown above, the light-sensitive material according to the present invention had good surface smoothness which indicated a uniform dispersion state of zinc oxide. The electrostatic characteristics were stable and good even when the ambient condition was fluctuated. With the images forming performance, duplicated images faithful to the original were obtained without the formation of background fog. Further, when it was used as an offset master plate precursor and subjected to the oil-desensitizing treatment and printing, 10,000 prints of good quality were obtained.

EXAMPLES II-3 TO II-22

Each electrophotographic light-sensitive material was prepared in the same manner as described in Example II-2, except for using each of Resins (A) and Resins (B) shown in Table II-3 below in place of Resin (A-115) and Resin (B-2) used in Example II-2.

TABLE II-3

| Example | Resin (A) | Resin (B) |
|---|---|---|
| II-3 | A-101 | B-3 |
| II-4 | A-103 | B-4 |
| II-5 | A-105 | B-1 |
| II-6 | A-106 | B-5 |
| II-7 | A-111 | B-6 |
| II-8 | A-121 | B-7 |
| II-9 | A-116 | B-8 |
| II-10 | A-118 | B-9 |
| II-11 | A-119 | B-11 |
| II-12 | A-120 | B-12 |
| II-13 | A-121 | B-13 |
| II-14 | A-122 | B-15 |
| II-15 | A-125 | B-16 |
| II-16 | A-129 | B-20 |
| II-17 | A-130 | B-21 |
| II-18 | A-131 | B-23 |
| II-19 | A-110 | B-22 |
| II-20 | A-113 | B-19 |
| II-21 | A-115 | B-14 |

TABLE II-3-continued

| Example | Resin (A) | Resin (B) |
|---|---|---|
| II-22 | A-117 | B-17 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example II-2, more than 8,000 good prints were obtained respectively.

It can be seen from the results described above that each of the light-sensitive materials according to the present invention was satisfactory in all aspects of the surface smoothness and film strength of the photoconductive layer, electrostatic characteristics, and printing property. Also, it can be seen that the electrostatic characteristics are further improved by the use of the resin (A').

EXAMPLES II-23 TO II-26

Each electrophotographic light-sensitive material was prepared in the same manner as described in Example II-1, except for using each of the dyes shown in Table II-4 below in place of Methine Dye (II-I) used in Example II-1.

TABLE II-4

| Example | Dye | Chemical Structure of Dye |
|---|---|---|
| II-23 | (II-III) | 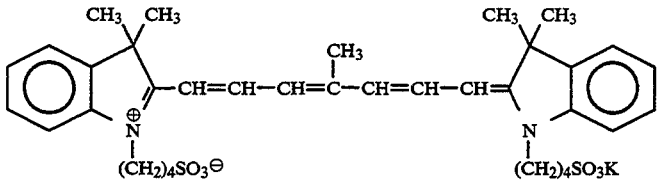 |
| II-24 | (II-IV) | 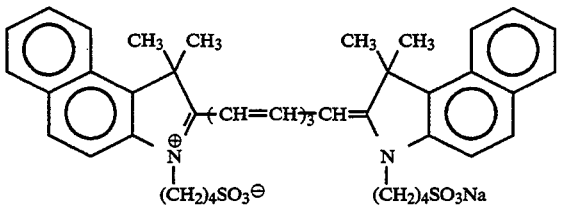 |
| II-25 | (II-V) | 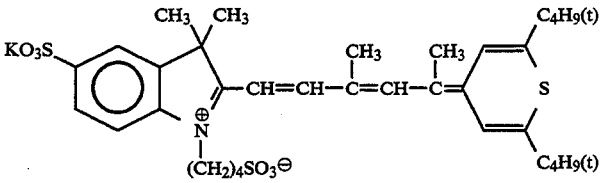 |

TABLE II-4-continued

| Example | Dye | Chemical Structure of Dye |
|---|---|---|
| II-26 | (I-VI) | 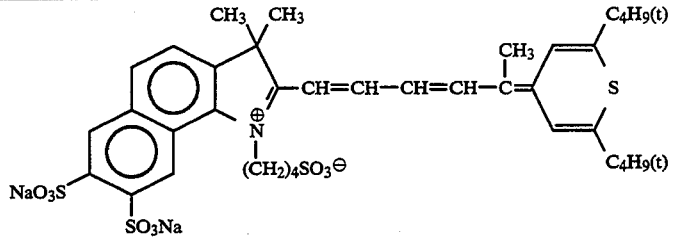 |

Each of the light-sensitive materials according to the present invention was excellent in charging properties, dark charge retention rate, and photosensitivity, and provided clear duplicated images free from background fog even when processed under severe conditions of high temperature and high humidity (30° C. and 80% RH) and low temperature and low humidity (15° C. and 30% RH).

EXAMPLES II-27 AND II-28

A mixture of 6 g of Resin (A-101) and 34 g of Resin (B-20) (Example II-27) or 6 g of Resin (A-121) and 34 g of Resin (B-16) (Example II-28), 200 g of photoconductive zinc oxide, 0.02 g of uranine, 0.03 g of Methine Dye (II-VII) having the following structure, 0.03 g of Methine Dye (II-VIII) having the following structure, 0.18 g of p-hydroxybenzoic acid and 300 g of toluene was dispersed by a homogenizer at $7\times10^3$ r.p.m. for 10 minutes to prepare a coating composition for a light-sensitive layer. The coating composition was coated on paper, which had been subjected to electrically conductive treatment, by a wire bar at a dry coverage of 20 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (II-VII)

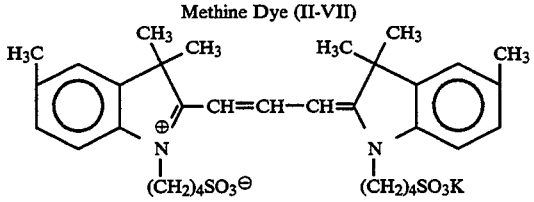

-continued

Methine Dye (II-VIII)

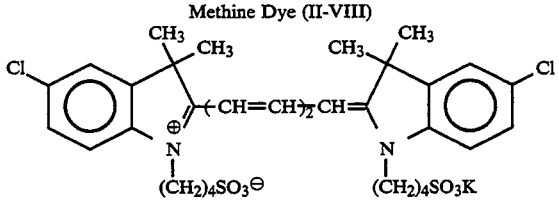

COMPARATIVE EXAMPLE II-3

An electrophotographic light-sensitive material was prepared in the same manner as in Example II-27, except for using 6 g of Resin (R-II-1) described above and 34 g of Resin (R-II-5) having the following structure in place of Resin (A-101) and Resin (B-20) used in Example II-27, respectively.

Comparative Resin (R-II-5)

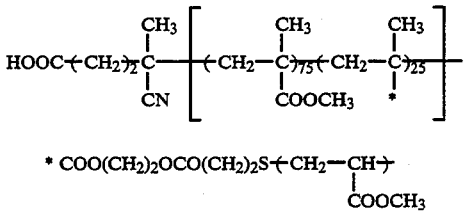

Mw: $7.5\times10^4$

With each of the light-sensitive materials thus prepared, various characteristics were evaluated in the same manner as in Example II-2. The results obtained are shown in Table II-5 below.

TABLE II-5

| | | | Example II-27 | Example II-28 | Comparative Example II-3 |
|---|---|---|---|---|---|
| Binder Resin | | | (A-101)/(B-20) | (A-121)/(B-16) | (R-II-1)/(R-II-5) |
| Smoothness of Photoconductive Layer (sec/cc) | | | 400 | 405 | 400 |
| Electrostatic Characteristics*6) | | | | | |
| $V_{10}$ (−V) | I | (20° C., 65% RH) | 650 | 760 | 630 |
| | II | (30° C., 80% RH) | 630 | 745 | 605 |
| | III | (15° C., 30% RH) | 655 | 765 | 640 |
| D.R.R. (%) | I | (20° C., 65% RH) | 93 | 95 | 88 |
| | II | (30° C., 80% RH) | 90 | 90 | 82 |
| | III | (15° C., 30% RH) | 94 | 95 | 87 |
| $E_{1/10}$ (lux · sec) | I | (20° C., 65% RH) | 10.2 | 9.5 | 13.4 |
| | II | (30° C., 80% RH) | 9.8 | 9.0 | 12.7 |
| | III | (15° C., 30% RH) | 11.3 | 10.3 | 15.6 |
| $E_{1/100}$ (lux · sec) | I | (20° C., 65% RH) | 17 | 13 | 21 |
| | II | (30° C., 80% RH) | 15 | 14 | 20 |
| | III | (15° C., 30% RH) | 24 | 18 | 25 |
| Image-Forming*7) Performance | I | (20° C., 65% RH) | Good | Very good | Good |
| | II | (30° C., 80% RH) | Good | Very good | Edge mark of cutting, Unevenness in half |

TABLE II-5-continued

| | | Example II-27 | Example II-28 | Comparative Example II-3 |
|---|---|---|---|---|
| | | | | tone area |
| | III (15° C., 30% RH) | Good | Very good | Unevenness of white spots in image portion |
| Water Retentivity of Light-Sensitive Material | | Good | Very good | Good |
| Printing Durability | | 8,000 Prints | 8,000 Prints | 5,000 Prints |

The characteristics were evaluated in the same manner as in Example II-2, except that some electrostatic characteristics and image forming performance were evaluated according to the following test methods.

*6) Electrostatic Characteristics: $E_{1/10}$ and $E_{1/100}$

The surface of the photoconductive layer was charged to −400 V with corona discharge, and then irradiated by visible light of the illuminance of 2.0 lux on the surface of the photoconductive layer. Then, the time required for decay of the surface potential ($V_{10}$) to 1/10 or 1/100 thereof was determined, and the exposure amount $E_{1/10}$ or $E_{1/100}$ (lux.sec) was calculated therefrom.

*7) Image Forming Performance:

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (Condition I), 30° C. and 80% RH (Condition II) or 15° C. and 30% RH (Condition III). The original used for the duplication was composed of cuttings of other originals pasted up thereon.

From the results shown above, it can be seen that each light-sensitive material exhibits good properties with respect to the surface smoothness of the photoconductive layer and electrostatic characteristics.

With respect to image-forming performance, the edge mark of cuttings pasted up was observed as background fog in the non-image areas or the occurrence of unevenness of white spots in the image portion was observed in the light-sensitive material of Comparative Example II-3 under the severe conditions. On the contrary, the light-sensitive materials according to the present invention provided clear duplicated images free from background fog.

Further, each of these light-sensitive materials was subjected to the oil-desensitizing treatment to prepare an offset printing plate and printing was conducted. The light-sensitive materials according to the present invention provided more than 8,000 prints of clear image without background stains. However, with the plate of Comparative Example II-3 subjected to plate making under the severe conditions, the above described edge mark of cuttings pasted up was not removed with the oil-desensitizing treatment and the background stains occurred from the start of printing, or the unevenness of duplicated image occurred on prints.

As can be seen from the above results, only the light-sensitive materials according to the present invention could provide the excellent performance.

EXAMPLE II-29

A mixture of 5 g of Resin (A-116), 35 g of Resin (B-5), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in II-27 to prepare an electrophotographic light-sensitive material.

As the result of the evaluation on various characteristics in the same manner as described in Example II-27, it can be seen that the light-sensitive material according to the present invention is excellent in charging properties, dark charge retention rate, and photosensitivity, and provides a clear duplicated image free from background fog and unevenness of image portion under severe conditions of high temperature and high humidity (30° C. and 80% RH) and low temperature and low humidity (15° C. and 30% RH). Further, when the material was employed as an offset master plate precursor, 8,000 prints of clear image quality were obtained.

EXAMPLES II-30 TO II-45

Each electrophotographic light-sensitive material was prepared in the same manner as described in Example II-29, except for using 6 g of each of Resin (A) and 34 g of each of Resin (B) shown in Table II-6 below in place of 5 g of Resin (A-116) and 35 g of Resin (B-5) used in Example II-29, respectively.

TABLE II-6

| Example | Resin (A) | Resin |
|---|---|---|
| II-30 | A-102 | B-20 |
| II-31 | A-103 | B-23 |
| II-32 | A-105 | B-18 |
| II-33 | A-107 | B-10 |
| II-34 | A-108 | B-2 |
| II-35 | A-111 | B-12 |
| II-36 | A-115 | B-22 |
| II-37 | A-117 | B-16 |
| II-38 | A-121 | B-13 |
| II-39 | A-126 | B-21 |
| II-40 | A-127 | B-17 |
| II-41 | A-128 | B-5 |
| II-42 | A-103 | B-104 |
| II-43 | A-109 | B-108 |
| II-44 | A-118 | B-116 |
| II-45 | A-125 | B-126 |

Each of the light-sensitive materials according to the present invention was excellent in charging properties, dark charge retention rate, and photosensitivity, and provided a clear duplicated image free from background fog, unevenness of image portion and scratches of fine lines even under severe conditions of high temperature and high humidity (30° C. and 80% RH) and low temperature and low humidity (15° C. and 30% RH). Further, when these materials were employed as offset master plate precursors, more than 8,000 prints of a clear image free from background stains were obtained respectively.

EXAMPLE III-1

A mixture of 6 g (solid basis) of Resin (A-3), 34 g (solid basis) of Resin (B-201), 200 g of photoconductive zinc oxide, 0.018 g of Methine Dye (III-I) having the following structure, 0.15 g of phthalic anhydride and 300 g of toluene was dispersed by a homogenizer (manufactured by Nippon Seiki K.K.) at $6\times10^3$ r.p.m. for 7 minutes to prepare a coating composition for a light-sensitive layer. The coating composition was coated on paper, which had been subjected to electrically conductive treatment, by a wire bar at a dry coverage of 28 g/m$^2$, followed by drying at 110° C. for 10 seconds. The coated material was then allowed to stand in a dark place at 20° C. and 65% RH (relative humidity) for 24 hours to prepare an electrophotographic light-sensitive material.

Methine Dye (III-I)

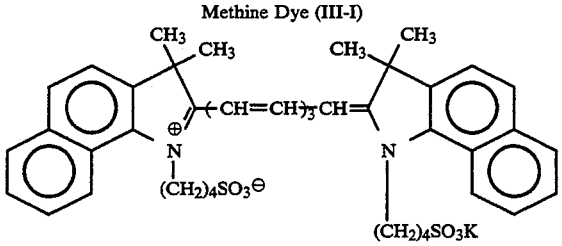

COMPARATIVE EXAMPLE III-1

An electrophotographic light-sensitive material was prepared in the same manner as in Example III-1, except for using 6 g of Resin (R-III-1) having the following structure and 34 g of Resin (R-III-2) having the following structure in place of 6 g of Resin (A-3) and 34 g of Resin (B-201) used in Example III-1, respectively.

Comparative Resin (R-III-1)

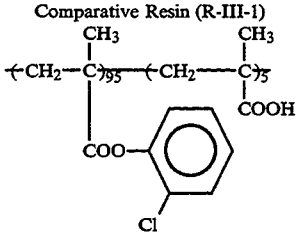

Mw: $8\times10^3$

Comparative Resin (R-III-2)

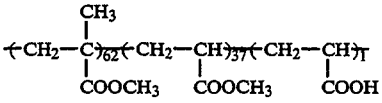

Mw: $7\times10^4$ (random copolymer)

COMPARATIVE EXAMPLE III-2

An electrophotographic light-sensitive material was prepared in the same manner as in Example III-1, except for using 6 g of Resin (R-III-3) having the following structure and 34 g of Resin (R-III-4) having the following structure in place of 6 g of Resin (A-8) and 34 g of Resin (B-201) Used in Example III-1, respectively.

Comparative Resin (R-III-3)

-continued

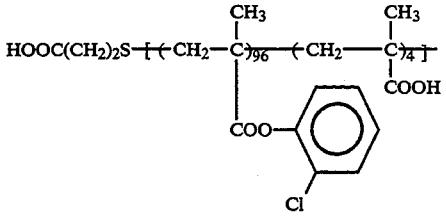

Mw: $8.5\times10^3$

Comparative Resin (R-III-4)

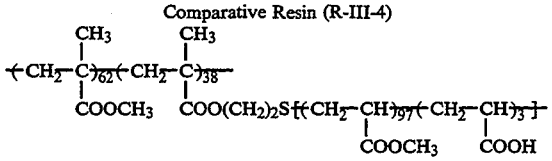

Mw: $7.5\times10^4$ (graft copolymer)

With each of the light-sensitive material thus prepared, film property, image forming performance and printing property were evaluated. The results obtained are shown in Table III-1 below.

TABLE III-1

| | Example III-1 | Comparative Example III-1 | Comparative Example III-2 |
|---|---|---|---|
| Smoothness of*1 Photoconductive Layer (sec/cc) | 310 | 320 | 300 |
| Image Forming*2 Performance | | | |
| I (20° C., 65% RH) | Very good | Good | Good |
| II (30° C., 80% RH) | Good | Unevenness in half tone area, slight background fog | Unevenness in half tone area, slight background fog |
| III (15° C., 30% RH) | Good | White spots in image portion | White spots in image portion |
| Water Retentivity of*3 Light-Sensitive Material | Good | Good | Very slight background stain |
| Printing Durability*4 | 8,000 Prints | Cut in image portion from the start of printing | Cut in image portion from the start of printing |

The evaluation of each item shown in Table III-1 was conducted in the following manner.

*1) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*2) Image Forming Performance

After the light-sensitive material was allowed to stand for one day under the ambient condition shown below, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of isoparaffinic solvent Isopar G (manufactured by Esso Chemical K.K.) and fixed. The duplicated image obtained was visually evaluated for fog and image quality.

The ambient condition at the time of image formation was 20° C. and 65% RH (Condition I), 30° C. and 80% RH (Condition II) or 15° C. and 30% RH (Condition III).

*3) Water Retentivity of Light-Sensitive Material

A degree of hydrophilicity of the light-sensitive material after being subjected to an oil-desensitizing treatment for use as a printing plate was evaluated by processing under the following forced condition. Specifically, the light-sensitive material without subjecting to plate making was passed once through an etching machine using an aqueous solution obtained by diluting an oil-desensitizing solution ELP-EX (produced by Fuji Photo Film Co., Ltd.) to a five-fold volume with distilled water. The material thus-treated was mounted on a printing machine ("Hamada Star Type 8005X" manufactured by Hamada Star K.K.) and printing was conducted. The extent of background stain occurred on the 50th print was visually evaluated.

*4) Printing Durability

The light-sensitive material was subjected to plate making in the same manner as described in *2) above, passed once through an etching machine with ELPEX. Printing was conducted using the plate thus-obtained and a number of prints on which background stain was first visually observed was determined.

As can be seen from the results shown in Table III-1 above, the light-sensitive material according to the present invention provided duplicated images having very clear highly accurate image portions such as fine lines, fine letters and dots of continuous gradation and no background stain. Further, it provided stably clear duplicated images even under the severe ambient condition such as a low temperature and low humidity condition or a high temperature and high humidity condition at the time of image formation.

On the contrary, although the light-sensitive materials of Comparative Examples III-1 and III-2 provided good duplicated images under the ambient condition of normal temperature and normal humidity (Condition I), the occurrence of unevenness of density was observed in the highly accurate image portions, in particular, half tone areas of continuous gradation upon the fluctuation of ambient condition at the time of image formation.

Then, in order to evaluate performance of each of the light-sensitive material as an off-set master plate, it was subjected to an oil-desensitizing treatment to prepare a printing plate.

When each of the light-sensitive materials was subjected to the oil-desensitizing treatment under the forced condition of using a solution of a reduced oil-desensitizing power, followed by practical printing, and the extent of adhesion of ink on prints was evaluated as described in *3), the adhesion of ink was observed in cases of using the light-sensitive materials of Comparative Examples III-1 and III-2, although no adhesion of ink occurred for the light-sensitive material according to the present invention.

As a result of conducting plate making, oil-desensitizing treatment under an usual condition and printing as described in *4), the light-sensitive material according to the present invention provided 8,000 prints of faithfully duplicated images without the occurrence of background stain. On the contrary, with the light-sensitive materials of Comparative Examples III-1 and III-2, only 3,000 prints and 5,000 prints could be obtained, respectively. Further, when the plate making was conducted under the severe condition of Condition II or Condition III, poor images on prints were obtained from the start of printing due to poor reproducibility of duplicated images.

From these results it is believed that the resin (A) and the resin (B) according to the present invention suitably interact with zinc oxide particles to form the condition under which the adsorption of spectral sensitizing dye and chemical sensitizer onto the surface of zinc oxide particles is not disturbed whereby the excellent electrophotographic characteristics are achieved and to form the condition under which an oil-desensitizing reaction proceeds easily and sufficiently with an oil-desensitizing solution and that the remarkable improvement in film strength is achieved by the action of the resin (B).

EXAMPLE III-2

A mixture of 5 g (solid basis) of Resin (A-12), 35 g (solid basis) of Resin (B-202), 200 g of photoconductive zinc oxide, 0.020 g of Methine Dye (III-II) having the following structure, 0.20 g of N-hydroxymalinimide and 300 g of toluene was treated in the same manner as described in Example III-1 to prepare an electrophotographic light-sensitive material.

Methine Dye (III-II)

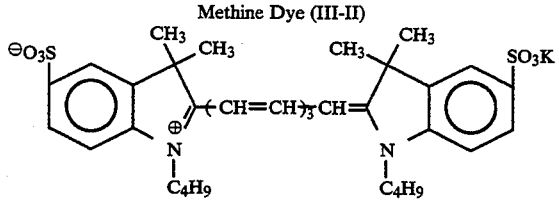

With the light-sensitive material thus-prepared, a film property in terms of surface smoothness, electrostatic characteristics, and image forming performance were evaluated. Further, printing property was evaluated when it was used as an electrophotographic lithographic printing plate precursor. The results obtained are shown in Table III-2 below.

TABLE III-2

| | | | Example III-2 |
|---|---|---|---|
| Smoothness of Photoconductive Layer (sec/cc) | | | 300 |
| Electrostatic Characteristics*5) | | | |
| $V_{10}$ (−V) | I | (20° C., 65% RH) | 810 |
| | II | (30° C., 80% RH) | 785 |
| | III | (15° C., 30% RH) | 815 |
| D.R.R. (%) | I | (20° C., 65% RH) | 91 |
| | II | (30° C., 80% RH) | 87 |
| | III | (15° C., 30% RH) | 90 |
| $E_{1/10}$ (erg/cm$^2$) | I | (20° C., 65% RH) | 25 |
| | II | (30° C., 80% RH) | 23 |
| | III | (15° C., 30% RH) | 28 |
| $E_{1/100}$ (erg/cm$^2$) | I | (20° C., 65% RH) | 36 |
| | II | (30° C., 80% RH) | 35 |
| | III | (15° C., 30% RH) | 51 |
| Image Forming Performance | I | (20° C., 65% RH) | Very good |
| | II | (30° C., 80% RH) | Good |
| | III | (15° C., 30% RH) | Good |
| Water Retentivity of Light-Sensitive Material | | | Good |
| Printing Durability | | | 10,000 Prints |

The evaluation of the electrostatic characteristics shown in Table III-2 was conducted in the following manner.

*5) Electrostatic Characteristics

The light-sensitive material was charged with a corona discharge to a voltage of −6 kV for 20 seconds in a dark room using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 120 seconds, and the potential $V_{130}$ was measured. The dark charge retention rate (DRR; %), i.e., percent retention of potential after dark decay for 120 seconds, was calculated from the following equation:

$$DRR(\%)=(_{130}/V_{10})\times 100$$

Separately, the surface of photoconductive layer was charged to −500 V with a corona discharge and then exposed to monochromatic light having a wavelength of 780 nm, and the time required for decay of the surface potential $V_{10}$ to one-tenth was measured, and the exposure amount $E_{1/10}$ (erg/cm$^2$) was calculated therefrom. Further, the light-sensitive material was charged to −500 V with a corona discharge in the same manner as described for the measurement of $E_{1/10}$, then exposed to monochromatic light having a wavelength of 780 nm, and the time required for decay of the surface potential $V_{10}$ to one-hundredth was measured, and the exposure amount $E_{1/100}$ (erg/cm$^2$) was calculated therefrom. The measurements were conducted under ambient condition of 20° C. and 65% RH (Condition I), 30° C. and 80% RH (Condition II) or 15° C. and 30% RH (Condition III).

As can be seen from the results shown above, the light-sensitive material according to the present invention had good surface smoothness which indicated a uniform dispersion state of zinc oxide. The electrostatic characteristics were stable and good even when the ambient condition was fluctuated. With the images forming performance, duplicated images faithful to the original were obtained without the formation of background fog. Further, when it was used as an offset master plate precursor and subjected to the oil-desensitizing treatment and printing, 10,000 prints of good quality were obtained.

EXAMPLES III-3 TO III-22

Each electrophotographic light-sensitive material was prepared in the same manner as described in Example III-2, except for using each of Resins (A) and Resins (B) shown in Table III-3 below in place of Resin (A-12) and Resin (B-202) used in Example III-2.

TABLE III-3

| Example | Resin (A) | Resin (B) |
|---|---|---|
| III-3 | A-2 | B-203 |
| III-4 | A-4 | B-204 |
| III-5 | A-5 | B-205 |
| III-6 | A-6 | B-206 |
| III-7 | A-7 | B-207 |
| III-8 | A-8 | B-208 |
| III-9 | A-9 | B-209 |
| III-10 | A-10 | B-210 |
| III-11 | A-12 | B-211 |
| III-12 | A-14 | B-212 |
| III-13 | A-15 | B-213 |
| III-14 | A-16 | B-214 |
| III-15 | A-18 | B-215 |
| III-16 | A-19 | B-218 |
| III-17 | A-20 | B-222 |
| III-18 | A-21 | B-223 |
| III-19 | A-24 | B-221 |
| III-20 | A-26 | B-224 |
| III-21 | A-28 | B-220 |
| III-22 | A-30 | B-226 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example III-2, more than 8,000 good prints were obtained respectively.

It can be seen from the results described above that each of the light-sensitive materials according to the present invention was satisfactory in all aspects of the surface smoothness and film strength of the photoconductive layer, electrostatic characteristics, and printing property. Also, it can be seen that the electrostatic characteristics are further improved by the use of the resin (A').

EXAMPLES III-23 TO III-26

Each electrophotographic light-sensitive material was prepared in the same manner as described in Example III-1, except for using each of the dyes shown in Table III-4 below in place of Methine Dye (III-I) used in Example III-1.

TABLE III-4

| Example | Dye | Chemical Structure of Dye |
|---|---|---|
| III-23 | (III-III) | 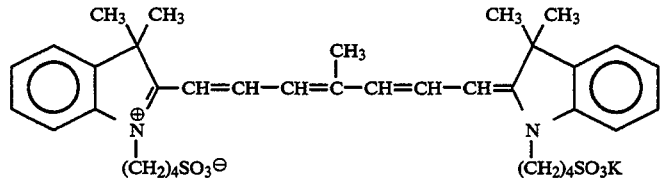 |
| III-24 | (III-IV) | 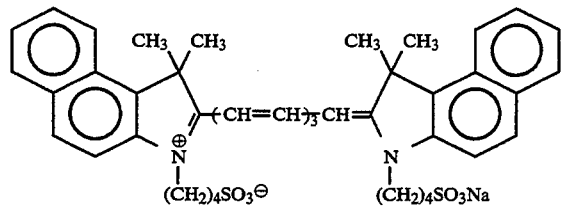 |

TABLE III-4-continued

| Example | Dye | Chemical Structure of Dye |
|---|---|---|
| III-25 | (III-V) | 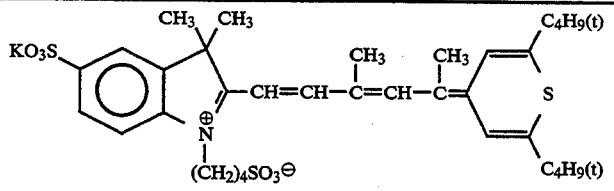 |
| III-26 | (III-VI) | 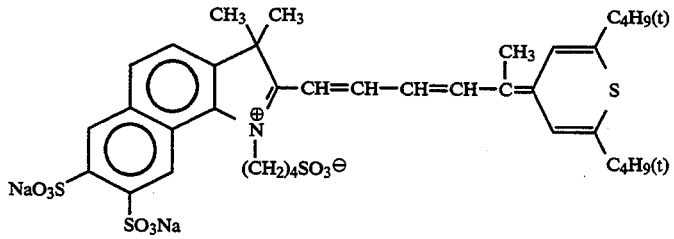 |

Each of the light-sensitive materials according to the present invention was excellent in charging properties, dark charge retention rate, and photosensitivity, and provided clear duplicated images free from background fog even when processed under severe conditions of high temperature and high humidity (30° C. and 80% RH) and low temperature and low humidity (15° C. and 30% RH).

EXAMPLES III-27 AND III-28

A mixture of 6 g of Resin (A-1) and 34 g of Resin (B-208) (Example III-27) or 6 g of Resin (A-29) and 34 g of Resin (B-222) (Example III-28), 200 g of photoconductive zinc oxide, 0.02 g of uranine, 0.03 g of Methine Dye (III-VII) having the following structure, 0.03 g of Methine Dye (III-VIII) having the following structure, 0.18 g of p-hydroxybenzoic acid and 300 g of toluene was dispersed by a homogenizer at $6\times10^3$ r.p.m. for 6 minutes to prepare a coating composition for a light-sensitive layer. The coating composition was coated on paper, which had been subjected to electrically conductive treatment, by a wire bar at a dry coverage of 20 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (III-VII)

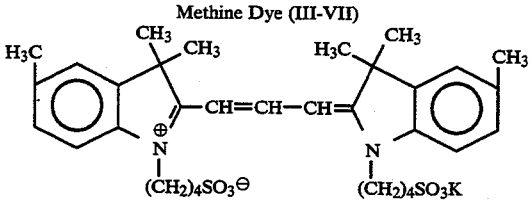

-continued

Methine Dye (III-VIII)

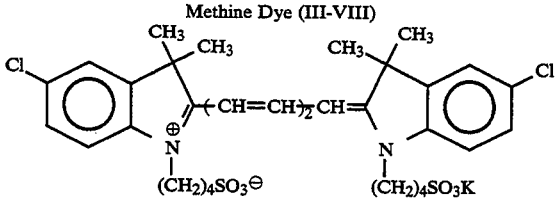

COMPARATIVE EXAMPLE III-3

An electrophotographic light-sensitive material was prepared in the same manner as in Example III-27, except for using 6 g of Resin (R-III-1) described above and 34 g of Resin (R-III-5) having the following structure in place of Resin (A-1) and Resin (B-208) used in Example III-27, respectively.

Comparative Resin (R-III-5)

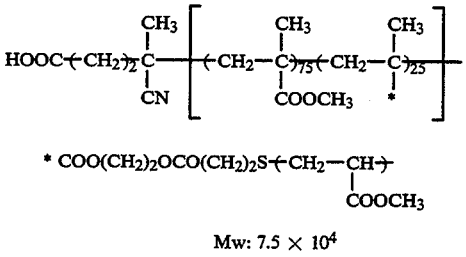

Mw: 7.5 × 10$^4$

With each of the light-sensitive materials thus prepared, various characteristics were evaluated in the same manner as in Example III-2. The results obtained are shown in Table III-5 below.

TABLE III-5

| | | Example III-27 | Example III-28 | Comparative Example III-3 |
|---|---|---|---|---|
| Binder Resin | | (A-1)/(B-208) | (A-29)/(B-222) | (R-III-1)/(R-III-5) |
| Smoothness of Photoconductive Layer (sec/cc) | | 250 | 260 | 255 |
| Electrostatic Characteristics*6) | | | | |
| $V_{10}$ (−V) | I (20° C., 65% RH) | 595 | 785 | 715 |
| | II (30° C., 80% RH) | 580 | 770 | 690 |
| | III (15° C., 30% RH) | 600 | 780 | 710 |

TABLE III-5-continued

| | | | Example III-27 | Example III-28 | Comparative Example III-3 |
|---|---|---|---|---|---|
| D.R.R. (%) | I | (20° C., 65% RH) | 88 | 94 | 88 |
| | II | (30° C., 80% RH) | 84 | 90 | 83 |
| | III | (15° C., 30% RH) | 89 | 93 | 90 |
| $E_{1/10}$ (lux · sec) | I | (20° C., 65% RH) | 11.5 | 8.4 | 10.5 |
| | II | (30° C., 80% RH) | 11.0 | 8.0 | 10.0 |
| | III | (15° C., 30% RH) | 12.2 | 9.1 | 11.3 |
| $E_{1/100}$ (lux · sec) | I | (20° C., 65% RH) | 21 | 14 | 24 |
| | II | (30° C., 80% RH) | 19 | 13 | 28 |
| | III | (15° C., 30% RH) | 23 | 16 | 31 |
| Image-Forming*7) Performance | I | (20° C., 65% RH) | Good | Very good | Good |
| | II | (30° C., 80% RH) | Good | Very good | Edge mark of cutting, Unevenness in half tone area |
| | III | (15° C., 30% RH) | Good | Very good | Unevenness of white spots in image portion |
| Water Retentivity of Light-Sensitive Material | | | Good | Very good | Good |
| Printing Durability | | | 8,000 Prints | 8,000 Prints | 5,000 Prints |

The characteristics were evaluated in the same manner as in Example III-2, except that some electrostatic characteristics and image forming performance were evaluated according to the following test methods.

*6) Electrostatic Characteristics: $E_{1/10}$ and $E_{1/100}$

The surface of the photoconductive layer was charged to −400 V with corona discharge, and then irradiated by visible light of the illuminance of 2.0 lux on the surface of the photoconductive layer. Then, the time required for decay of the surface potential ($V_{10}$) to 1/10 or 1/100 thereof was determined, and the exposure amount $E_{1/10}$ or $E_{1/100}$ (lux-sec) was calculated therefrom.

*7) Image Forming Performance:

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (Condition I), 30° C. and 80% RH (Condition II) or 15° C. and 30% RH (Condition III). The original used for the duplication was composed of cuttings of other originals pasted up thereon.

From the results shown above, it can be seen that each light-sensitive material exhibits good properties with respect to the surface smoothness of the photoconductive layer and electrostatic characteristics.

With respect to image-forming performance, the edge mark of cuttings pasted up was observed as background fog in the non-image areas or the occurrence of unevenness of white spots in the image portion was observed in the light-sensitive material of Comparative Example III-3 under the severe conditions. On the contrary, the light-sensitive materials according to the present invention provided clear duplicated images free from background fog.

Further, each of these light-sensitive materials was subjected to the oil-desensitizing treatment to prepare an offset printing plate and printing was conducted. The light-sensitive materials according to the present invention provided more than 8,000 prints of clear image without background stains. However, with the plate of Comparative Example III-3 subjected to plate making under the severe conditions, the above described edge mark of cuttings pasted up was not removed with the oil-desensitizing treatment and the background stains occurred from the start of printing, or the unevenness of duplicated image occurred on prints.

As can be seen from the above results, only the light-sensitive materials according to the present invention can provide the excellent performance.

EXAMPLE III-29

A mixture of 5 g of Resin (A-27), 35 g of Resin (B-224), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in III-27 to prepare an electrophotographic light-sensitive material.

As the result of the evaluation on various characteristics in the same manner as described in Example III-27, it can be seen that the light-sensitive material according to the present invention is excellent in charging properties, dark charge retention rate, and photosensitivity, and provides a clear duplicated image free from background fog and unevenness of image portion under severe conditions of high temperature and high humidity (30° C. and 80% RH) and low temperature and low humidity (15° C. and 30% RH). Further, when the material was employed as an offset master plate precursor, 8,000 prints of clear image quality were obtained.

EXAMPLES III-30 TO III-41

Each electrophotographic light-sensitive material was prepared in the same manner as described in Example III-29, except for using 6 g of each of Resin (A) and 34 g of each of Resin (B) shown in Table III-6 below in place of 5 g of Resin (A-27) and 35 g of Resin (B-224) used in Example III-29, respectively.

TABLE III-6

| Example | Resin (A) | Resin (B) |
|---|---|---|
| III-30 | A-1 | B-203 |
| III-31 | A-2 | B-205 |
| III-32 | A-3 | B-207 |
| III-33 | A-5 | B-211 |
| III-34 | A-17 | B-212 |
| III-35 | A-21 | B-215 |
| III-36 | A-22 | B-219 |
| III-37 | A-23 | B-220 |
| III-38 | A-25 | B-221 |
| III-39 | A-28 | B-223 |
| III-40 | A-29 | B-225 |

TABLE III-6-continued

| Example | Resin (A) | Resin (B) |
|---|---|---|
| III-41 | A-30 | B-226 |

Each of the light-sensitive materials according to the present invention was excellent in charging properties, dark charge retention rate, and photosensitivity, and provided a clear duplicated image free from background fog, unevenness of image portion and scratches of fine lines even under severe conditions of high temperature and high humidity (30° C. and 80% RH) and low temperature and low humidity (15° C. and 30% RH). Further, when these materials were employed as offset master plate precursors, more than 8,000 prints of a clear image free from background stains were obtained respectively.

EXAMPLE IV-1

A mixture of 7 g (solid basis) of Resin (A-103), 33 g (solid basis) of Resin (B-201), 200 g of photoconductive zinc oxide, 0.018 g of Methine Dye (IV-I) having the following structure, 0.15 g of phthalic anhydride and 300 g of toluene was dispersed by a homogenizer (manufactured by Nippon Seiki K.K.) at $6\times10^3$ r.p.m. for 8 minutes to prepare a coating composition for a light-sensitive layer. The coating composition was coated on paper, which had been subjected to electrically conductive treatment, by a wire bar at a dry coverage of 25 g/m$^2$, followed by drying at 110° C. for 10 seconds. The coated material was then allowed to stand in a dark place at 20° C. and 65% RH (relative humidity) for 24 hours to prepare an electrophotographic light-sensitive material.

Methine Dye (IV-I)

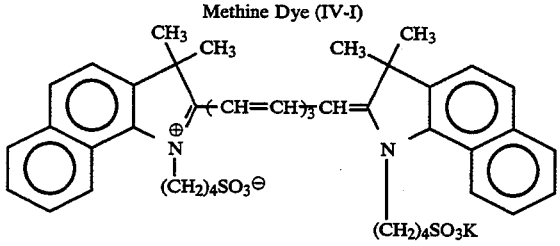

COMPARATIVE EXAMPLE IV-1

An electrophotographic light-sensitive material was prepared in the same manner as in Example IV-1, except for using 7 g of Resin (R-IV-1) having the following structure and 33 g of Resin (R-IV-2) having the following structure in place of 7 g of Resin (A-103) and 33 g of Resin (B-201) used in Example IV-1, respectively.

Comparative Resin (R-IV-1)

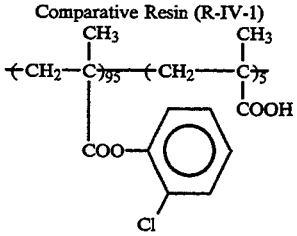

Mw: $8\times10^3$

-continued

Comparative Resin (R-IV-2)

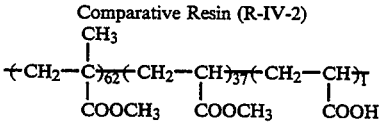

Mw: $7\times10^4$ (random copolymer)

COMPARATIVE EXAMPLE IV-2

An electrophotographic light-sensitive material was prepared in the same manner as in Example IV-1, except for using 7 g of Resin (R-IV-3) having the following structure and 33 g of Resin (R-IV-4) having the following structure in place of 7 g of Resin (A-103) and 33 g of Resin (B-201) used in Example IV-1, respectively.

Comparative Resin (R-IV-3)

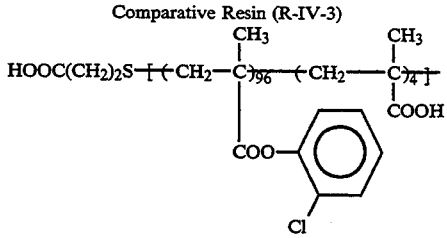

Mw: $8.5\times10^3$

Comparative Resin (R-IV-4)

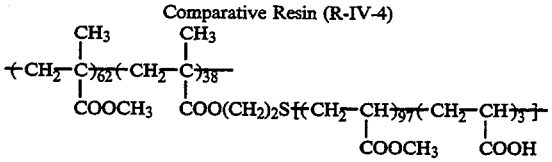

Mw: $7.5\times10^4$ (graft copolymer)

With each of the light-sensitive material thus prepared, film property, image forming performance and printing property were evaluated. The results obtained are shown in Table IV-1 below.

TABLE IV-1

| | Example IV-1 | Comparative Example IV-1 | Comparative Example IV-2 |
|---|---|---|---|
| Smoothness of*1 Photoconductive Layer (sec/cc) | 450 | 430 | 455 |
| Image Forming*2 Performance | | | |
| I (20° C., 65% RH) | Very good | Good | Good |
| II (30° C., 80% RH) | Good | Unevenness in half tone area, slight background fog | Unevenness in half tone area, slight background fog |
| III (15° C., 30% RH) | Good | White spots in image portion | White spots in image portion |
| Water Retentivity of*3 Light-Sensitive Material | Good | Good | Very slight background stain |
| Printing Durability*4 | 8,000 Prints | Cut in image portion from the start of printing | Cut in image portion from the start of printing |

The evaluation of each item shown in Table IV-1 was conducted in the following manner.

*1) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*2) Image Forming Performance

After the light-sensitive material was allowed to stand for one day under the ambient condition shown below, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of isoparaffinic solvent Isopar G (manufactured by Esso Chemical K.K.) and fixed. The duplicated image obtained was visually evaluated for fog and image quality.

The ambient condition at the time of image formation was 20° C. and 65% RH (Condition I), 30° C. and 80% RH (Condition II) or 15° C. and 30% RH (Condition III).

*3) Water Retentivity of Light-Sensitive Material

A degree of hydrophilicity of the light-sensitive material after being subjected to an oil-desensitizing treatment for use as a printing plate was evaluated by processing under the following forced condition. Specifically, the light-sensitive material without subjecting to plate making was passed once through an etching machine using an aqueous solution obtained by diluting an oil-desensitizing solution ELP-EX (produced by Fuji Photo Film Co., Ltd.) to a five-fold volume with distilled water. The material thus-treated was mounted on a printing machine ("Hamada Star Type 8005X" manufactured by Hamada Star K.K.) and printing was conducted. The extent of background stain occurred on the 50th print was visually evaluated.

*4) Printing Durability

The light-sensitive material was subjected to plate making in the same manner as described in *2) above, passed once through an etching machine with ELPEX. Printing was conducted using the plate thus-obtained and a number of prints on which background stain was first visually observed was determined.

As can be seen from the results shown in Table IV-1 above, the light-sensitive material according to the present invention provided duplicated images having very clear highly accurate image portions such as fine lines, fine letters and dots of continuous gradation and no background stain. Further, it provided stably clear duplicated images even under the severe ambient condition such as a low temperature and low humidity condition or a high temperature and high humidity condition at the time of image formation.

On the contrary, although the light-sensitive materials of Comparative Examples IV-1 and IV-2 provided good duplicated images under the ambient condition of normal temperature and normal humidity (Condition I), the occurrence of unevenness of density was observed in the highly accurate image portions, in particular, half tone areas of continuous gradation upon the fluctuation of ambient condition at the time of image formation.

Then, in order to evaluate performance of each of the light-sensitive material as an off-set master plate, it was subjected to an oil-desensitizing treatment to prepare a printing plate.

When each of the light-sensitive materials was subjected to the oil-desensitizing treatment under the forced condition of using a solution of a reduced oil-desensitizing power, followed by practical printing, and the extent of adhesion of ink on prints was evaluated as described in *3), the adhesion of ink was observed in cases of using the light-sensitive materials of Comparative Examples IV-1 and IV-2, although no adhesion of ink occurred for the light-sensitive material according to the present invention.

As a result of conducting plate making, oil-desensitizing treatment under an usual condition and printing as described in *4), the light-sensitive material according to the present invention provided 8,000 prints of faithfully duplicated images without the occurrence of background stain. On the contrary, with the light-sensitive materials of Comparative Examples IV-1 and IV-2, when the plate making was conducted under the severe condition of Condition II or Condition III, poor images on prints were obtained from the start of printing due to poor reproducibility of duplicated images.

From these results it is believed that the resin (A) and the resin (B) according to the present invention suitably interact with zinc oxide particles to form the condition under which the adsorption of spectral sensitizing dye and chemical sensitizer onto the surface of zinc oxide particles is not disturbed whereby the excellent electrophotographic charactenstics are achieved and to form the condition under which an oil-desensitizing reaction proceeds easily and sufficiently with an oil-desensitizing solution and that the remarkable improvement in film strength is achieved by the action of the resin (B).

EXAMPLE IV-2

A mixture of 6 g (solid basis) of Resin (A-111), 34 g (solid basis) of Resin (B-202), 200 g of photoconductive zinc oxide, 0.020 g of Methine Dye (IV-II) shown below, 0.20 g of N-hydroxymalinimide and 300 g of toluene was treated in the same manner as described in Example IV-1 to prepare an electrophotographic light-sensitive material.

Methine Dye (IV-II)

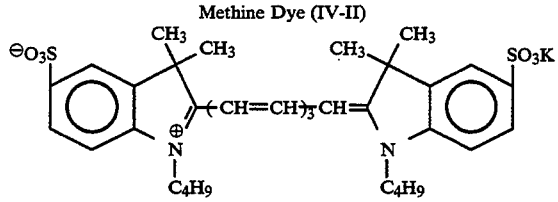

With the light-sensitive material thus-prepared, a film property in terms of surface smoothness, electrostatic characteristics, and image forming performance were evaluated. Further, printing property was evaluated when it was used as an electrophotographic lithographic printing plate precursor. The results obtained are shown in Table IV-2 below.

TABLE IV-2

| | | | Example IV-2 |
|---|---|---|---|
| Smoothness of Photoconductive Layer (sec/cc) | | | 460 |
| Electrostatic Characteristics*5) | | | |
| $V_{10}$ (−V) | I | (20° C., 65% RH) | 780 |
| | II | (30° C., 80% RH) | 765 |
| | III | (15° C., 30% RH) | 785 |
| D.R.R. (%) | I | (20° C., 65% RH) | 93 |
| | II | (30° C., 80% RH) | 88 |

TABLE IV-2-continued

| | | | Example IV-2 |
|---|---|---|---|
| | III | (15° C., 30% RH) | 92 |
| $E_{1/10}$ (erg/cm$^2$) | I | (20° C., 65% RH) | 21 |
| | II | (30° C., 80% RH) | 20 |
| | III | (15° C., 30% RH) | 24 |
| $E_{1/100}$ (erg/cm$^2$) | I | (20° C., 65% RH) | 30 |
| | II | (30° C., 80% RH) | 31 |
| | III | (15° C., 30% RH) | 48 |
| Image Forming Performance | I | (20° C., 65% RH) | Very good |
| | II | (30° C., 80% RH) | Good |
| | III | (15° C., 30% RH) | Good |
| Water Retentivity of Light-Sensitive Material | | | Good |
| Printing Durability | | | 10,000 Prints |

The evaluation of the electrostatic characteristics shown in Table IV-2 was conducted in the following manner.

*5) Electrostatic Characteristics

The light-sensitive material was charged with a corona discharge to a voltage of −6 kV for 20 seconds in a dark room using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 120 seconds, and the potential $V_{130}$ as measured. The dark charge retention rate (DRR; %), i.e., percent retention of potential after dark decay for 120 seconds, was calculated from the following equation:

$$DRR(\%)=(V_{130}/V_{10})\times 100$$

Separately, the surface of photoconductive layer was charged to −500 V with a corona discharge and then exposed to monochromatic light having a wavelength of 780 nm, and the time required for decay of the surface potential $V_{10}$ to one-tenth was measured, and the exposure amount $E_{1/10}$ (erg/cm$^2$) was calculated therefrom. Further, the light-sensitive material was charged to −500 V with a corona discharge in the same manner as described for the measurement of $E_{1/10}$, then exposed to monochromatic light having a wavelength of 780 nm, and the time required for decay of the surface potential $V_{10}$ to one-hundredth was measured, and the exposure amount $E_{1/100}$ (erg/cm$^2$) was calculated therefrom. The measurements were conducted under ambient condition of 20° C. and 65% RH (Condition I), 30° C. and 80% RH (Condition II) or 15° C. and 30% RH (Condition III).

As can be seen from the results shown above, the light-sensitive material according to the present invention had good surface smoothness which indicated a uniform dispersion state of zinc oxide. The electrostatic characteristics were stable and good even when the ambient condition was fluctuated. With the images forming performance, duplicated images faithful to the original were obtained without the formation of background fog. Further, when it was used as an offset master plate precursor and subjected to the oil-desensitizing treatment and printing, 10,000 prints of good quality were obtained.

EXAMPLES IV-3 TO IV-22

Each electrophotographic light-sensitive material was prepared in the same manner as described in Example IV-2, except for using each of Resins (A) and Resins (B) shown in Table IV-3 below in place of Resin (A-111) and Resin (B-202) used in Example IV-2.

TABLE IV-3

| Example | Resin (A) | Resin (B) |
|---|---|---|
| IV-3 | A-102 | B-203 |
| IV-4 | A-104 | B-204 |
| IV-5 | A-105 | B-205 |
| IV-6 | A-106 | B-206 |
| IV-7 | A-107 | B-207 |
| IV-8 | A-108 | B-208 |
| IV-9 | A-109 | B-209 |
| IV-10 | A-110 | B-210 |
| IV-11 | A-112 | B-211 |
| IV-12 | A-114 | B-212 |
| IV-13 | A-116 | B-213 |
| IV-14 | A-117 | B-214 |
| IV-15 | A-118 | B-215 |
| IV-16 | A-119 | B-218 |
| IV-17 | A-120 | B-222 |
| IV-18 | A-121 | B-223 |
| IV-19 | A-122 | B-221 |
| IV-20 | A-123 | B-224 |
| IV-21 | A-129 | B-220 |
| IV-22 | A-131 | B-226 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example IV-2, more than 8,000 good prints were obtained respectively.

It can be seen from the results described above that each of the light-sensitive materials according to the present invention was satisfactory in all aspects of the surface smoothness and film strength of the photoconductive layer, electrostatic characteristics, and printing property. Also, it can be seen that the electrostatic characteristics are further improved by the use of the resin (A').

EXAMPLES IV-23 TO IV-26

Each electrophotographic light-sensitive material was prepared in the same manner as described in Example IV-1, except for using each of the dyes shown in Table IV-4 below in place of Methine Dye (IV-I) used in Example IV-1.

TABLE IV-4

| Example | Dye | Chemical Structure of Dye |
|---|---|---|
| IV-23 | (IV-III) | 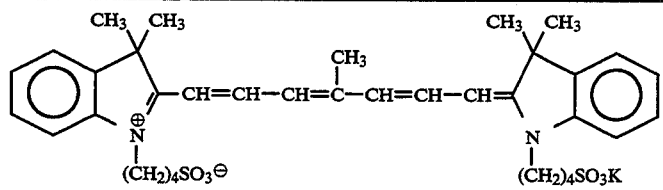 |

TABLE IV-4-continued

| Example | Dye | Chemical Structure of Dye |
|---|---|---|
| IV-24 | (IV-IV) | 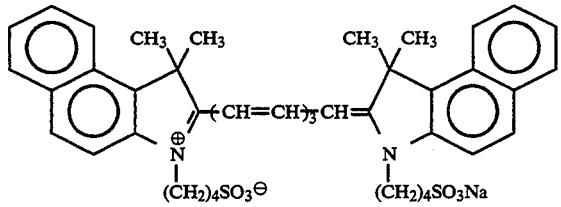 |
| IV-25 | (IV-V) | 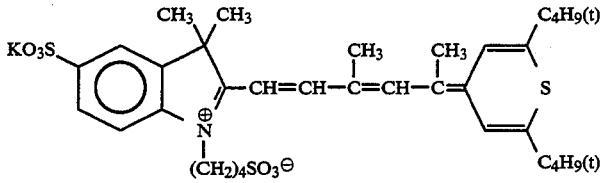 |
| IV-26 | (IV-VI) | 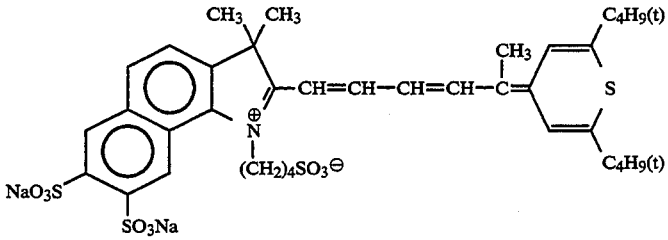 |

Each of the light-sensitive materials according to the present invention was excellent in charging properties, dark charge retention rate, and photosensitivity, and provided clear duplicated images free from background fog even when processed under severe conditions of high temperature and high humidity (30° C. and 80% RH) and low temperature and low humidity (15° C. and 30% RH).

EXAMPLES IV-27 AND IV-28

A mixture of 6 g of Resin (A-130) and 34 g of Resin (B-211) (Example IV-27) or 6 g of Resin (A-117) and 34 g of Resin (B-208) (Example IV-28), 200 g of photoconductive zinc oxide, 0.02 g of uranine, 0.03 g of Methine Dye (IV-VII) having the following structure, 0.03 g of Methine Dye (IV-VIII) having the following structure, 0.18 g of p-hydroxybenzoic acid and 300 g of toluene was dispersed by a homogenizer at $7\times10^3$ r.p.m. for 5 minutes to prepare a coating composition for a light-sensitive layer. The coating composition was coated on paper, which had been subjected to electrically conductive treatment, by a wire bar at a dry coverage of 20 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (IV-VII)

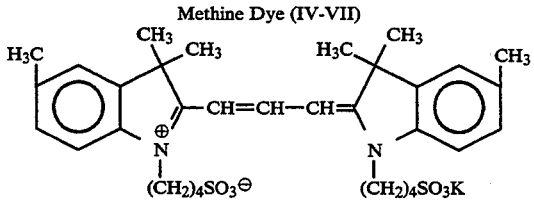

-continued

Methine Dye (IV-VIII)

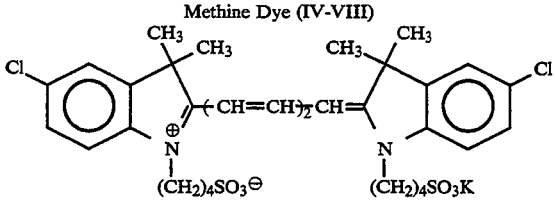

COMPARATIVE EXAMPLE IV-3

An electrophotographic light-sensitive material was prepared in the same manner as in Example IV-27, except for using 6 g of Resin (R-IV-l) described above and 34 g of Resin (R-IV-5) shown below in place of Resin (A-130) and Resin (B-211) used in Example IV-27, respectively.

Comparative Resin (R-IV-5)

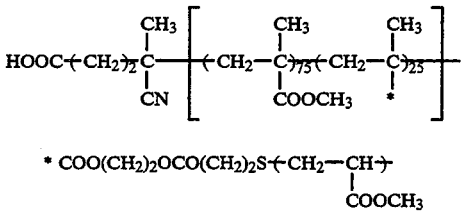

Mw: 7.5 × 10$^4$

With each of the light-sensitive materials thus prepared, various characteristics were evaluated in the same manner as in Example IV-2. The results obtained are shown in Table IV-5 below.

TABLE IV-5

| | | | Example IV-27 | Example IV-28 | Comparative Example IV-3 |
|---|---|---|---|---|---|
| Binder Resin | | | (A-130)/(B-211) | (A-117)/(B-208) | (R-IV-1)/(R-IV-5) |
| Smoothness of Photoconductive Layer (sec/cc) | | | 350 | 360 | 350 |
| Electrostatic Characteristics*6) | | | | | |
| $V_{10}$ (−V) | I | (20° C., 65% RH) | 650 | 760 | 730 |
| | II | (30° C., 80% RH) | 635 | 745 | 710 |
| | III | (15° C., 30% RH) | 650 | 740 | 735 |
| D.R.R. (%) | I | (20° C., 65% RH) | 90 | 95 | 91 |
| | II | (30° C., 80% RH) | 88 | 91 | 88 |
| | III | (15° C., 30% RH) | 90 | 94 | 92 |
| $E_{1/10}$ (lux · sec) | I | (20° C., 65% RH) | 11.3 | 8.6 | 9.8 |
| | II | (30° C., 80% RH) | 10.7 | 8.0 | 9.3 |
| | III | (15° C., 30% RH) | 12.0 | 9.2 | 10.4 |
| $E_{1/100}$ (lux · sec) | I | (20° C., 65% RH) | 19 | 13 | 18 |
| | II | (30° C., 80% RH) | 17 | 12 | 19 |
| | III | (15° C.,30% RH) | 20 | 15 | 23 |
| Image-Forming*7) Performance | I | (20° C., 65% RH) | Good | Very good | Good |
| | II | (30° C., 80% RH) | Good | Very good | Edge mark of cutting, Unevenness in half tone area |
| | III | (15° C., 30% RH) | Good | Very good | Unevenness of white spots in image portion |
| Water Retentivity of Light-Sensitive Material | | | Good | Very good | Good |
| Printing Durability | | | 8,000 Prints | 8,000 Prints | 5,000 Prints |

The characteristics were evaluated in the same manner as in Example IV-2, except that some electrostatic characteristics and image forming performance were evaluated according to the following test methods.

*6) Electrostatic Characteristics: $E_{1/10}$ and $E_{1/100}$

The surface of the photoconductive layer was charged to −400 V with corona discharge, and then irradiated by visible light of the illuminance of 2.0 lux on the surface of the photoconductive layer. Then, the time required for decay of the surface potential ($V_{10}$) to 1/10 or 1/100 thereof was determined, and the exposure amount $E_{1/10}$ or $E_{1/100}$ (lux.sec) was calculated therefrom.

*7) Image Forming Performance:

The electrophotographic light-sensitive material was allowed to stand for one day under the ambient condition described below, the light-sensitive material was subjected to plate making by a full-automatic plate making machine (ELP-404V manufactured by Fuji Photo Film Co., Ltd.) using ELP-T as a toner. The duplicated image thus obtained was visually evaluated for fog and image quality. The ambient condition at the time of image formation was 20° C. and 65% RH (Condition I), 30° C. and 80% RH (Condition II) or 15 C. and 30% RH (Condition III). The original used for the duplication was composed of cuttings of other originals pasted up thereon.

From the results shown above, it can be seen that each light-sensitive material exhibits good properties with respect to the surface smoothness of the photoconductive layer and electrostatic characteristics.

With respect to image-forming performance, the edge mark of cuttings pasted up was observed as background fog in the non-image areas or the occurrence of unevenness of white spots in the image portion was observed in the light-sensitive material of Comparative Example-IV-3 under the severe conditions. On the contrary, the light-sensitive materials according to the present invention provided clear duplicated images free from background fog.

Further, each of these light-sensitive materials was subjected to the oil-desensitizing treatment to prepare an offset printing plate and printing was conducted. The light-sensitive materials according to the present invention provided more than 8,000 prints of clear image without background stains. However, with the plate of Comparative Example IV-3 subjected to plate making under the severe conditions, the above described edge mark of cuttings pasted up was not removed with the oil-desensitizing treatment and the background stains occurred from the start of printing, or the unevenness of duplicated image occurred on prints.

As can be seen from the above results, only the light-sensitive materials according to the present invention can provide the excellent performance.

EXAMPLE IV-29

A mixture of 5 g of Resin (A-116), 35 g of Resin (B-205), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in IV-27 to prepare an electrophotographic light-sensitive material.

As the result of the evaluation on various characteristics in the same manner as described in Example IV-27, it can be seen that the light-sensitive material according to the present invention is excellent in charging properties, dark charge retention rate, and photosensitivity, and provides a clear duplicated image free from background fog and unevenness of image portion under severe conditions of high temperature and high humidity (30° C. and 80% RH) and low temperature and low humidity (15° C. and 30% RH). Further, when the material was employed as an offset master plate precursor, 8,000 prints of clear image quality were obtained.

EXAMPLES IV-30 TO IV-41

Each electrophotographic light-sensitive material was prepared in the same manner as described in Example IV-29, except for using 6 g of each of Resin (A) and 34 g of each of Resin (B) shown in Table IV-6 below in place of 5 g of Resin (A-116) and 35 g of Resin (B-5) used in Example IV-29, respectively.

TABLE IV-6

| Example | Resin (A) | Resin (B) |
|---|---|---|
| IV-30 | A-101 | B-203 |
| IV-31 | A-102 | B-205 |
| IV-32 | A-103 | B-207 |
| IV-33 | A-105 | B-208 |
| IV-34 | A-107 | B-209 |
| IV-35 | A-110 | B-210 |
| IV-36 | A-116 | B-212 |
| IV-37 | A-120 | B-215 |
| IV-38 | A-122 | B-219 |
| IV-39 | A-126 | B-221 |
| IV-40 | A-127 | B-224 |
| IV-41 | A-128 | B-225 |

Each of the light-sensitive materials according to the present invention was excellent in charging properties, dark charge retention rate, and photosensitivity, and provided a clear duplicated image free from background fog, unevenness of image portion and scratches of fine lines even under severe conditions of high temperature and high humidity (30° C. and 80% RH) and low temperature and low humidity (15° C. and 30% RH). Further, when these materials were employed as offset master plate precursors, more than 8,000 prints of a clear image free from background stains were obtained respectively.

POSSIBILITY OF UTILIZATION IN INDUSTRY

In accordance with the present invention, an electrophotographic light-sensitive material which exhibits excellent electrostatic characteristics (particularly, under severe conditions) and mechanical strength and provides clear images of good quality can be obtained. The electrophotographic light-sensitive material according to the present invention is particularly useful in the scanning exposure system using a semiconductor laser beam. The electrostatic characteristics are further improved by using the resin according to the present invention which contains a reapeating unit having the specific methacrylate component.

What is claimed is:

1. An electrophotographic light-sensitive material having a photoconductive layer containing at least an inorganic photoconductive substance, a spectral sensitizing dye and a binder resin, wherein the binder resin comprises at least one resin (A) shown below and at least one resin (B) shown below:

Resin (A):

a starlike polymer having a weight average molecular weight of from $1\times10^3$ to $2\times10^4$ and comprising an organic molecule having a weight average molecular weight of 1,000 or less and having bonded thereto at least three polymer chains each containing a polymer component containing at least one polar group selected from the group consisting of

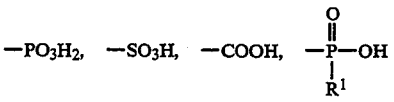

(wherein $R^1$ is a hydrocarbon group and $—OR^2$ (wherein $R^2$ represents a hydrocarbon group)) and a cyclic acid anhydride group and a polymer component corresponding to a repeating unit represented by the general formula (I) described below, wherein the starlike polymer contains the polymer component containing a polar group in an amount of from 1 to 20% by weight and the polymer component represented by the general formula (I) in an amount not less than 30% by weight:

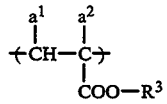

Formula (I)

(wherein $a^1$ and $a^2$ each is a hydrogen atom, a halogen atom, a cyano group, a hydrocarbon group, $—COOR^4$ or $—COOR^4$ bonded via a hydrocarbon group (wherein $R^4$ represents a hydrocarbon group); and $R^3$ represents a hydrocarbon group);

an AB block copolymer having a weight average molecular weight of from $3\times10^4$ to $1\times10^6$ and comprising an A block containing a polymer component containing at least one polar group selected from the specified polar groups as described in the resin (A) above and a B block containing a polymer component corresponding to a repeating unit represented by the general formula (I) as described in the resin (A) above, wherein the A block contains the polymer component containing a polar group in an amount of from 0.05 to 10% by weight based on the AB block copolymer and the B block contains the polymer component represented by the general formula (I) in an amount not less than 30% by weight based on the AB block copolymer.

2. An electrophotographic light-sensitive material as claimed in claim 1, wherein the resin (A) contains, as the polymer component represented by the general formula (I), at least one methacrylate component having an aryl group represented by the following general formulae (Ia) and (Ib):

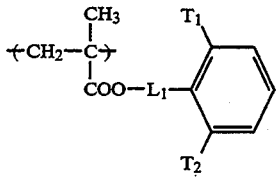

Formula (Ia)

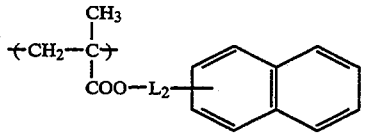

Formula (Ib)

wherein $T_1$ and $T_2$ each is a hydrogen atom, a halogen atom, a hydrocarbon group having from 1 to 10 carbon atoms, a cyano group, $—COR_a$ or $—COOR_a$ (wherein $R_a$ represents a hydrocarbon group having from 1 to 10 carbon atoms); and $L_1$ and $L_2$ each represents a mere bond or a linking group containing from 1 to 4 linking atoms, which connects —COO— and the benzene ring.

3. An electrophotographic light-sensitive material as claimed in claim 1, wherein the total amount of the specified polar group-containing polymer component contained in the copolymer of the resin (B) is from 10 to 50% by weight based on the total amount of the specified polar group-containing polymer component present in the resin (A).

4. An electrophotographic light-sensitive material as claimed in claim 1, wherein the polymer chain in the resin (A) is an AB block polymer chain composed of an A block comprising a polymer component containing the polar group and a B block comprising a polymer component corresponding to the general formula (I).

5. An electrophotographic light-sensitive material as claimed in claim 1, wherein the resin (B) is an AB block copolymer wherein the A block polymer chain and the B block polymer chain respectively comprise the terminal ends of the AB block copolymer.

6. An electrophotographic light-sensitive material as claimed in claim 1, wherein the resin (B) is an AB block copolymer wherein the polar group-containing polymer component is bonded at one terminal of the A block polymer chain and the B block polymer chain is bonded at the other terminal of the A block polymer chain.

7. An electrophotographic light-sensitive material as claimed in claim 1, wherein the resin (B) is an AB block copolymer wherein the B block polymer chains are bonded at both terminals of the A block polymer chain.

8. An electrophotographic light-sensitive material as claimed in claim 1, wherein the organic molecule includes a tri- or higher-valent hydrocarbon moiety selected from the group consisting of

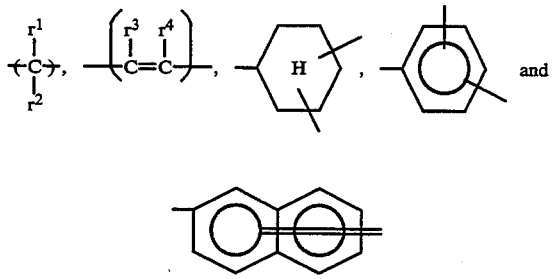

wherein ( ) represents a repeating unit; $r^1$, $r^2$, $r^3$ and $r^4$ each is a hydrogen atom or a hydrocarbon group, provided that at least one of $r^1$ and $r^2$ or $r^3$ and $r^4$ is bonded to a polymer chain, or a combination of said hydrocarbon moieties with or without a linking unit selected from the group consisting of —O—, —S—, $$-\overset{r^7}{\overset{|}{N}}-$$

(wherein r is a hydrogen atom or a hydrocarbon group), —CO—, —CS—, —COO—, $$-\overset{r^7}{\overset{|}{CON}}-,$$

$-SO_2$, $$-\overset{r^7}{\overset{|}{SO_2N}}-,$$

—NHCOO—, —NHCONH— and a heterocyclic group containing at least one hetero atom.

9. An electrophotographic light-sensitive material as claimed in claim 1, wherein the organic molecule includes a moiety comprising a combination of $$-\overset{|}{N}-,\quad -\overset{\overset{O}{\|}}{\underset{|}{P}}-\quad \text{or}\quad -\overset{|}{\underset{|}{Si}}-$$

with a linking unit selected from the group consisting of —O—, —S—, $$-\overset{r^7}{\overset{|}{N}}-$$

(wherein $r^7$ is a hydrogen atom or a hydrocarbon group), —CO—, —CS—, —COO—, $$-\overset{r^7}{\overset{|}{CON}}-,$$

$-SO_2$, $$-\overset{r^7}{\overset{|}{SO_2N}}-,$$

—NHCOO—, —NHCONH— and a heterocyclic group containing at least one hetero atom.

* * * * *